US011842642B2

(12) United States Patent
Ran et al.

(10) Patent No.: US 11,842,642 B2
(45) Date of Patent: Dec. 12, 2023

(54) CONNECTED AUTOMATED VEHICLE HIGHWAY SYSTEMS AND METHODS RELATED TO HEAVY VEHICLES

(71) Applicant: CAVH LLC, Fitchburg, WI (US)

(72) Inventors: Bin Ran, Fitchburg, WI (US); Yang Cheng, Middleton, WI (US); Kun Luan, Madison, WI (US); Haiyan Yu, Madison, WI (US); Yi Shen, Madison, WI (US); Shiyan Xu, Madison, WI (US); Xiaoli Zhang, Madison, WI (US); Hongli Gao, Madison, WI (US); Shaohua Wang, Madison, WI (US); Hongliang Wan, Madison, WI (US); Linchao Li, Madison, WI (US); Linghui Xu, Madison, WI (US); Liling Zhu, Madison, WI (US); Linfeng Zhang, Madison, WI (US); Yifei Wang, Madison, WI (US); Qin Li, Madison, WI (US); Yanyan Qin, Madison, WI (US); Hainan Huang, Madison, WI (US); Dongye Sun, Madison, WI (US); Liping Zhao, Madison, WI (US)

(73) Assignee: CAVH LLC, Fitchburg, WI (US)

( * ) Notice: Subject to any disclaimer, the term of this patent is extended or adjusted under 35 U.S.C. 154(b) by 217 days.

(21) Appl. No.: 16/446,082

(22) Filed: Jun. 19, 2019

(65) Prior Publication Data

US 2019/0392712 A1 Dec. 26, 2019

Related U.S. Application Data

(60) Provisional application No. 62/687,435, filed on Jun. 20, 2018.

(51) Int. Cl.
*G08G 1/16* (2006.01)
*G08G 1/01* (2006.01)

(52) U.S. Cl.
CPC ..... *G08G 1/164* (2013.01); *G08G 1/0116* (2013.01); *G08G 1/0125* (2013.01); *G08G 1/167* (2013.01); *G08G 1/161* (2013.01)

(58) Field of Classification Search
None
See application file for complete search history.

(56) References Cited

U.S. PATENT DOCUMENTS 3,824,469 A 7/1974 Ristenbatt
4,023,017 A 5/1977 Ceseri
(Continued)

FOREIGN PATENT DOCUMENTS

CN 102768768 B 11/2012
CN 103854473 A 6/2014
(Continued)

OTHER PUBLICATIONS

Montes, H., Salinas, C., Fernández, R., & Armada, M. (2017). An experimental platform for autonomous bus development. Applied Sciences, 7(11), 1131.*

(Continued)

*Primary Examiner* — Ig T An
*Assistant Examiner* — Stephanie T Su
(74) *Attorney, Agent, or Firm* — CASIMIR JONES S.C.; Thomas A. Isenbarger

(57) ABSTRACT

The invention provides designs and methods for a heavy vehicle operations and control system for heavy automated vehicles, which facilitates heavy vehicle operation and control for connected automated vehicle highway (CAVH) systems. The heavy vehicle management system provides heavy vehicles with individually customized information (Continued)

and real-time vehicle control instructions to fulfill the driving tasks such as car following, lane changing, route guidance. The heavy vehicle management system also realizes heavy vehicle related lane design, transportation operations, and management services for both dedicated and non-dedicated lanes. The heavy vehicle management system consists of one or more of the following physical subsystems: (1) Roadside unit (RSU) network, (2) Traffic Control Unit (TCU) and Traffic Control Center (TCC) network, (3) vehicles and onboard units (OBU), (4) traffic operations centers (TOCs), and (5) cloud platform. The heavy vehicle management system realizes one or more of the following function categories: sensing, transportation behavior prediction and management, planning and decision making, and vehicle control. The heavy vehicle management system is supported by road infrastructure design, real-time wired and/or wireless communication, power supply networks, and cyber safety and security services.

20 Claims, 38 Drawing Sheets

(56) References Cited

U.S. PATENT DOCUMENTS 4,704,610 A 11/1987 Smith et al.
4,962,457 A 10/1990 Chen et al.
5,420,794 A 5/1995 James
5,504,683 A 4/1996 Gurmu
5,625,559 A 4/1997 Egawa
5,732,785 A 3/1998 Ran et al.
6,028,537 A 2/2000 Suman et al.
6,064,318 A 5/2000 Kirchner, III et al.
6,317,682 B1 11/2001 Ogura et al.
6,829,531 B2 12/2004 Lee
6,900,740 B2 5/2005 Bloomquist et al.
7,295,904 B2 11/2007 Kanevsky et al.
7,324,893 B2 1/2008 Yamashita et al.
7,343,243 B2 3/2008 Smith
7,382,274 B1 6/2008 Kermani et al.
7,418,346 B2 6/2008 Breed et al.
7,421,334 B2 9/2008 Dahlgren et al.
7,425,903 B2 9/2008 Boss et al.
7,554,435 B2 6/2009 Tengler et al.
7,725,249 B2 5/2010 Kickbusch
7,860,639 B2 12/2010 Yang
7,894,951 B2 2/2011 Norris et al.
7,979,172 B2 7/2011 Breed
8,344,864 B1 * 1/2013 Al-Mutawa ..... G08G 1/096775 340/435
8,352,112 B2 1/2013 Mudalige
8,527,139 B1 9/2013 Yousuf
8,589,070 B2 11/2013 Ban
8,630,795 B2 1/2014 Breed et al.
8,682,511 B2 3/2014 Andreasson
8,972,080 B2 3/2015 Shida et al.
9,053,636 B2 6/2015 Gordon
9,076,332 B2 7/2015 Myr
9,120,485 B1 9/2015 Dolgov
9,182,951 B1 11/2015 Ormerod et al.
9,349,055 B1 5/2016 Ogale
9,494,935 B2 11/2016 Okumura et al.
9,495,874 B1 11/2016 Zhu et al.
9,595,190 B2 3/2017 McCrary
9,646,496 B1 5/2017 Miller et al.
9,654,511 B1 5/2017 Brocco et al.
9,665,101 B1 5/2017 Templeton
9,731,713 B2 8/2017 Horii
9,799,224 B2 10/2017 Okamoto
9,845,096 B2 12/2017 Urano et al.
9,855,894 B1 * 1/2018 Khorasani ..... G06K 9/00805
9,940,840 B1 4/2018 Schubert et al.
9,964,948 B2 5/2018 Ullrich et al.
10,074,223 B2 9/2018 Newman
10,074,273 B2 9/2018 Yokoyama et al.
10,380,886 B2 8/2019 Ran et al.
2002/0008637 A1 1/2002 Lemelson et al.
2003/0045995 A1 3/2003 Lee
2003/0171939 A1 * 9/2003 Yagesh ..... G06Q 10/06 705/325
2004/0145496 A1 7/2004 Ellis
2004/0230393 A1 11/2004 Tzamaloukas
2005/0060069 A1 3/2005 Breed et al.
2005/0102098 A1 5/2005 Montealegre et al.
2005/0209769 A1 9/2005 Yamashita et al.
2005/0222760 A1 10/2005 Cabral et al.
2006/0142933 A1 6/2006 Feng
2006/0226968 A1 10/2006 Tengler et al.
2006/0251498 A1 11/2006 Buzzoni et al.
2007/0093997 A1 4/2007 Yang et al.
2007/0146162 A1 6/2007 Tengler et al.
2008/0042815 A1 2/2008 Breed et al.
2008/0095163 A1 4/2008 Chen et al.
2008/0150786 A1 6/2008 Breed
2008/0161986 A1 7/2008 Breed et al.
2008/0161987 A1 7/2008 Breed
2008/0275646 A1 11/2008 Perng et al.
2010/0013629 A1 1/2010 Sznaider et al.
2010/0256836 A1 10/2010 Mudalige et al.
2010/0256852 A1 * 10/2010 Mudalige ..... G08G 1/164 701/24
2011/0224892 A1 9/2011 Speiser
2011/0227757 A1 9/2011 Chen et al.
2012/0017262 A1 1/2012 Kapoor et al.
2012/0022776 A1 1/2012 Razavilar et al.
2012/0059574 A1 3/2012 Hada
2012/0105639 A1 5/2012 Stein et al.
2012/0143786 A1 6/2012 Karner
2012/0283910 A1 11/2012 Lee et al.
2012/0303807 A1 11/2012 Akelbein et al.
2013/0116915 A1 5/2013 Ferreira et al.
2013/0137457 A1 5/2013 Potkonjak
2013/0138714 A1 5/2013 Ricci
2013/0141580 A1 6/2013 Stein et al.
2013/0204484 A1 8/2013 Ricci
2013/0218412 A1 8/2013 Ricci
2013/0297140 A1 11/2013 Montemerlo et al.
2013/0297196 A1 11/2013 Shida
2014/0112410 A1 4/2014 Yokoyama
2014/0219505 A1 8/2014 Kindo et al.
2014/0222322 A1 8/2014 Durekovic
2014/0278026 A1 9/2014 Taylor
2014/0278052 A1 9/2014 Slavin et al.
2014/0354451 A1 12/2014 Tonguz et al.
2015/0153013 A1 6/2015 Zhao et al.
2015/0169018 A1 6/2015 Rogo et al.
2015/0197247 A1 7/2015 Ichinowaka
2015/0199685 A1 7/2015 Betancourt et al.
2015/0211868 A1 7/2015 Matsushita et al.
2015/0310742 A1 10/2015 Albornoz
2016/0042303 A1 2/2016 Medina et al.
2016/0086391 A1 3/2016 Ricci
2016/0110820 A1 4/2016 Fleck et al.
2016/0132705 A1 5/2016 Kovarik et al.
2016/0142492 A1 5/2016 Fang et al.
2016/0148440 A1 5/2016 Kwak
2016/0216130 A1 7/2016 Abramson et al.
2016/0221186 A1 8/2016 Perrone
2016/0231746 A1 8/2016 Hazelton et al.
2016/0238703 A1 8/2016 Liu et al.
2016/0325753 A1 11/2016 Stein et al.
2016/0328272 A1 11/2016 Ahmed et al.
2016/0330036 A1 11/2016 Zhou et al.
2016/0370194 A1 12/2016 Colijn et al.
2017/0026893 A1 1/2017 Lagassey
2017/0039435 A1 2/2017 Ogale et al.
2017/0046883 A1 2/2017 Gordon et al.
2017/0053529 A1 2/2017 Yokoyama et al.
2017/0075195 A1 3/2017 Stein et al.
2017/0085632 A1 3/2017 Cardote
2017/0090994 A1 3/2017 Jubinski et al.

(56) References Cited

U.S. PATENT DOCUMENTS

| | | | | |
|---|---|---|---|---|
| 2017/0109644 | A1 | 4/2017 | Nariyambut Murali et al. | |
| 2017/0131435 | A1 | 5/2017 | Peacock et al. | |
| 2017/0206783 | A1 | 7/2017 | Miller | |
| 2017/0262790 | A1 | 9/2017 | Khasis | |
| 2017/0276492 | A1 | 9/2017 | Ramasamy | |
| 2017/0324817 | A1 | 11/2017 | Oliveira et al. | |
| 2017/0337571 | A1 | 11/2017 | Bansal et al. | |
| 2017/0337813 | A1* | 11/2017 | Taylor | G05D 1/0285 |
| 2017/0339224 | A1 | 11/2017 | Condeixa et al. | |
| 2017/0357980 | A1 | 12/2017 | Bakun et al. | |
| 2018/0018216 | A1 | 1/2018 | Halford et al. | |
| 2018/0053413 | A1* | 2/2018 | Patil | G08G 1/0969 |
| 2018/0065637 | A1 | 3/2018 | Bassindale | |
| 2018/0114079 | A1 | 4/2018 | Myers et al. | |
| 2018/0151064 | A1 | 5/2018 | Xu et al. | |
| 2018/0158327 | A1 | 6/2018 | Gärtner | |
| 2018/0190111 | A1* | 7/2018 | Green | G08G 1/052 |
| 2018/0190116 | A1 | 7/2018 | Bauer et al. | |
| 2018/0262887 | A1 | 9/2018 | Futaki | |
| 2018/0279183 | A1* | 9/2018 | Song | G05D 1/0276 |
| 2018/0299274 | A1 | 10/2018 | Moghe et al. | |
| 2018/0308344 | A1 | 10/2018 | Ravindranath et al. | |
| 2018/0336780 | A1 | 11/2018 | Ran et al. | |
| 2019/0051158 | A1* | 2/2019 | Felip Leon | G05D 1/0088 |
| 2019/0096238 | A1 | 3/2019 | Ran et al. | |
| 2019/0137285 | A1* | 5/2019 | Bailey | G05D 1/0088 |
| 2019/0238436 | A1* | 8/2019 | Volos | G06N 7/005 |
| 2019/0244518 | A1 | 8/2019 | Yang et al. | |
| 2019/0244521 | A1 | 8/2019 | Ran et al. | |
| 2019/0316919 | A1* | 10/2019 | Keshavamurthy | G08G 1/096844 |

FOREIGN PATENT DOCUMENTS

| | | | |
|---|---|---|---|
| CN | 104485003 | B | 4/2015 |
| CN | 106710203 | A | 5/2017 |
| CN | 107665578 | A | 2/2018 |
| CN | 107807633 | A | 3/2018 |
| CN | 108039053 | A | 5/2018 |
| CN | 108447291 | A | 8/2018 |
| EP | 2395472 | A1 | 12/2011 |
| KR | 20170008703 | A | 1/2017 |
| WO | WO 2015/114592 | A1 | 8/2015 |
| WO | WO 2016/077027 | A1 | 5/2016 |
| WO | WO 2016/135561 | A1 | 9/2016 |
| WO | WO 2017/049978 | A1 | 3/2017 |
| WO | WO 2017/079474 | A2 | 5/2017 |
| WO | WO 2017/115342 | A1 | 7/2017 |
| WO | WO 2017/160276 | A1 | 9/2017 |
| WO | WO 2018/039134 | A1 | 3/2018 |
| WO | WO 2018/132378 | | 7/2018 |
| WO | WO 2019/156955 | A1 | 8/2019 |
| WO | WO 2019/156956 | A1 | 8/2019 |

OTHER PUBLICATIONS

Al-Najada et al., "Autonomous vehicles safe-optimal trajectory selection based on big data analysis and predefined user preferences," 2016 IEEE 7th Annual Ubiquitous Computing, Electronics & Mobile Communication Conference (UEMCON), New York, NY, 2016, pp. 1-6.

APGDT002, Microchip Technology Inc. http://www.microchip.com/, retrieved on: Nov. 3, 2017, 2 pages.

Bergenhem et al. "Overview of Platooning Systems", ITS World Congress, Vienna, Oct. 22-26, 2012, 8 pages.

Bhat "Travel Modeling in an Era of Connected and Automated Transportation Systems: An Investigation in the Dallas-Fort Worth Area," Techinal Report 122, Center for Transportation Research, Feb. 2017 [retrieved on Sep. 3, 2019]. Retrieved from the Internet: <URL:http://www.caee.utexas.edu/prof/bhat/REPORTS/DSTOP_122.pdf> pp. 1-61.

Conduent™—Toll Collection Solutions, https://www.conduent.com/solution/transportation-solutions/electronic-toll-collection/, retrived on: Nov. 3, 2017, 3 pages.

Doshi Review of the book "Security for Cloud Storage Systems" MEFHI, Gauridad Campus, India, 2014, pp. 1-2 [retrieved on Sep. 5, 2019]. Retrieved from the Internet: <URL:https://www.iacr.org/books/2014_sp_yang_cloudstorage.pdf.

EyEQ4 from Mobileye, http://www.mobileye.com/our-technology, retrieved on Nov. 3, 2017, 6 pages.

Fehr-Peers "Effects of Next Generation Vehicles on Travel Demand and Highway, Capacity, "FP Think: Effects of Next-Generation Vehicles on Travel Demand and Highway Capacity Feb. 2014, [retrieved on Jun. 13, 2019]. Retrived from the Internet: <URL:http://www.fehrandpeers.com/wp-content/uploads/2015/07/FP_Thing_Next_Gen_White_Paper_FINAL.pdf>pp. 1-39.

Flammini et al. "Wireless sensor networking in the internet of things and cloud computing era." Procedia Engineering 87 (2014): 672-679.

Fleetmatics https://www.fleetmatics.com/, retrieved on: Nov. 3, 2017, 6 pages.

HDL-64E of Velodyne Lidar, http://velodynelidar.com/index.html, retrieved on: Nov. 3, 2017, 10 pages.

Here, https://here.com/en/products-services/products/here-hd-live-map, retrieved on: Nov. 3, 2017, 5 pages.

Johri et al.,"A Multi-Scale Spatiotemporal Perspective of Connected and Automated Vehicles: Applications and Wireless Networking," in IEEE Intelligent Transportation Systems Magazine, vol. 8, No. 2, pp. 65-73, Summer 2016.

Maaß et al., "Data Processing of High-rate low-voltage Distribution Grid Recordings for Smart Grid Monitoring and Analysis," EURASIP Journal on Advances in Signal Processing (2015) 2015:14 DOI 10.1186/s13634-015-02034[retrieved on Sep. 3, 2019]. Retrieved from the Internet: <URL:https://link.springer.com/content/pdf/10.1186%2Fs13634-015-0203-4.pdf> pp. 1-21.

Miami Dade Transportation Planning Organization "First Mile-Last Mile Options with High Trip Generator Employers." MiamiDadeTPO.org. pp. 1-99 Jan. 31, 2018, [retrieved on Jun. 13, 2019]. Retrieved from the Internet:<URL:http://www.miamidadetpo.org/library/studies/first-mile-last-mile-options-with-high-trip-generator-employers-2017-12.pdf>.

MK5 V2X ,Cohda Wireless,http://cohdawireless.com, retrieved on: Nov. 3, 2017, 2 pages.

National Association of City Transportation Officials. "Blueprint for Autonomous Urbanism". New York, NY10017, www.nacto.org, Fall 2017, [retrieved on Sep. 5, 2019]. Retrieved from the Internet: <URL:https://nacto.org/wp-content/uploads/2017/11/BAU_Mod1_raster-sm.pdf>.

Optical Fiber from Cablesys, https://www.cablesys.com/fiber-patch-cables/?gclid=Cj0KEQjwldzHBRCfg_almKrf7N4BEiQABJTPKH_q2wbjNLGBhBVQVSBogLQMkDaQdMm5rZtyBaE8uuUaAhTJ8P8HAQ, retrieved on: Nov. 3, 2017, 10 pages.

Portland "Portland Metro Area Value Pricing Feasibility Analysis" Oregon Department of Transportation, Jan. 23, 2018, pp. 1-29, [retrieved on Jun. 13, 2019]. Retrived from the Internet: <URL:https://www.oregon.gov/ODOT/KOM/VP-TM2-InitialConcepts.PDF>.

Products for Toll Collection—Mobility—Siemens—Siemens, https://www.mobility.siemens.com/mobility/global/en/urban-mobility/road-solutions/toll-systems-for-cities/products-for-toll-collection/pages/products-for-toll-collection.aspx, retrieved on: Nov. 3, 2017, 2 pages.

R-Fans_16 from Beijing Surestar Technology Co. Ltd, http://www.isurestar.com/index.php/en-product-product.html#9, retrieved on: Nov. 3, 2017, 7 pages.

Society of Automotive Engineers International's new standard J3016: "(R) Taxonomy and Definitions for Terms Related to Driving Automation Systems for On-Road Motor Vehicles" 2016, downloaded Dec. 12, 2016, 30 pages.

Society of Automotive Engineers International's new standard J3016: "Taxonomy and Definitions for Terms Related to On-Road Motor Vehicle Automated Driving Systems" 2014, downloaded Sep. 17, 2019, 12 pages.

Southwest Research Institute, Basic Infrastructure Message Development and Standards Support for Connected Vehicles Applica-

(56) References Cited

OTHER PUBLICATIONS tions, Apr. 24, 2018. {retrieved on Sep. 3, 2019}. Retrieved from the Internet: <URL:http://www.cts.virginia.edu/wp-content/uploads/2018/12/Task4-Basic-Infrastructure-Message-Development-20180425-Final.pdf> pp. 1-76.
STJ1-3 from Sensortech, http://www.whsensortech.com/, retrieved on Nov. 3, 2017, 2 pages.
StreetWAVE from Savari, http://savari.net/technology/road-side-unit, retrieved on: Nov. 3, 2017, 2 pages.
Surakitbanharn "Connected and Autonomous Vehicles: A Policy Review" Purdue Policy Research Institute, Feb. 2018, retrieved on Sep. 3, 2019, retrived from the interned: <URL:https://www.purdue.edu/discoverypark/ppri/docs/CATV%20Policy%20Writeup%20Feb%202018.pdf> pp. 1-17.
TDC-GPX2 LIDAR of precision-measurement-technologies, http://pmt-fl.com, retrieved on: Nov. 3, 2017, 2 pages.
Teletrac Navman http://drive.teletracnavman.com/, retrived on: Nov. 3, 2017, 2 pages.
Vector CANalyzer9.0 from vector https://vector.com, retrieved on Nov. 3, 2017, 1 page.
Williams "Transportation Planning Implications of Automated/Connected Vehicles on Texas Highways" Texas A&M Transportation Institute, Apr. 2017, 34 pages.
International Search Report of related PCT/US2018/012961, dated May 10, 2018, 16 pages.
International Search Report of related PCT/US2019/016606, dated Apr. 23, 2019, 21 pages.
International Search Report of related PCT/US2019/016603, dated Apr. 24, 2019, 17 pages.
International Search Report of related PCT/US2019/031304, dated Aug. 9, 2019, 17 pages.
International Search Report of related PCT/US2019/026569, dated Jul. 8, 33 pages.
International Search Report of related PCT/US2019/037963, dated Sep. 10, 2019, 54 pages.
International Search Report of related PCT/US2019/041004, dated Oct. 3, 2019, 18 pages.
International Search Report of related PCT/US2019/040814, dated Oct. 8, 2019, 20 pages.
International Search Report of related PCT/US2019/041008, dated Oct. 8, 2019, 16 pages.
International Search Report of related PCT/US2019/040819, dated Oct. 17, 2019, 41 pages.
International Search Report of related PCT/US2019/039376, dated Oct. 29, 2019, 11 pages.
International Search Report of related PCT/US2019/040809, dated Nov. 15, 2019, 17 pages.

* cited by examiner

CONNECTED AUTOMATED VEHICLE HIGHWAY SYSTEMS AND METHODS RELATED TO HEAVY VEHICLES

This application claims priority to U.S. provisional patent application Ser. No. 62/687,435, filed Jun. 20, 2018, which is incorporated herein by reference in its entirety.

FIELD

The present invention relates generally to a comprehensive system providing full vehicle operations and control for connected and automated heavy vehicles (CAHVs), and, more particularly, to a system controlling CAHVs by sending individual vehicles with detailed and time-sensitive control instructions for vehicle following, lane changing, route guidance, and related information.

BACKGROUND

Freight management systems for heavy automated vehicles, in which heavy vehicles are detected and navigated by roadside units without or with reduced human input, are in development. At present, they are in experimental testing and not in widespread commercial use. Existing systems and methods are expensive, complicated, and unreliable, making widespread implementation a substantial challenge.

For instance, a technology described in U.S. Pat. No. 8,682,511 relates to a method for platooning of vehicles in an automated vehicle system. The automated vehicle system comprises a network of tracks along which vehicles are adapted to travel. The network comprises at least one merge point, one diverge point, and a plurality of stations. An additional technology described in U.S. Pat. No. 9,799,224 relates to a platoon travel system comprising a plurality of platoon vehicles traveling in two vehicle groups. In addition, U.S. Pat. No. 9,845,096 describes an autonomous driving vehicle system comprising an acquisition unit that acquires an operation amount or a duration count and a switching unit that switches a driving state. These conventional technologies are designed to provide an autonomous driving vehicle system or a platoon travel system and do not provide a technology for a connected automated vehicle highway system.

SUMMARY

The present technology relates generally to a comprehensive system providing full vehicle operations and control for connected and automated heavy vehicles (CAHVs), and, more particularly, to a system controlling CAHVs by sending individual vehicles with detailed and time-sensitive control instructions for vehicle following, lane changing, route guidance, and related information. In some embodiments, the technology comprises a connected automated vehicle highway system and methods and/or components thereof as described in U.S. patent application Ser. No. 15/628,331, filed Jun. 20, 2017 and U.S. Provisional Patent Application Ser. No. 62/626,862, filed Feb. 6, 2018, 62/627,005, filed Feb. 6, 2018, 62/655,651, filed Apr. 10, 2018, and 62/669,215, filed May 9, 2018, the disclosures of which are herein incorporated by reference in their entireties (referred to herein as a CAVH system).

Accordingly, embodiments of the technology provide a vehicle operations and control system comprising a roadside unit (RSU) network; a Traffic Control Unit (TCU) and Traffic Control Center (TCC) network (e.g., TCU/TCC network); a vehicle comprising an onboard unit (OBU); a Traffic Operations Center (TOC); and a cloud-based platform configured to provide information and computing services. In some embodiments, the system is configured to control special and non-special vehicles. In some embodiments, the system controls a special vehicle. As used herein, the term "special vehicle" refers to a vehicle controlled, in some embodiments, by particular processes and/or rules based on the special vehicle having one or more characteristics or statuses that is/are different than a typical vehicle used for commuting and travelling (e.g., a passenger car, passenger truck, and/or passenger van). Non-limiting examples of a "special vehicle" include, but are not limited to, oversize vehicles (e.g., overlength vehicles, overwidth vehicles, overheight vehicles), overweight vehicles (e.g., heavy vehicles (e.g., connected and automated heavy vehicles (CAHVs)), vehicles transporting special goods (e.g., hazardous material (e.g., flammable, radioactive, poisonous, explosive, toxic, biohazardous, and/or waste material), perishable material (e.g., food), temperature sensitive material, valuable material (e.g., currency, precious metals), emergency vehicles (e.g., a fire truck, an ambulance, a police vehicle, a tow truck), scheduled vehicles (e.g., buses, taxis, on-demand and ride-share vehicles (e.g., Uber, Lyft, and the like)), government vehicles, military vehicles, shuttles, car services, livery vehicles, delivery vehicles, etc. Thus, in some embodiments, the system controls a special vehicle chosen from the group consisting of an oversize vehicle, an overweight vehicle, a vehicle transporting special goods, a scheduled vehicle, a delivery vehicle, and an emergency vehicle.

In some embodiments, the system provides individual vehicles with detailed and time-sensitive control instructions for vehicle following, lane changing, and route guidance. As used herein, the term "vehicle following" refers to the spacing between vehicles in a road lane. In some embodiments, "vehicle following" refers to the distance between two consecutive vehicles in a lane.

In some embodiments, a system comprises a vehicle comprising a vehicle-human interface, e.g., to provide information about the vehicle, road, traffic, and/or weather conditions to the driver and/or to provide controls to the driver for controlling the vehicle.

In some embodiments, the system comprises a plurality of vehicles.

In some embodiments, the technology provides a system (e.g., a vehicle operations and control system comprising a RSU network; a TCU/TCC network; a vehicle comprising an onboard unit OBU; a TOC; and a cloud-based platform configured to provide information and computing services) configured to provide sensing functions, transportation behavior prediction and management functions, planning and decision making functions, and/or vehicle control functions. In some embodiments, the system comprises wired and/or wireless communications media. In some embodiments, the system comprises a power supply network. In some embodiments, the system comprises a cyber safety and security system. In some embodiments, the system comprises a real-time communication function.

In some embodiments, the system is configured to operate on one or more lanes of a highway to provide one or more automated driving lanes. In some embodiments, the system comprises a barrier separating an automated driving lane from a non-automated driving lane. In some embodiments, the barrier separating an automated driving lane from a non-automated driving lane is a physical barrier. In some embodiments, the barrier separating an automated driving lane from a non-automated driving lane is a logical barrier. In some embodiments, automated driving lanes and non-automated driving lanes are not separated by a barrier, e.g., not separated by a physical nor logical barrier. In some embodiments, a logical barrier comprises road signage, pavement markings, and/or vehicle control instructions for lane usage. In some embodiments, a physical barrier comprises a fence, concrete blocks, and/or raised pavement.

In some embodiments, the systems provided herein comprise a plurality of highway lanes. In some embodiments, systems are configured to provide: dedicated lane(s) shared by automated heavy and light vehicles; dedicated lane(s) for automated heavy vehicles separated from dedicated lane(s) for automated, light vehicles; and/or non-dedicated lane(s) shared by automated and human-driven vehicles.

In some embodiments in which the system comprises a special vehicle, the special vehicle is a heavy vehicle. As used herein, the term "heavy vehicle" refers to a vehicle that is or would be classified in the United States according to its gross vehicle weight rating (GVWR) in classes 7 or 8, e.g., approximately 25,000 pounds or more (e.g., 25,000; 26,000; 27,000; 28,000; 29,000, 30,000; 31,000; 32,000; 33,000; 34,000; 35,000, or more pounds). The term "heavy vehicle" also refers to a vehicle that is or would be classified in the European Union as a Class C or Class D vehicle. In some embodiments, a "heavy vehicle" is a vehicle other than a passenger vehicle. For instance, in some embodiments a special vehicle is a truck, e.g., a heavy, medium, or light truck.

In some embodiments, the system comprises a special vehicle at SAE automation Level 1 or above (e.g., Level 1, 2, 3, 4, 5). See, e.g., Society of Automotive Engineers International's new standard J3016: "Taxonomy and Definitions for Terms Related to On-Road Motor Vehicle Automated Driving Systems" (2014) and the 2016 update J3016_201609, each of which is incorporated herein by reference.

In some embodiments, systems comprise special vehicles having a vehicle to infrastructure communication capability. In some embodiments, systems comprise special vehicles lacking a vehicle to infrastructure communication capability. As used herein, the term "vehicle to infrastructure" or "V2I" or "infrastructure to vehicle" or "I2V" refers to communication between vehicles and other components of the system (e.g., an RSU, TCC, TCU, and/or TOC). V2I or I2V communication is typically wireless and bi-directional, e.g., data from system components is transmitted to the vehicle and data from the vehicle is transmitted to system components. As used herein, the term vehicle to vehicle or "V2V" refers to communication between vehicles.

In some embodiments, the system is configured to provide entrance traffic control methods and exit traffic control methods to a vehicle. For instance, in some embodiments, entrance traffic control methods comprise methods for controlling a vehicle's: entrance to an automated lane from a non-automated lane; entrance to an automated lane from a parking lot; and/or entrance to an automated lane from a ramp. For instance, in some embodiments, exit traffic control methods comprise methods for controlling a vehicle's: exit from an automated lane to a non-automated lane; exit from an automated lane to a parking lot; and/or exit from an automated lane to a ramp. In some embodiments, the entrance traffic control methods and/or exit traffic control methods comprise(s) one or more modules for automated vehicle identification, unauthorized vehicle interception, automated and manual vehicle separation, and automated vehicle driving mode switching assistance.

In some embodiments, the RSU network of embodiments of the systems provided herein comprises an RSU subsystem. In some embodiments, the RSU subsystem comprises: a sensing module configured to measure characteristics of the driving environment; a communication module configured to communicate with vehicles, TCUs, and the cloud; a data processing module configured to process, fuse, and compute data from the sensing and/or communication modules; an interface module configured to communicate between the data processing module and the communication module; and an adaptive power supply module configured to provide power and to adjust power according to the conditions of the local power grid. In some embodiments, the adaptive power supply module is configured to provide backup redundancy. In some embodiments, communication module communicates using wired or wireless media.

In some embodiments, sensing module comprises a radar based sensor. In some embodiments, sensing module comprises a vision based sensor. In some embodiments, sensing module comprises a radar based sensor and a vision based sensor and wherein said vision based sensor and said radar based sensor are configured to sense the driving environment and vehicle attribute data. In some embodiments, the radar based sensor is a LIDAR, microwave radar, ultrasonic radar, or millimeter radar. In some embodiments, the vision based sensor is a camera, infrared camera, or thermal camera. In some embodiments, the camera is a color camera.

In some embodiments, the sensing module comprises a satellite based navigation system. In some embodiments, the sensing module comprises an inertial navigation system. In some embodiments, the sensing module comprises a satellite based navigation system and an inertial navigation system and wherein said sensing module comprises a satellite based navigation system and said inertial navigation system are configured to provide vehicle location data. In some embodiments, the satellite based navigation system is a Differential Global Positioning Systems (DGPS) or a BeiDou Navigation Satellite System (BDS) System or a GLONASS Global Navigation Satellite System. In some embodiments, the inertial navigation system comprises an inertial reference unit.

In some embodiments, the sensing module of embodiments of the systems described herein comprises a vehicle identification device. In some embodiments, the vehicle identification device comprises RFID, Bluetooth, Wi-fi (IEEE 802.11), or a cellular network radio, e.g., a 4G or 5G cellular network radio.

In some embodiments, the RSU sub-system is deployed at a fixed location near road infrastructure. In some embodiments, the RSU sub-system is deployed near a highway roadside, a highway on ramp, a highway off ramp, an interchange, a bridge, a tunnel, a toll station, or on a drone over a critical location. In some embodiments, the RSU sub-system is deployed on a mobile component. In some embodiments, the RSU sub-system is deployed on a vehicle drone over a critical location, on an unmanned aerial vehicle (UAV), at a site of traffic congestion, at a site of a traffic accident, at a site of highway construction, at a site of extreme weather. In some embodiments, a RSU sub-system is positioned according to road geometry, heavy vehicle size, heavy vehicle dynamics, heavy vehicle density, and/or heavy vehicle blind zones. In some embodiments, the RSU sub-system is installed on a gantry (e.g., an overhead assembly, e.g., on which highway signs or signals are mounted). In some embodiments, the RSU sub-system is installed using a single cantilever or dual cantilever support.

In some embodiments, the TCC network of embodiments of the systems described herein is configured to provide traffic operation optimization, data processing and archiving. In some embodiments, the TCC network comprises a human operations interface. In some embodiments, the TCC network is a macroscopic TCC, a regional TCC, or a corridor TCC based on the geographical area covered by the TCC network. See, e.g., U.S. patent application Ser. No. 15/628,331, filed Jun. 20, 2017 and U.S. Provisional Patent Application Ser. No. 62/626,862, filed Feb. 6, 2018, 62/627,005, filed Feb. 6, 2018, 62/655,651, filed Apr. 10, 2018, and 62/669,215, filed May 9, 2018, each of which is incorporated herein in its entirety for all purposes.

In some embodiments, the TCU network is configured to provide real-time vehicle control and data processing. In some embodiments, the real-time vehicle control and data processing are automated based on preinstalled algorithms.

In some embodiments, the TCU network is a segment TCU or a point TCUs based on based on the geographical area covered by the TCU network. See, e.g., U.S. patent application Ser. No. 15/628,331, filed Jun. 20, 2017 and U.S. Provisional Patent Application Ser. No. 62/626,862, filed Feb. 6, 2018, 62/627,005, filed Feb. 6, 2018, 62/655,651, filed Apr. 10, 2018, and 62/669,215, filed May 9, 2018, each of which is incorporated herein in its entirety for all purposes. In some embodiments, the system comprises a point TCU physically combined or integrated with an RSU. In some embodiments, the system comprises a segment TCU physically combined or integrated with a RSU.

In some embodiments, the TCC network of embodiments of the systems described herein comprises macroscopic TCCs configured to process information from regional TCCs and provide control targets to regional TCCs; regional TCCs configured to process information from corridor TCCs and provide control targets to corridor TCCs; and corridor TCCs configured to process information from macroscopic and segment TCUs and provide control targets to segment TCUs. See, e.g., U.S. patent application Ser. No. 15/628,331, filed Jun. 20, 2017 and U.S. Provisional Patent Application Ser. No. 62/626,862, filed Feb. 6, 2018, 62/627,005, filed Feb. 6, 2018, 62/655,651, filed Apr. 10, 2018, and 62/669,215, filed May 9, 2018, each of which is incorporated herein in its entirety for all purposes.

In some embodiments, the TCU network comprises: segment TCUs configured to process information from corridor and/or point TOCs and provide control targets to point TCUs; and point TCUs configured to process information from the segment TCU and RSUs and provide vehicle-based control instructions to an RSU. See, e.g., U.S. patent application Ser. No. 15/628,331, filed Jun. 20, 2017 and U.S. Provisional Patent Application Ser. No. 62/626,862, filed Feb. 6, 2018, 62/627,005, filed Feb. 6, 2018, 62/655,651, filed Apr. 10, 2018, and 62/669,215, filed May 9, 2018, each of which is incorporated herein in its entirety for all purposes.

In some embodiments, the RSU network of embodiments of the systems provided herein provides vehicles with customized traffic information and control instructions and receives information provided by vehicles.

In some embodiments, the TCC network of embodiments of the systems provided herein comprises one or more TCCs comprising a connection and data exchange module configured to provide data connection and exchange between TCCs. In some embodiments, the connection and data exchange module comprises a software component providing data rectify, data format convert, firewall, encryption, and decryption methods. In some embodiments, the TCC network comprises one or more TCCs comprising a transmission and network module configured to provide communication methods for data exchange between TCCs. In some embodiments, the transmission and network module comprises a software component providing an access function and data conversion between different transmission networks within the cloud platform. In some embodiments, the TCC network comprises one or more TCCs comprising a service management module configured to provide data storage, data searching, data analysis, information security, privacy protection, and network management functions. In some embodiments, the TCC network comprises one or more TCCs comprising an application module configured to provide management and control of the TCC network. In some embodiments, the application module is configured to manage cooperative control of vehicles and roads, system monitoring, emergency services, and human and device interaction.

In some embodiments, TCU network of embodiments of the systems described herein comprises one or more TCUs comprising a sensor and control module configured to provide the sensing and control functions of an RSU. In some embodiments, the sensor and control module is configured to provide the sensing and control functions of radar, camera, RFID, and/or V2I equipment. In some embodiments, the sensor and control module comprises a DSRC, GPS, 4G, 5G, and/or wifi radio. In some embodiments, the TCU network comprises one or more TCUs comprising a transmission and network module configured to provide communication network function for data exchange between an automated heavy vehicles and a RSU. In some embodiments, the TCU network comprises one or more TCUs comprising a service management module configured to provide data storage, data searching, data analysis, information security, privacy protection, and network management. In some embodiments, the TCU network comprises one or more TCUs comprising an application module configured to provide management and control methods of an RSU. In some embodiments, the management and control methods of an RSU comprise local cooperative control of vehicles and roads, system monitoring, and emergency service. In some embodiments, the TCC network comprises one or more TCCs further comprising an application module and said service management module provides data analysis for the application module. In some embodiments, the TCU network comprises one or more TCUs further comprising an application module and said service management module provides data analysis for the application module.

In some embodiments, the TOC of embodiments of the systems described herein comprises interactive interfaces. In some embodiments, the interactive interfaces provide control of said TCC network and data exchange. In some embodiments, the interactive interfaces comprise information sharing interfaces and vehicle control interfaces. In some embodiments, the information sharing interfaces comprise: an interface that shares and obtains traffic data; an interface that shares and obtains traffic incidents; an interface that shares and obtains passenger demand patterns from shared mobility systems; an interface that dynamically adjusts prices according to instructions given by said vehicle operations and control system; and/or an interface that allows a special agency (e.g., a vehicle administrative office or police) to delete, change, and share information. In some embodiments, the vehicle control interfaces of embodiments of the interactive interfaces comprise: an interface that allows said vehicle operations and control system to assume control of vehicles; an interface that allows vehicles to form a platoon with other vehicles; and/or an interface that allows a special agency (e.g., a vehicle administrative office or police) to assume control of a vehicle. In some embodiments, the traffic data comprises vehicle density, vehicle velocity, and/or vehicle trajectory. In some embodiments, the traffic data is provided by the vehicle operations and control system and/or other share mobility systems. In some embodiments, traffic incidents comprise extreme conditions, major accident, and/or a natural disaster. In some embodiments, an interface allows the vehicle operations and control system to assume control of vehicles upon occurrence of a traffic event, extreme weather, or pavement breakdown when alerted by said vehicle operations and control system and/or other share mobility systems. In some embodiments, an interface allows vehicles to form a platoon with other vehicles when they are driving in the same dedicated and/or same non-dedicated lane.

In some embodiments, the OBU of embodiments of systems described herein comprises a communication module configured to communicate with an RSU. In some embodiments, the OBU comprises a communication module configured to communicate with another OBU. In some embodiments, the OBU comprises a data collection module configured to collect data from external vehicle sensors and internal vehicle sensors; and to monitor vehicle status and driver status. In some embodiments, the OBU comprises a vehicle control module configured to execute control instructions for driving tasks. In some embodiments, the driving tasks comprise car following and/or lane changing. In some embodiments, the control instructions are received from an RSU. In some embodiments, the OBU is configured to control a vehicle using data received from an RSU. In some embodiments, the data received from said RSU comprises: vehicle control instructions; travel route and traffic information; and/or services information. In some embodiments, the vehicle control instructions comprise a longitudinal acceleration rate, a lateral acceleration rate, and/or a vehicle orientation. In some embodiments, the travel route and traffic information comprise traffic conditions, incident location, intersection location, entrance location, and/or exit location. In some embodiments, the services data comprises the location of a fuel station and/or location of a point of interest. In some embodiments, OBU is configured to send data to an RSU. In some embodiments, the data sent to said RSU comprises: driver input data; driver condition data; vehicle condition data; and/or goods condition data. In some embodiments, the driver input data comprises origin of the trip, destination of the trip, expected travel time, service requests, and/or level of hazardous material. In some embodiments, the driver condition data comprises driver behaviors, fatigue level, and/or driver distractions. In some embodiments, the vehicle condition data comprises vehicle ID, vehicle type, and/or data collected by a data collection module. In some embodiments, the goods condition data comprises material type, material weight, material height, and/or material size.

In some embodiments, the OBU of embodiments of systems described herein is configured to collecting data comprising: vehicle engine status; vehicle speed; goods status; surrounding objects detected by vehicles; and/or driver conditions. In some embodiments, the OBU is configured to assume control of a vehicle. In some embodiments, the OBU is configured to assume control of a vehicle when the automated driving system fails. In some embodiments, the OBU is configured to assume control of a vehicle when the vehicle condition and/or traffic condition prevents the automated driving system from driving said vehicle. In some embodiments, the vehicle condition and/or traffic condition is adverse weather conditions, a traffic incident, a system failure, and/or a communication failure.

In some embodiments, the cloud platform of embodiments of systems described herein is configured to support automated vehicle application services. In some embodiments, the cloud platform is configured according to cloud platform architecture and data exchange standards. In some embodiments, cloud platform is configured according to a cloud operating system. In some embodiments, the cloud platform is configured to provide data storage and retrieval technology, big data association analysis, deep mining technologies, and data security. In some embodiments, the cloud platform is configured to provide data security systems providing data storage security, transmission security, and/or application security. In some embodiments, the cloud platform is configured to provide the said RSU network, said TCU network, and/or said TCC network with information and computing services comprising: Storage as a service (STaaS) functions to provide expandable storage; Control as a service (CCaaS) functions to provide expandable control capability; Computing as a service (CaaS) functions to provide expandable computing resources; and/or Sensing as a service (SEaaS) functions to provide expandable sensing capability. In some embodiments, the cloud platform is configured to implement a traffic state estimation and prediction algorithm comprising: weighted data fusion to estimate traffic states, wherein data provided by the RSU network, Traffic Control Unit (TCU) and Traffic Control Center (TCC) network, and TOC network are fused according to weights determined by the quality of information provided by the RSU network, Traffic Control Unit (TCU) and Traffic Control Center (TCC) network, and TOC network; and estimated traffic states based on historical and present RSU network, Traffic Control Unit (TCU) and Traffic Control Center (TCC) network, and TOC network data.

In some embodiments, the cloud platform of embodiments of systems described herein is configured to provide methods for fleet maintenance comprising remote vehicle diagnostics, intelligent fuel-saving driving, and intelligent charging and/or refueling. In some embodiments, the fleet maintenance comprises determining a traffic state estimate. In some embodiments, the fleet maintenance comprises use of cloud platform information and computing services. In some embodiments, the cloud platform is configured to support: real-time information exchange and sharing among vehicles, cloud, and infrastructure; and analyze vehicle conditions. In some embodiments, vehicle conditions comprise a vehicle characteristic that is one or more of overlength, overheight, overweight, oversize, turning radius, moving uphill, moving downhill, acceleration, deceleration, blind spot, and carrying hazardous goods.

In some embodiments, the sensing function of embodiments of systems described herein comprises sensing oversize vehicles using a vision sensor. In some embodiments, an RSU and/or OBU comprises said vision sensors. In some embodiments, oversize vehicle information is collected from said sensing function, sent to a special information center, and shared through the cloud platform. In some embodiments, the sensing function comprises sensing overweight vehicles using a pressure sensor and/or weigh-in-motion device. In some embodiments, overweight vehicle information is collected from said sensing function, sent to a special information center, and shared through the cloud platform. In some embodiments, the sensing function comprises sensing overheight, overwidth, and/or overlength vehicles using a geometric leveling method, a GPS elevation fitting method, and/or a GPS geoid refinement method. In some embodiments, overheight, overwidth, and/or overlength vehicle information is collected from said sensing function, sent to a special information center, and shared through the cloud platform. In some embodiments, the sensing function comprises sensing vehicles transporting hazardous goods using a vehicle OBU or a chemical sensor. In some embodiments, vehicle hazardous goods information is collected from said sensing function, sent to a special information center, and shared through the cloud platform. In some embodiments, the system is further configured to plan routes and dispatching vehicles transporting hazardous goods vehicles. In some embodiments, the system is further configured to transmit route and dispatch information for vehicles transporting hazardous goods to other vehicles. In some embodiments, the sensing function senses non-automated driving vehicles. In some embodiments, non-automated driving vehicle information is collected from an entrance sensor. In some embodiments, the system is further configured to track non-automated vehicles and transmit non-automated route information to other vehicles.

In some embodiments, the transportation behavior prediction and management function of embodiments of systems described herein is configured to provide longitudinal control of one or more vehicles. In some embodiments, longitudinal control comprises determining vehicle speed and car following distance. In some embodiments, longitudinal control comprises controlling automated heavy vehicle platoon, automated heavy and light vehicle platoon, and automated and manual vehicle platoon. In some embodiments, longitudinal control comprises a freight priority management system. In some embodiments, the freight priority management system comprises controlling heavy vehicle priority levels to reduce the acceleration and deceleration of automated vehicles. In some embodiments, the freight priority management system is configured to provide smooth traffic movement on dedicated and/or non-dedicated lanes.

In some embodiments, the transportation behavior prediction and management function of embodiments of systems described herein is configured to provide lateral control of one or more vehicles. In some embodiments, lateral control comprises lane keeping and/or lane changing. In some embodiments, the transportation behavior prediction and management function is configured to provide weight loading monitoring for one or more vehicles. In some embodiments, the weight loading monitoring comprises use of an artificial intelligence-based vehicle loading technology, cargo weight and packing volume information, and/or vehicle specification information. In some embodiments, the transportation behavior prediction and management function is configured to manage switching between automated and non-automated driving modes. In some embodiments, the transportation behavior prediction and management function is configured to provide special event notifications. In some embodiments, the special event notifications comprise information for goods type, serial number, delivery station, loading vehicle location, unloading vehicle location, shipper, consignee, vehicle number, and loading quantity. In some embodiments, the transportation behavior prediction and management function takes emergency measures to address a special event notification. In some embodiments, the transportation behavior prediction and management function is configured to provide incident detection. In some embodiments, the incident detection comprises monitoring status of tires, status of braking components, and status of sensors. In some embodiments, the incident detection comprises detecting an incident involving a vehicle or vehicles managed by the system. In some embodiments, the transportation behavior prediction and management function is configured to provide weather forecast notification. In some embodiments, a weather forecast notification comprises short-term weather forecasting and/or high resolution weather forecasting. In some embodiments, the weather forecast notification is supported by the cloud platform. In some embodiments, the transportation behavior prediction and management function is configured to monitor and/or identify a reduced speed zone. In some embodiments, the transportation behavior prediction and management function is configured to determine the location of the reduced speed zone and reduce the driving speed of vehicles.

In some embodiments, the transportation behavior prediction and management function of embodiments of systems described herein is configured to manage oversize and/or overweight (OSOW) vehicles. In some embodiments, the transportation behavior prediction and management function is configured to provide routing services for OSOW vehicles. In some embodiments, the transportation behavior prediction and management function is configured to provide permitting services for OSOW vehicles. In some embodiments, the permitting services comprise applying for permits, paying for permits, and receiving approved routes. In some embodiments, receiving approved routes is based on road system constraints and the intended vehicle and load characteristics. In some embodiments, the transportation behavior prediction and management function is configured to provide route planning and guidance to vehicles. In some embodiments, the route planning and guidance comprises providing vehicles with routes and schedules according to vehicle length, height, load weight, axis number, origin, and destination.

In some embodiments, the transportation behavior prediction and management function of embodiments of systems described herein is configured to provide network demand management. In some embodiments, the network demand management manages the traffic flow within and in the proximity of the system road. In some embodiments, the planning and decision making function is configured to provide longitudinal control of vehicles. In some embodiments, the longitudinal control comprises controlling following distance, acceleration, and/or deceleration. In some embodiments, the planning and decision making function is configured to provide lateral control of vehicles. In some embodiments, the lateral control comprises lane keeping and/or lane changing.

In some embodiments, the planning and decision making function of embodiments of systems described herein is configured to provide special event notification, work zone notification, reduced speed zone notification, ramp notification, and/or weather forecast notification. In some embodiments, the planning and decision making function is configured to provide incident detection. In some embodiments, the planning and decision making function controls vehicles according to permanent and/or temporary rules to provide safe and efficient traffic. In some embodiments, the planning and decision making function provides route planning and guidance and/or network demand management.

In some embodiments, the system is further configured to provide a hazard transportation management function. In some embodiments, a vehicle transporting a hazard is identified with an electronic tag. In some embodiments, the electronic tag provides information comprising the type of hazard, vehicle origin, vehicle destination, and vehicle license and/or permit. In some embodiments, the hazard is tracked by the vehicle OBU. In some embodiments, the hazard is tracked by the RSU network. In some embodiments, the hazard is tracked from vehicle origin to vehicle destination. In some embodiments, the hazard transportation management function implements a route planning algorithm for transport vehicles comprising travel cost, traffic, and road condition. In some embodiments, the vehicle control function is configured to control vehicles on road geometries and lane configurations comprising straight line, upslope, downslope, and on a curve. In some embodiments, the vehicle control function is configured to control vehicles using received real-time operation instructions specific for each vehicle. In some embodiments, the vehicle control function is configured to control vehicles on a straight-line road geometry and lane configuration by providing a travel route, travel speed, and acceleration. In some embodiments, the vehicle control function is configured to control vehicles on an upslope road geometry and lane configuration by providing a driving route, driving speed, acceleration, and slope of acceleration curve. In some embodiments, the vehicle control function is configured to control vehicles on a downslope road geometry and lane configuration by providing a driving route, driving speed, deceleration, and slope of deceleration curve. In some embodiments, the vehicle control function is configured to control vehicles on a curve geometry and lane configuration by providing a speed and steering angle.

In some embodiments, the systems provided herein further comprise a heavy vehicle emergency and incident management system configured to: identify and detect heavy vehicles involved in an emergency or incident; analyze and evaluate an emergency or incident; provide warnings and notifications related to an emergency or incident; and/or provide heavy vehicle control strategies for emergency and incident response and action plans. In some embodiments, identifying and detecting heavy vehicles involved in an emergency or incident comprises use of an OBU, the RSU network, and/or a TOC. In some embodiments, analyzing and evaluating an emergency or incident comprises use the TCC/TCU and/or cloud-based platform information and computing services. In some embodiments, analyzing and evaluating an emergency or incident is supported by a TOC. In some embodiments, providing warnings and notifications related to an emergency or incident comprises use of the RSU network, TCC/TCU network, and/or cloud-based platform of information and computing services. In some embodiments, providing heavy vehicle control strategies for emergency and incident response and action plans comprises use of the RSU network, TCC/TCU network, and/or cloud-based platform of information and computing services.

In some embodiments, systems provided herein are configured to provide detection, warning, and control functions for a special vehicle on specific road segments. In some embodiments, the special vehicle is a heavy vehicle. In some embodiments, the specific road segment comprise a construction site and/or high crash risk segment. In some embodiments, the detection, warning, and control functions comprise automatic detection of the road environment. In some embodiments, automatic detection of the road environment comprises use of information provided by an OBU, RSU network, and/or TOC. In some embodiments, the detection, warning, and control functions comprise real-time warning information for specific road conditions. In some embodiments, the real-time warning information for specific road conditions comprises information provided by the RSU network, TCC/TCU network, and/or TOC. In some embodiments, the detection, warning, and control functions comprise heavy vehicle related control strategies. In some embodiments, the heavy vehicle related control strategies are provided by a TOC based on information comprising site-specific road environment information.

In some embodiments, systems provided herein are configured to implement a method comprising managing heavy vehicles and small vehicles. In some embodiments, the small vehicles include passenger vehicles and motorcycles. In some embodiments, the method manages heavy and small vehicles on dedicated lanes and non-dedicated lanes. In some embodiments, managing heavy vehicles and small vehicles comprises controlling vehicle accelerations and decelerations through infrastructure-to-vehicle (I2V) communication.

In some embodiments, the technology relates to a method comprising managing heavy vehicles and small vehicles on dedicated lanes and non-dedicated lanes. In some embodiments, the small vehicles include passenger vehicles and motorcycles. In some embodiments, the methods comprise controlling vehicle accelerations and decelerations through infrastructure-to-vehicle (I2V) communication.

In some embodiments, the systems provided herein are configured to switch a vehicle from automated driving mode to non-automated driving mode. In some embodiments, switching a vehicle from automated driving mode to non-automated driving mode comprises alerting a driver to assume control of said vehicle or, if the driver takes no action after an amount of time, the system controls the vehicle to a safe stop. In some embodiments, systems are configured to switch a vehicle from automated driving mode to non-automated driving mode when the automated driving system is disabled or incapable of controlling said vehicle. In some embodiments, switching a vehicle from automated driving mode to non-automated driving mode comprises allowing a driver to control the vehicle.

In some embodiments, a vehicle is in a platoon. As used herein, a "platoon" is a group of cars controlled as a group electronically and/or mechanically in some embodiments. See, e.g., Bergenhem et al. "Overview of Platooning Systems", ITS World Congress, Vienna, 22-26 Oct. 2012, incorporated herein by reference in its entirety. A "pilot" of a platoon is a vehicle of the platoon that provides guidance and control for the remaining cars of the platoon. In some embodiments, the first vehicle in the platoon is a pilot vehicle. In some embodiments, the pilot vehicle is replaced by a functional automated vehicle in the platoon. In some embodiments, a human driver assumes control of a non-pilot vehicle in the platoon. In some embodiments, the system safely stops a non-pilot vehicle in the platoon. In some embodiments, the system is configured to reorganize a platoon of vehicles. In some embodiments, a platoon comprises automated and non-automated vehicles.

In some embodiments, the system is an open platform providing interfaces and functions for information inquiry, laws and regulations service, coordination and aid, information broadcast, and user management. In some embodiments, the system is configured to provide safety and efficiency functions for heavy vehicle operations and control under adverse weather conditions. In some embodiments, the safety and efficiency functions provide a high-definition map and location service. In some embodiments, the high-definition map and location service is provided by local RSUs. In some embodiments, the high-definition map and location service is provided without information obtained from vehicle-based sensors. In some embodiments, the high-definition map and location service provides information comprising lane width, lane approach, grade, curvature, and other geometry information. In some embodiments, the safety and efficiency functions provide a site-specific road weather and pavement condition information service. In some embodiments, the site-specific road weather and pavement condition information service uses information provided by the RSU network, the TCC/TCU network, and the cloud platform. In some embodiments, the safety and efficiency functions provide a heavy vehicle control service for adverse weather conditions. In some embodiments, the heavy vehicle control service for adverse weather conditions comprises use of information from a high-definition map and location service and/or a site-specific road weather and pavement condition information service. In some embodiments, the heavy vehicle control service for adverse weather conditions comprises use of information describing a type of hazardous goods transported by a heavy vehicle. In some embodiments, the safety and efficiency functions provide a heavy vehicle routing and schedule service. In some embodiments, the heavy vehicle routing and schedule service comprises use of site-specific road weather information and the type of cargo. In some embodiments, the type of cargo is hazardous or non-hazardous.

In some embodiments, the system is configured to provide security functions comprising hardware security; network and data security; reliability and resilience. In some embodiments, hardware security provides a secure environment for the system. In some embodiments, hardware security comprises providing measures against theft and sabotage, information leakage, power outage, and/or electromagnetic interference. In some embodiments, network and data security provides communication and data safety for the system. In some embodiments, network and data security comprises system self-examination and monitoring, firewalls between data interfaces, data encryption in transmission, data recovery, and multiple transmission methods. In some embodiments, the reliability and resilience of the system provides system recovery and function redundancy. In some embodiments, the reliability and resilience of the system comprises dual boot capability, fast feedback and data error correction, and automatic data retransmission.

In some embodiments, systems are configured to provide a blind spot detection function for heavy vehicles. In some embodiments, data collected by the RSU and OBU are used to determine a road status and vehicle environment status to identify blind spots for heavy vehicles in dedicated lanes. In some embodiments, the RSU network performs a heterogeneous data fusion of multiple data sources to determine a road status and vehicle environment status to identify blind spots for heavy vehicles in dedicated lanes. In some embodiments, data collected by the RSU and OBU are used to minimize and/or eliminate blind spots for heavy vehicles in dedicated lanes. In some embodiments, the RSU and OBU detect: 1) obstacles around automated and non-automated vehicles; and 2) moving entities on the roadside. In some embodiments, information from the RSU and OBU are used to control automated vehicles in non-dedicated lanes. In some embodiments, the system obtains: a confidence value associated with data provided by the RSU network; and a confidence value associated with data provided by an OBU; and the system uses the data associated with the higher confidence value to identify blind spots using the blind spot detection function. In some embodiments, road and vehicle condition data from multiple sources are fused to blind spot data for display. In some embodiments, blind spot data are displayed on a screen installed in the vehicle for use by a driver to observe all the directions around the vehicle.

The system and methods may include and be integrated with functions and components described in U.S. patent application Ser. No. 15/628,331, filed Jun. 20, 2017 and U.S. Provisional Patent Application Ser. No. 62/626,862, filed Feb. 6, 2018, 62/627,005, filed Feb. 6, 2018, 62/655,651, filed Apr. 10, 2018, and 62/669,215, filed May 9, 2018, each of which is incorporated herein in its entirety for all purposes.

Also provided herein are methods employing any of the systems described herein for the management of one or more aspects of traffic control. The methods include those processes undertaken by individual participants in the system (e.g., drivers, public or private local, regional, or national transportation facilitators, government agencies, etc.) as well as collective activities of one or more participants working in coordination or independently from each other.

Some portions of this description describe the embodiments of the invention in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Certain steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the invention may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the invention may also relate to a product that is produced by a computing process described herein. Such a product may comprise information resulting from a computing process, where the information is stored on a non-transitory, tangible computer readable storage medium and may include any embodiment of a computer program product or other data combination described herein.

DETAILED DESCRIPTION

Exemplary Embodiments of the Technology are Described Below. It should be Understood that these are Illustrative Embodiments and the Invention is not Limited to these Particular Embodiments The technology provides a technology for operating and controlling connected and automated heavy vehicles (CAHVs), and, more particularly, to a system for controlling CAHVs by sending individual vehicles with detailed and time-sensitive control instructions for vehicle following, lane changing, route guidance, and related information. The technology also provides embodiments for operating and controlling special vehicles, such as oversize vehicles (e.g., overlength vehicles, overwidth vehicles, overheight vehicles), vehicles transporting special goods (e.g., hazardous material, perishable material, temperature sensitive material, valuable material), scheduled vehicles (e.g., buses, taxis, on-demand and ride-share vehicles (e.g., Uber, Lyft, and the like), shuttles, car services, livery vehicles, delivery vehicles, etc.

In some embodiments, the technology provides lanes dedicated for use by automated vehicles ("automated driving lanes" or "CAVH lanes"). In some embodiments, the technology further provides other lanes ("ordinary", "non-dedicated", "general" or "normal" lanes), e.g., for use by automated vehicles and/or for use by non-automated vehicles.

Figure 1:
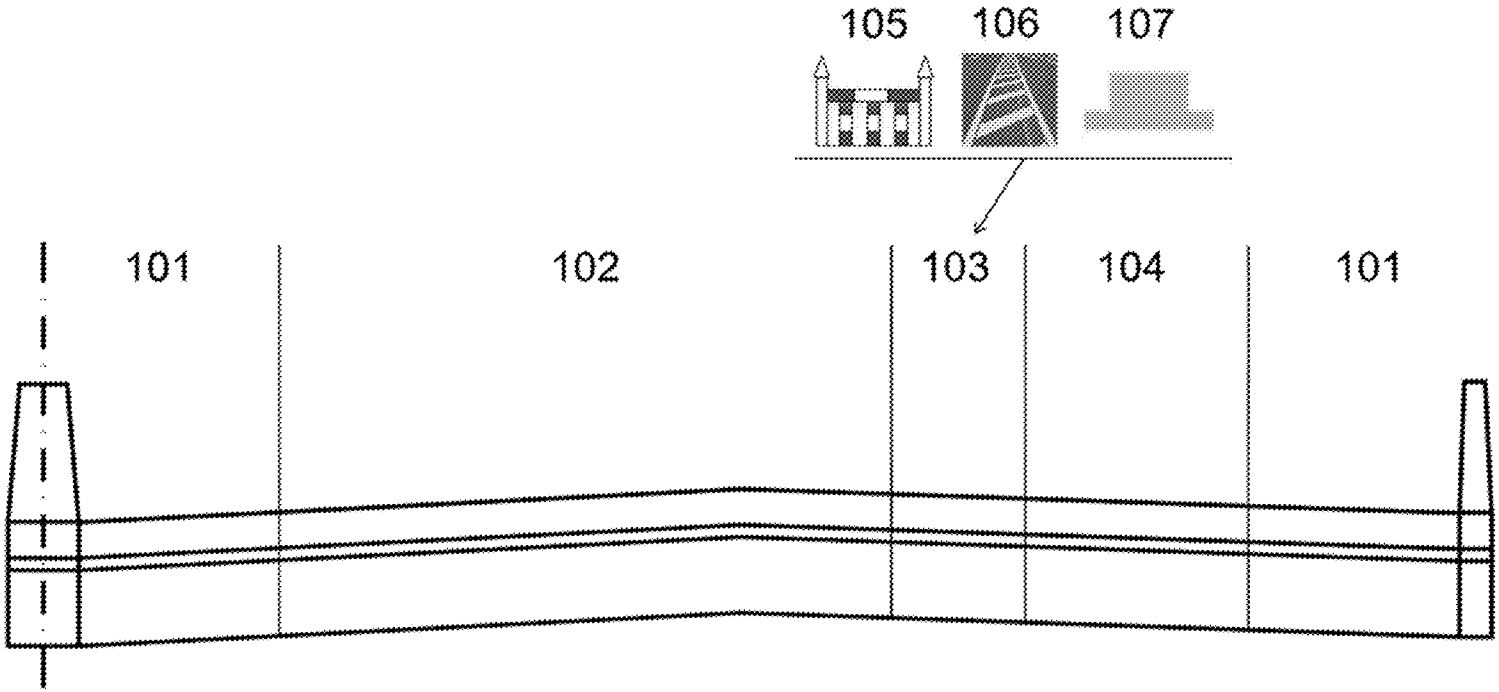
FIG. 1 illustrates examples of barriers. Features shown in FIG. 1 include, e.g., 101: Shoulder; 102: General lane; 103: Barrier; 104: CAVH lane; 105: Fence; 106: Marked lines; 107: Subgrade.
Figure 2:
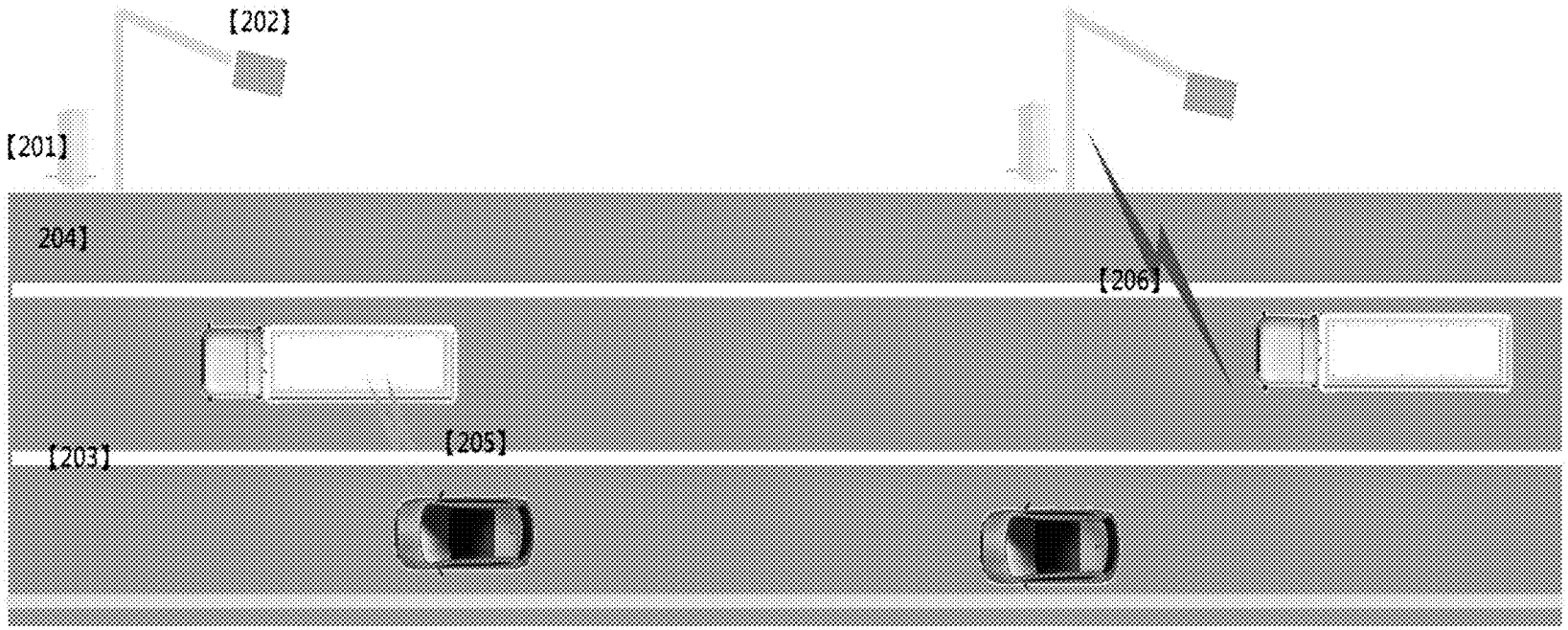
FIG. 2 illustrates a white line used to separate driving lanes. Features shown in FIG. 2 include, e.g., 201: RSU computing module (CPU, GPU); 202: RSU sensing module (e.g., comprising DSRC-4G-LTE, RFID, Camera, Radar, and/or LED); 203: Marked lines; 204: Emergency lane; 205: Vehicle-to-vehicle (V2V) communication; 206: Infrastructure-to-vehicle (I2V) communication.
Figure 3:
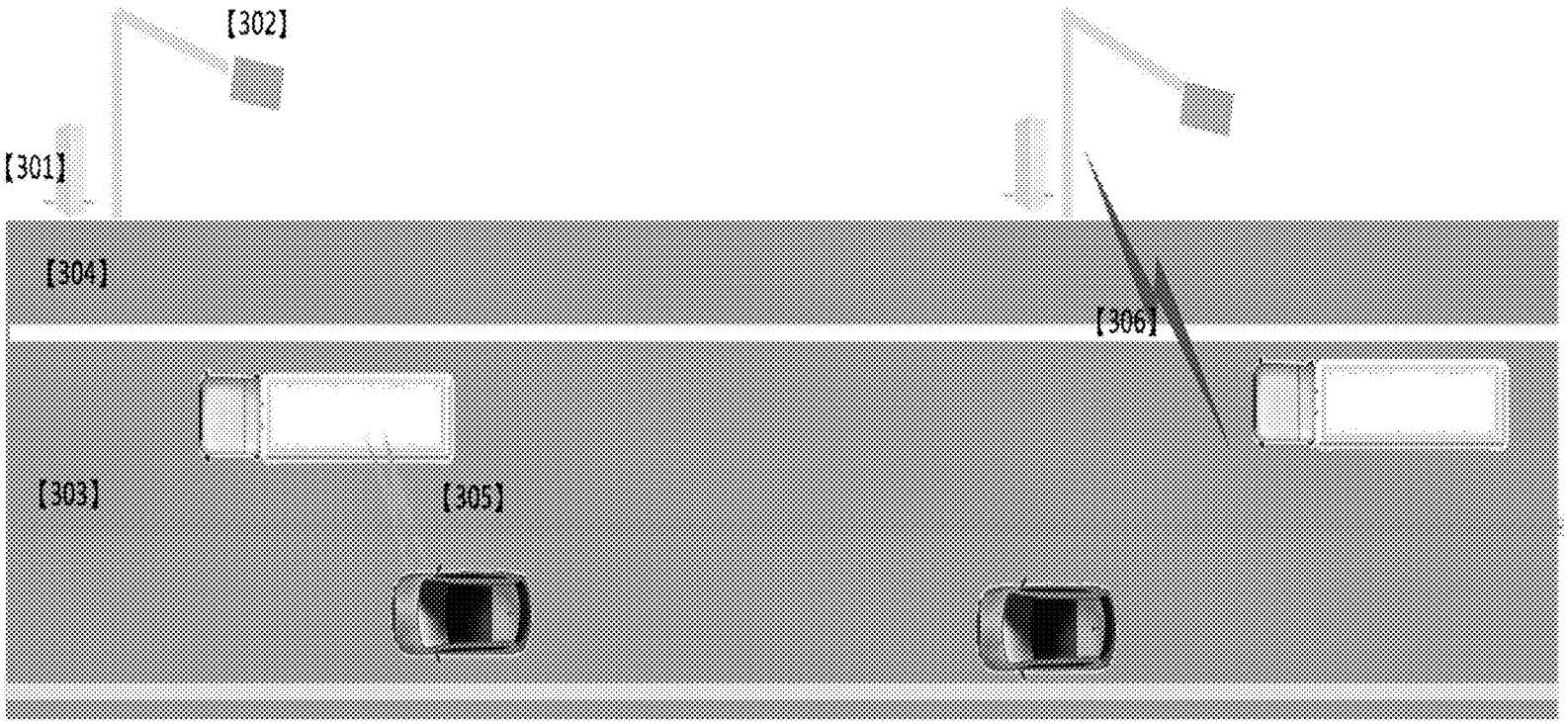
FIG. 3 illustrates a guardrail used to separate driving lanes. Features shown in FIG. 3 include, e.g., 301: RSU computing module (CPU, GPU); 302: RSU sensing module (e.g., comprising DSRC-4G-LTE, RFID, Camera, Radar, and/or LED); 303: Marked guardrail; 304: Emergency lane; 305: Vehicle-to-vehicle (V2V) communication; 306: Infrastructure-to-vehicle (I2V) communication.
Figure 4:
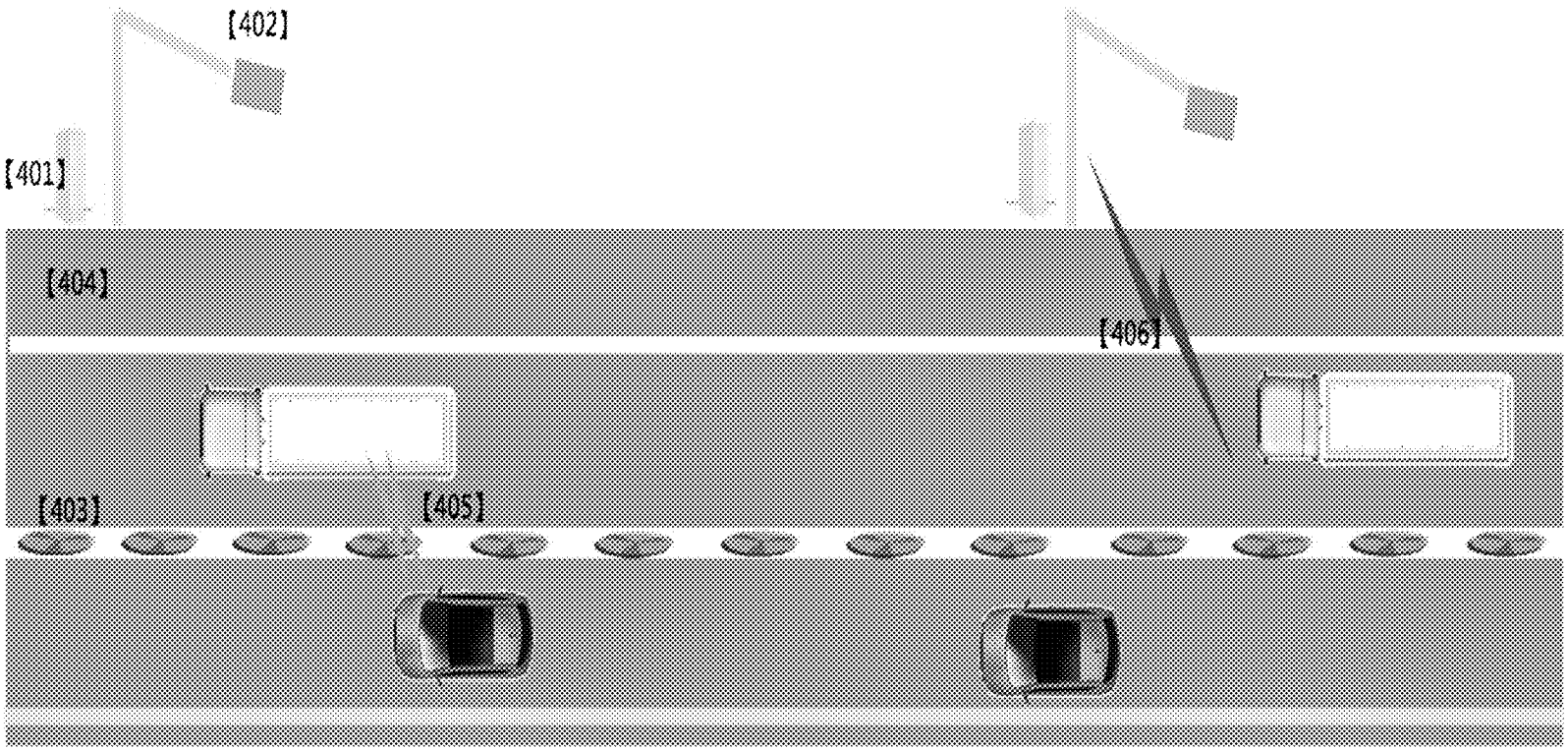
FIG. 4 illustrates a subgrade buffer used to separate driving lanes. Features shown in FIG. 4 include, e.g., 401: RSU computing module (CPU, GPU); 402: RSU sensing module (e.g., comprising DSRC-4G-LTE, RFID, Camera, Radar, and/or LED); 403: Marked subgrade; 404: Emergency lane; 405: Vehicle-to-vehicle (V2V) communication; 406: Infrastructure-to-vehicle (I2V) communication.

In some embodiments, as shown in FIG. 1, the technology comprises barriers to separate connected automated vehicle highway (CAVH) system lanes from general lanes. In some embodiments, exemplary barriers separating the CAVH lane 104 from the general lane 102 are, e.g., a fence 105, marked lines 106, and/or a subgrade 107. In some embodiments, there are shoulders 101 on both sides of each directional carriageway. In a particular embodiment shown in FIG. 2, a white marked line 203 is used to separate the automated driving lane from the general driving lane. In a particular embodiment shown in FIG. 3, a guardrail 303 is used to separate the automated driving lane from the general driving lane. In a particular embodiment shown in FIG. 4, a subgrade buffer 403 is used to separate the automated driving lane from the general driving lane.

Figure 5:
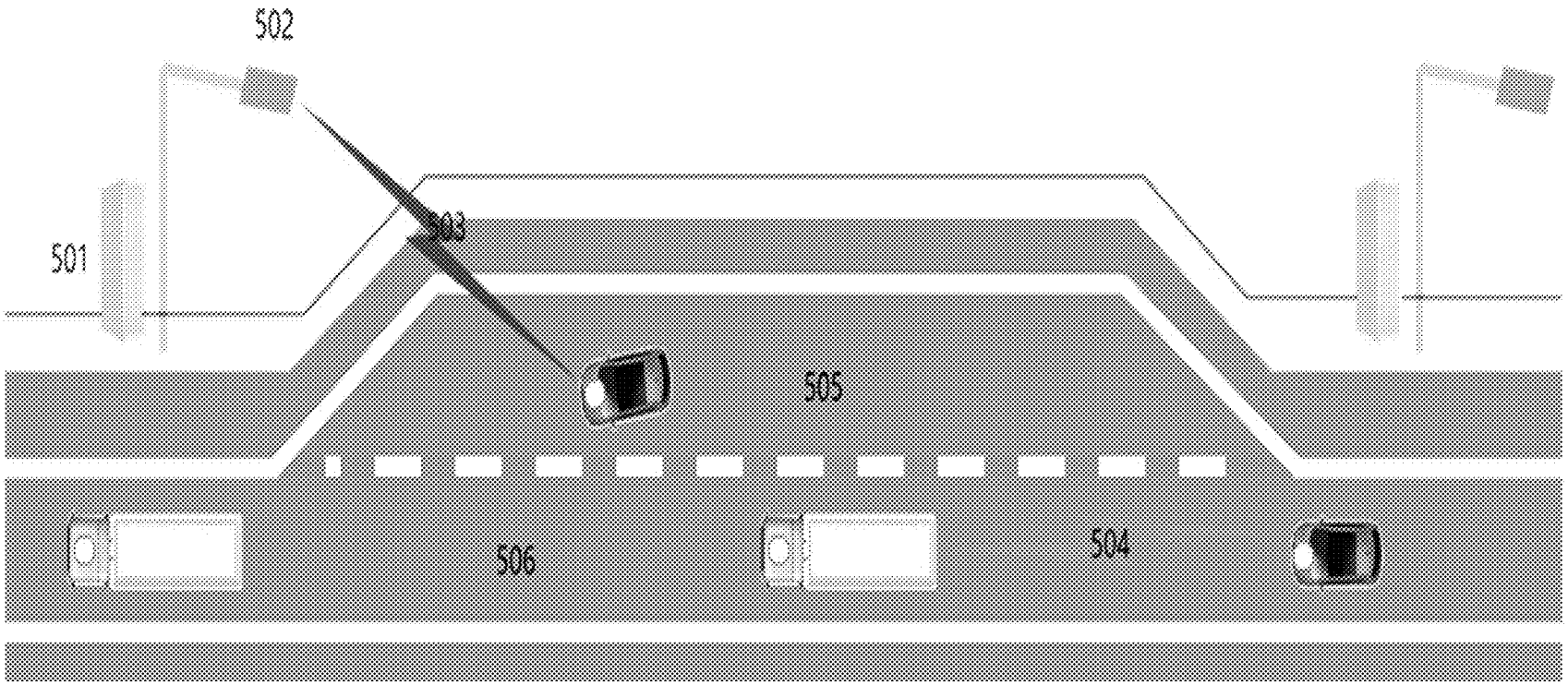
FIG. 5 illustrates an exemplary mixed use of a dedicated lane by cars and trucks. Features shown in FIG. 5 include, e.g., 501: RSU computing module (CPU, GPU); 502: RSU sensing module (e.g., comprising DSRC-4G-LTE, RFID, Camera, Radar, and/or LED); 503: Infrastructure-to-vehicle (I2V) communication; 504: Vehicle-to-vehicle (V2V) communication; 505: Bypass lane; 506: Automated driving dedicated lane.
Figure 6:
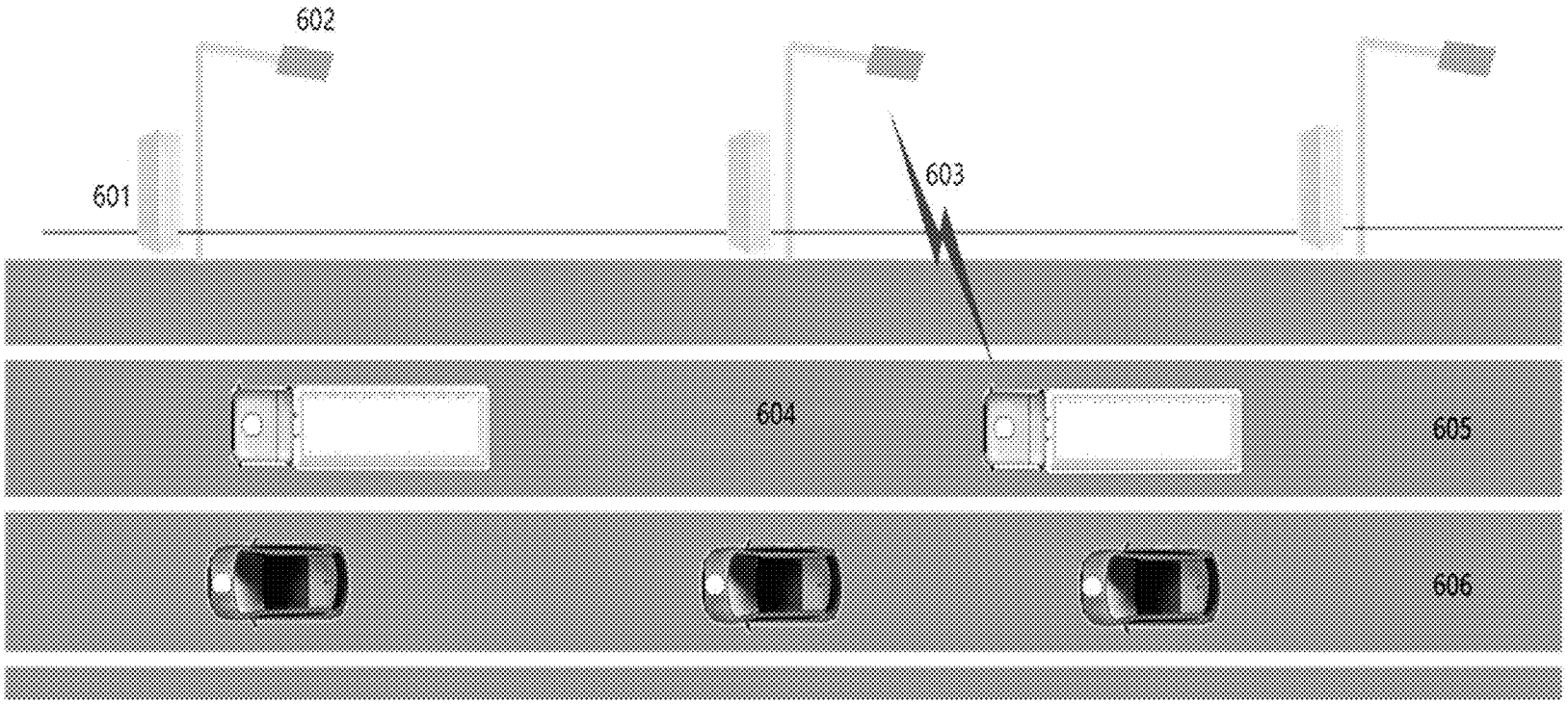
FIG. 6 illustrates an exemplary separation of cars and trucks in which a first dedicated lane is used by trucks only and a second dedicated lane is used by small vehicles only. Features shown in FIG. 6 include, e.g., 601: RSU computing module (CPU, GPU); 602: RSU sensing module (RFID, Camera, Radar, and/or LED); 603: I2V communication; 604: Vehicle-to-vehicle (V2V) communication; 605: Infrastructure-to-vehicle (I2V) communication; 606: Automated driving dedicated lane (e.g., for car).
Figure 7:
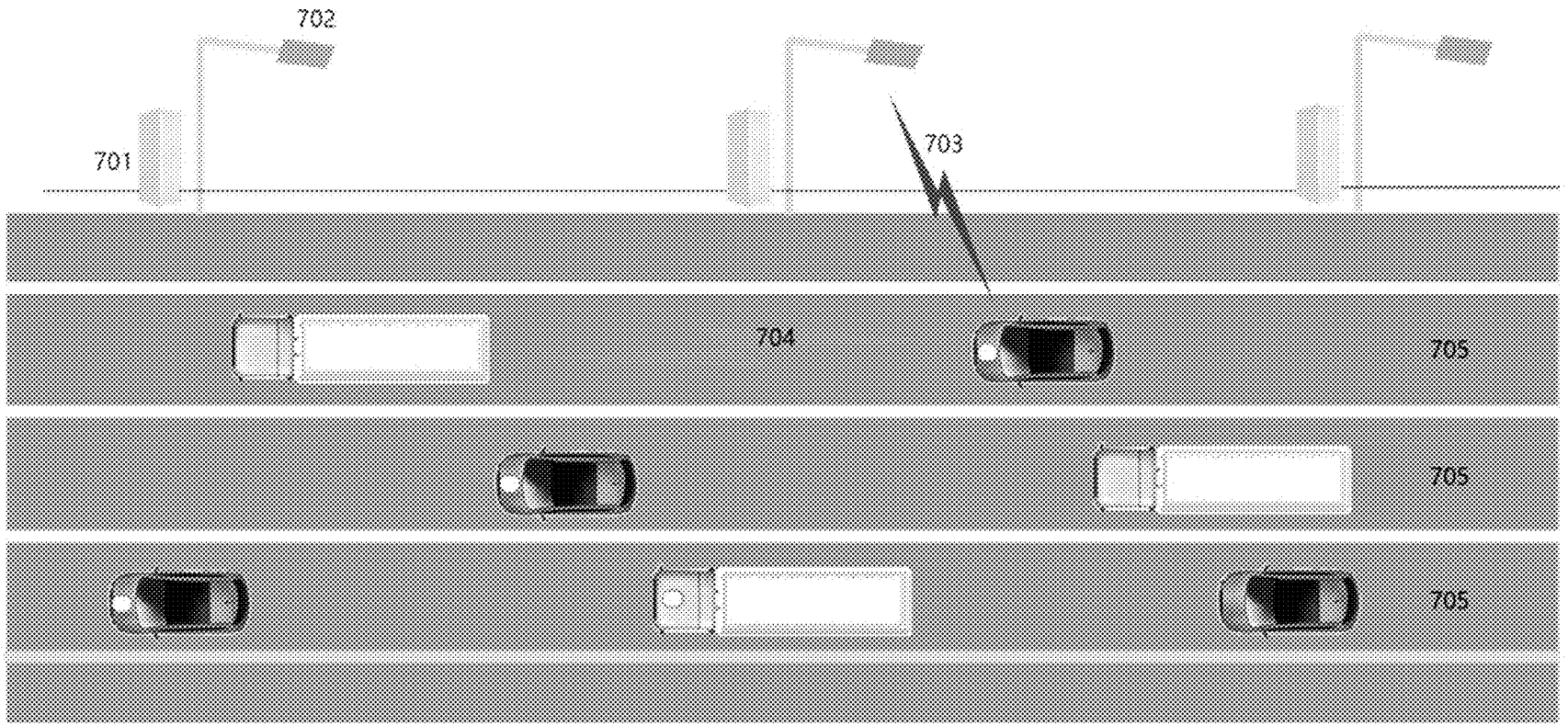
FIG. 7 illustrates exemplary use of non-dedicated lanes for mixed traffic, including mixed automated vehicles and conventional vehicles, and mixed cars and trucks. Features shown in FIG. 7 include, e.g., 701: RSU computing module (CPU, GPU); 702: RSU sensing module (e.g., comprising DSRC-4G-LTE, RFID, Camera, Radar, and/or LED); 703: Infrastructure-to-vehicle (I2V) communication; 704: Vehicle-to-vehicle (V2V) communication; 705: Non-dedicated lane.

In some embodiments, multiple vehicle types use a dedicated lane. In some embodiments, multiple vehicle types use a general lane. In some embodiments, vehicle types use separated lanes. For example, FIG. 5 shows an embodiment of the technology for a car-truck mixed situation in which the dedicated lane 506 is used by both automated small vehicles and automated trucks. Further, as shown in FIG. 5, embodiments provide that there is also a bypass lane 505 for overtaking. In some embodiments, the RSU sensing module 502 and Box 501 are used to identify vehicles that meet the requirement of Infrastructure-to-vehicle (I2V) communication 503. In another example, FIG. 6 shows an embodiment of the technology for a car-truck separated situation in which the dedicated lane 605 is used only by trucks and the dedicated lane 606 is used only by small vehicles. In some embodiments, e.g., as shown in FIG. 6, the dedicated lane 606 is on the left side and the dedicated lane 605 is on the right side. As shown in FIG. 7, in some embodiments, there are only non-dedicated lanes 705 for mixed traffic of automated vehicle and conventional (e.g., non-automated) vehicles, cars, and trucks.

Figure 8:
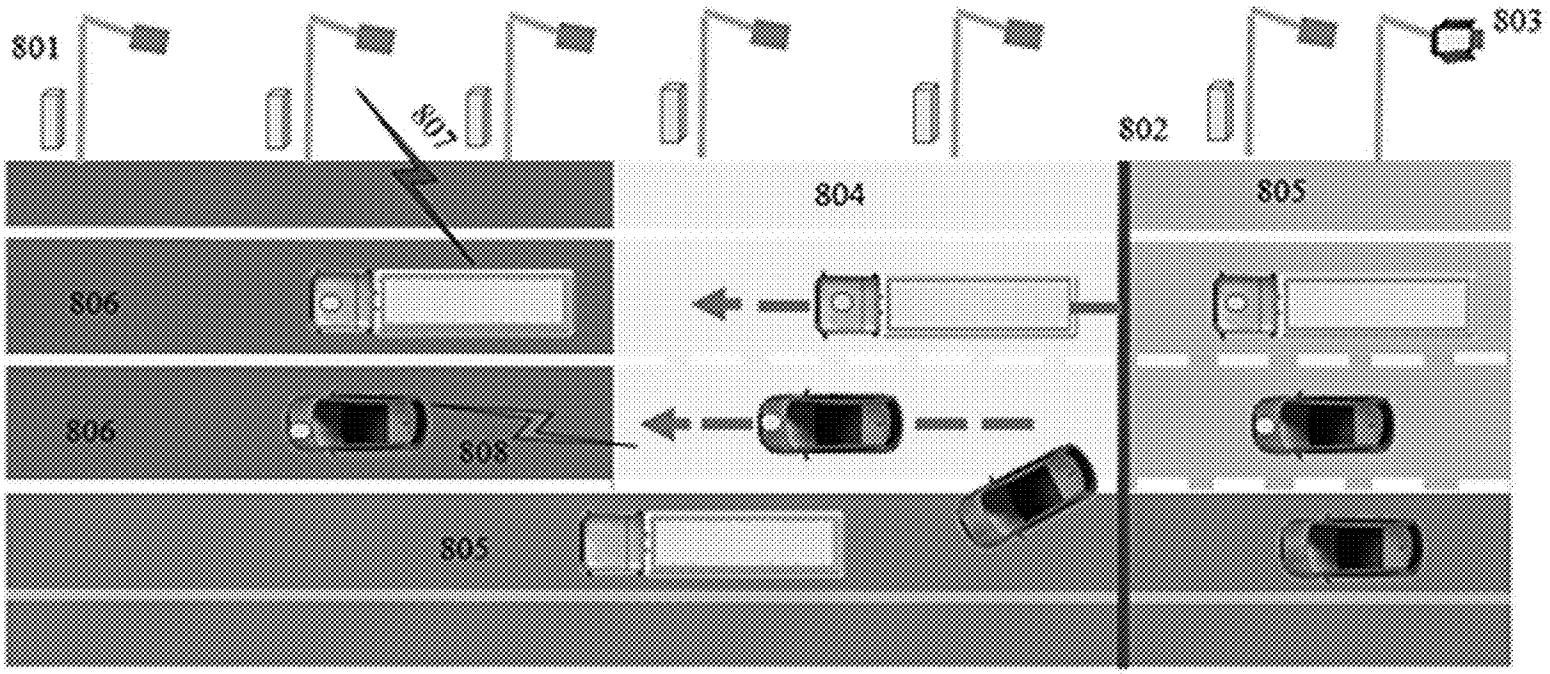
FIG. 8 illustrates an automated vehicle entering a dedicated lane from an ordinary lane. Features shown in FIG. 8 include, e.g., 801: RSU; 802: Vehicle identification and admission; 803: Variable Message Sign; 804: Change of driving style and lane change area; 805: Ordinary lane; 806: Automated driving dedicated lane; 807: I2V; 808: V2V.

Embodiments relate to control of vehicles moving between ordinary and dedicated lanes. For example, as shown in FIG. 8 in some embodiments, an automated vehicle enters a dedicated lane 806 from an ordinary lane 805. In some embodiments, before the vehicle reaches the change of driving style and lane change area 804, the vehicle is identified by RFID. In some embodiments, the automated driving vehicle and the conventional vehicle are guided to their own lanes 806 through the road and roadside marking. In some embodiments, when the vehicle reaches the change of driving style and lane change area 804, the vehicle is identified by RFID technology. If, in some embodiments, the vehicle does not meet the requirements to enter dedicated lanes 806, it is intercepted and the vehicle is guided into the ordinary lane 805 from the lane change area 804. In some embodiments, the automated driving vehicle changes driving mode (e.g., from non-automated to automated driving) in the lane change area 804 and enters the corresponding dedicated lane 806 using autonomous driving.

Figure 9:
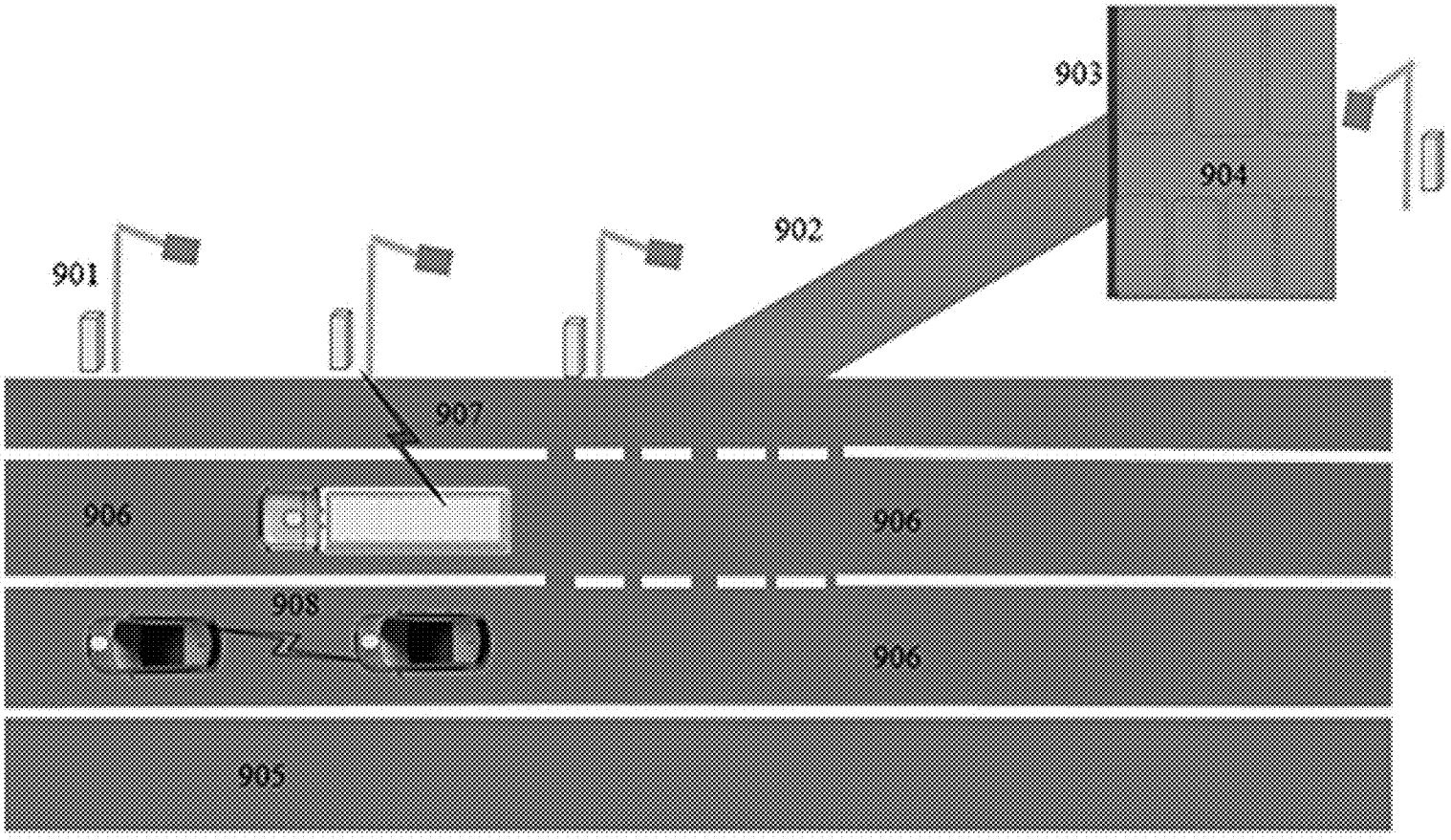
FIG. 9 illustrates an automated vehicle entering a dedicated lane from a parking lot. Features shown in FIG. 9 include, e.g., 901: RSU; 902: Ramp; 903: Vehicle identification and admission; 904: Parking lot; 905: Ordinary lane; 906: Automated driving dedicated lane; 907: I2V; 908: V2V.
Figure 10:
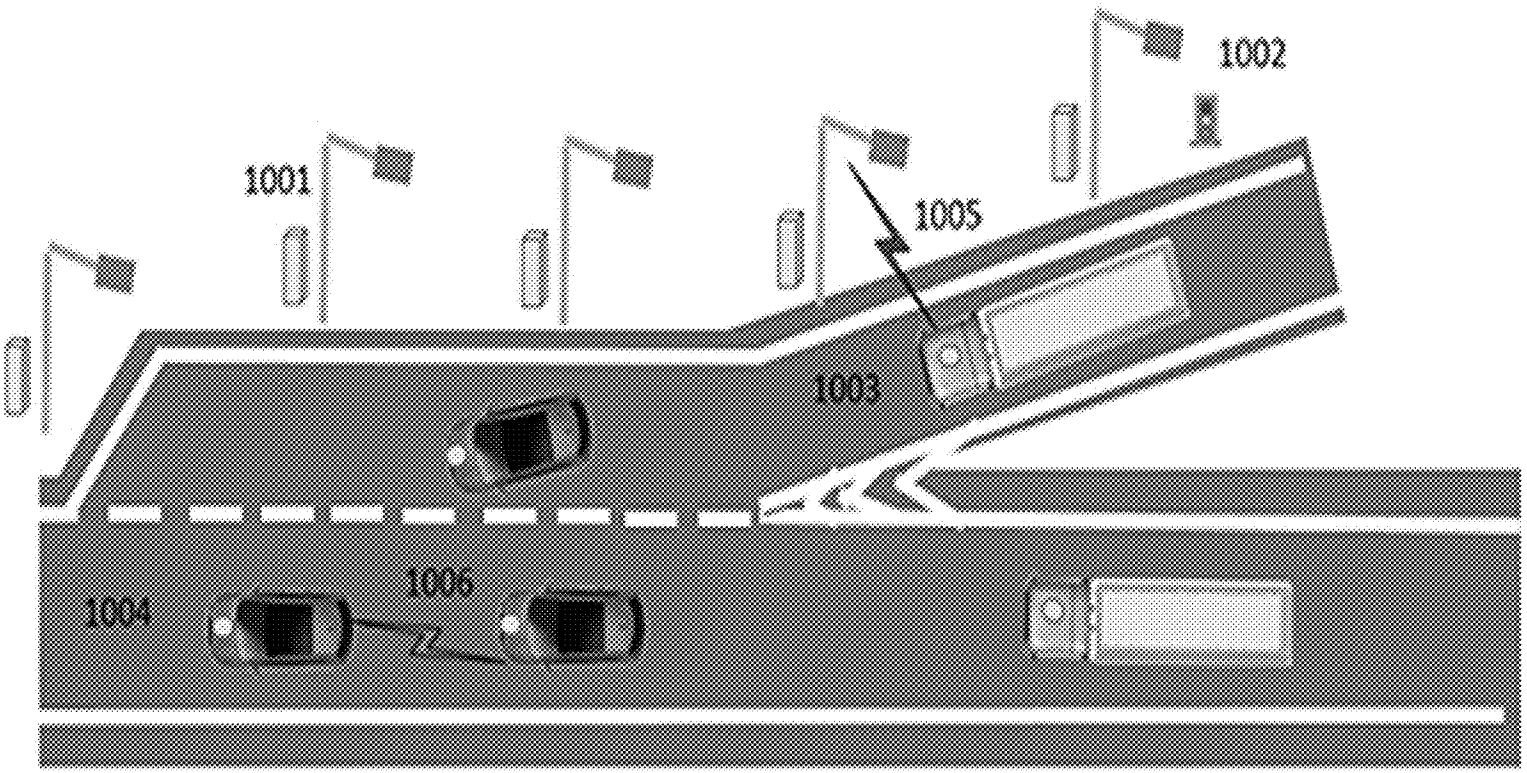
FIG. 10 illustrates an automated vehicle entering a dedicated lane from a ramp. Features shown in FIG. 10 include, e.g., 1001: RSU; 1002: Signal light; 1003: Ramp; 1004: Automated driving dedicated lane; 1005: I2V; 1006: V2V.

As shown in FIG. 9, in some embodiments, an automated vehicle enters the dedicated lane 906 from, e.g., a parking lot 904. In some embodiments, the vehicle enters the dedicated lane 906 through the ramp 902 from the parking lot 904. In some embodiments, before the vehicle enters the dedicated lane 906, RFID technology in RSU 901 is used to identify the vehicle and, in some embodiments, release vehicles into dedicated lanes that meet the requirements of dedicated lanes and, in some embodiments, intercept vehicles that do not meet the requirements for dedicated lanes. As shown in FIG. 10, in some embodiments, an automated vehicle enters a dedicated lane 1004 from a ramp 1003. In some embodiments, at the entrance of the ramp 1003, RFID in RSU 1001 is used to identify the vehicle and determine if the vehicle is approved for a dedicated lane. In some embodiments, traffic flow data collected by RSU 1001 characterizing traffic flow in the dedicated lane and the ramp, the queue at the entrance of the ramp, and the corresponding ramp control algorithm, are used to control traffic lights 1002 and, in some embodiments, to control whether a vehicle should be approved to enter the ramp. In some embodiments, based on the speed and position of an adjacent vehicle on the main lane, the RSU 1001 calculates the speed and merging position of the entering vehicle to control the entering vehicle and cause it to enter the dedicated lane 1004.

Figure 11:
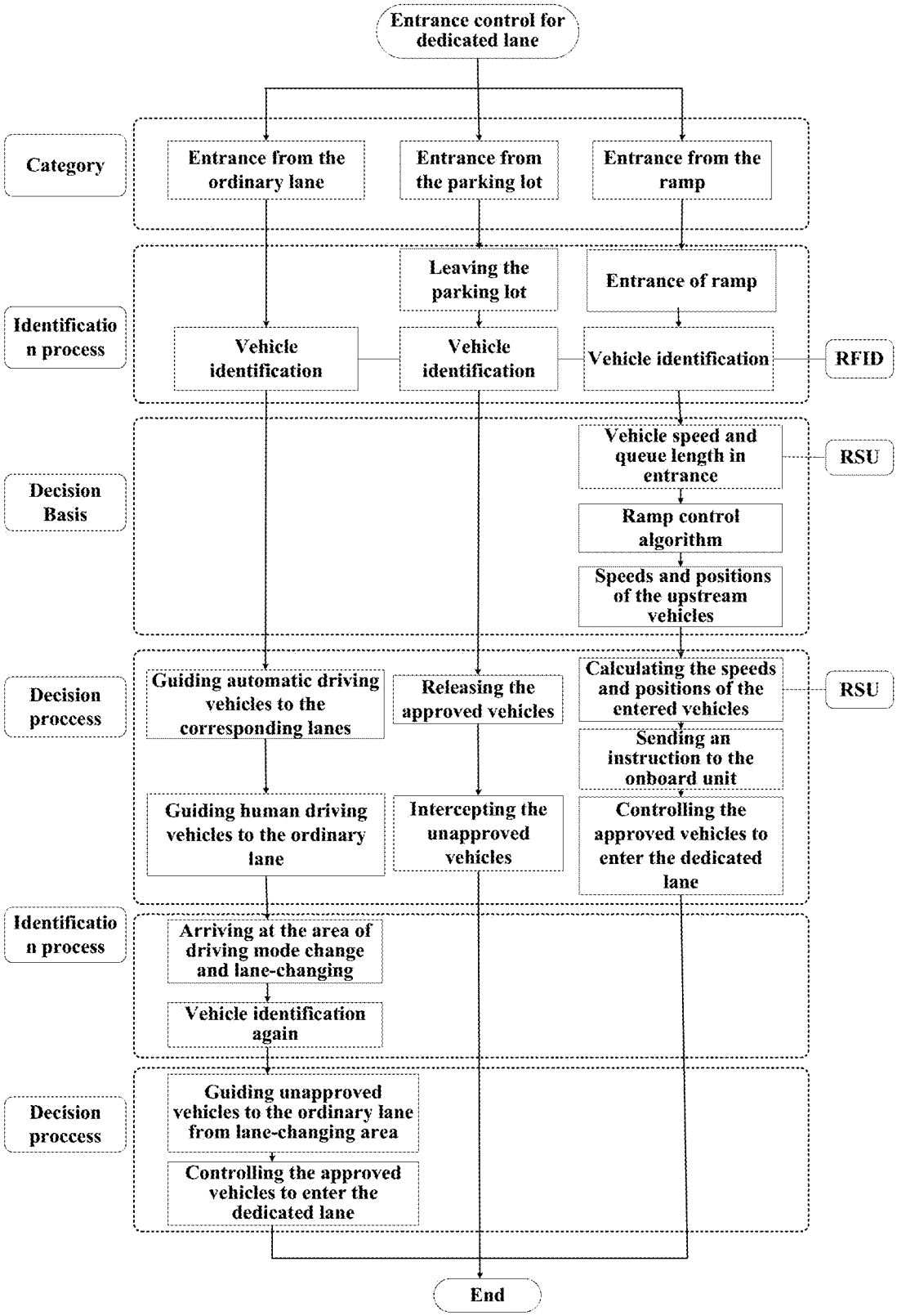
FIG. 11 is a flow chart of three exemplary situations of entering a dedicated lane.

In some embodiments, the technology contemplates several scenarios controlling the entrance of vehicles into a dedicated lane, e.g., entering a dedicated lane from: an ordinary lane, a parking lot, and a ramp. The flow chart of FIG. 11 shows these three exemplary situations of vehicles entering the dedicated lane from an ordinary lane, a parking lot, and a ramp. In some embodiments, before the vehicles enter into a dedicated lane, the vehicles are identified using the RFID and determined if they are allowed into the dedicated lane. If a vehicle is approved to enter the dedicated lane, algorithms are applied to calculate the entering speed using an RSU. If a vehicle is not approved to enter the dedicated lane, algorithms are applied to lead it into the ordinary lane.

Figure 12:
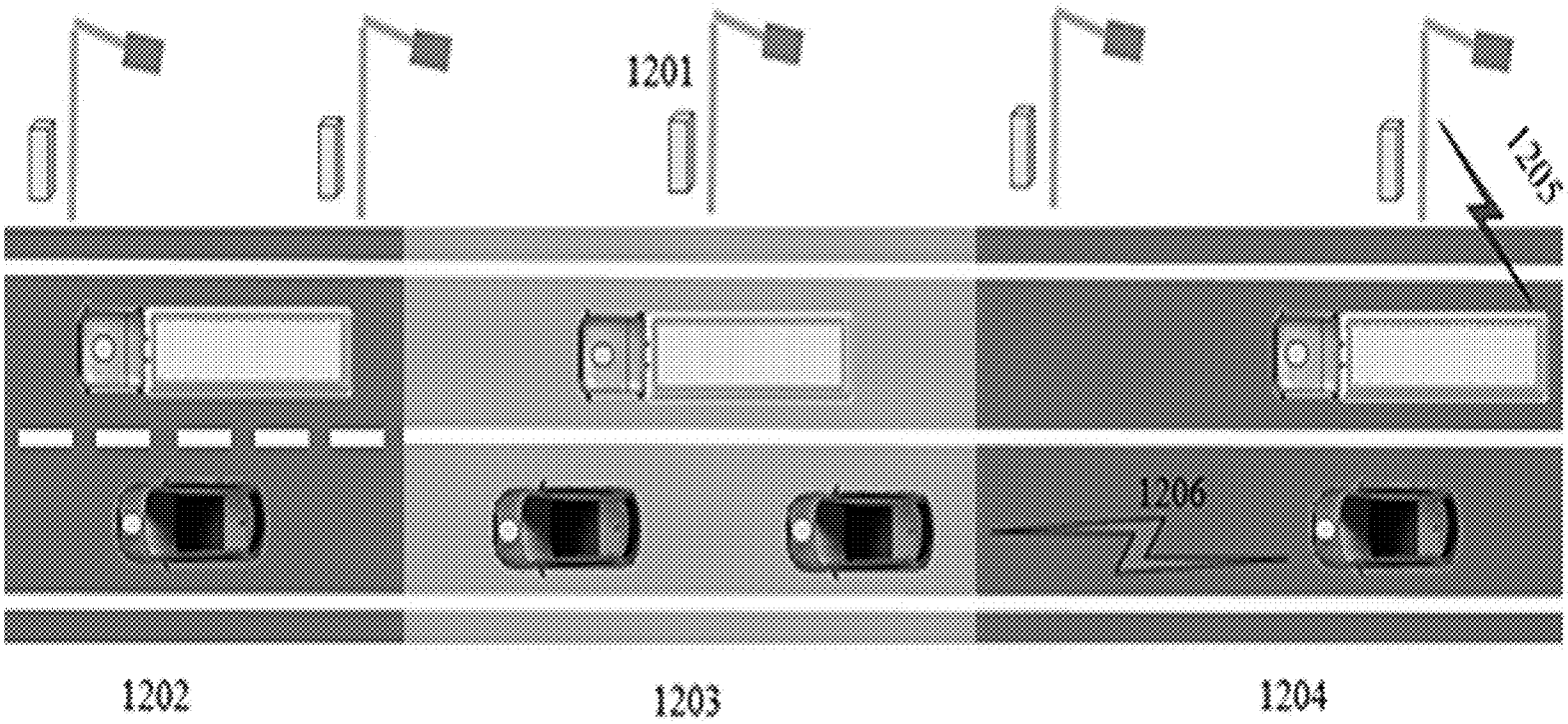
FIG. 12 illustrates an automated vehicle exiting a dedicated lane to an ordinary lane. Features shown in FIG. 12 include, e.g., 1201: RSU; 1202: Ordinary lane; 1203: Change of driving style area; 1204: Automated driving dedicated lane; 1205: I2V; 1206: V2V.

Similarly, embodiments relate to control of vehicles moving between dedicated and ordinary lanes. As shown in FIG. 12, in some embodiments, an automated vehicle exits the dedicated lane 1204 to the ordinary lane 1202. In some embodiments, an automated vehicle switches driving mode from self-driving ("automated") to manual driving ("non-automated") in the change of driving style area 1203. Then, in some embodiments, the driver drives the vehicle out of the dedicated lane; and, in some embodiments, the driver drives the vehicle to the ordinary lane 1202.

Figure 13:
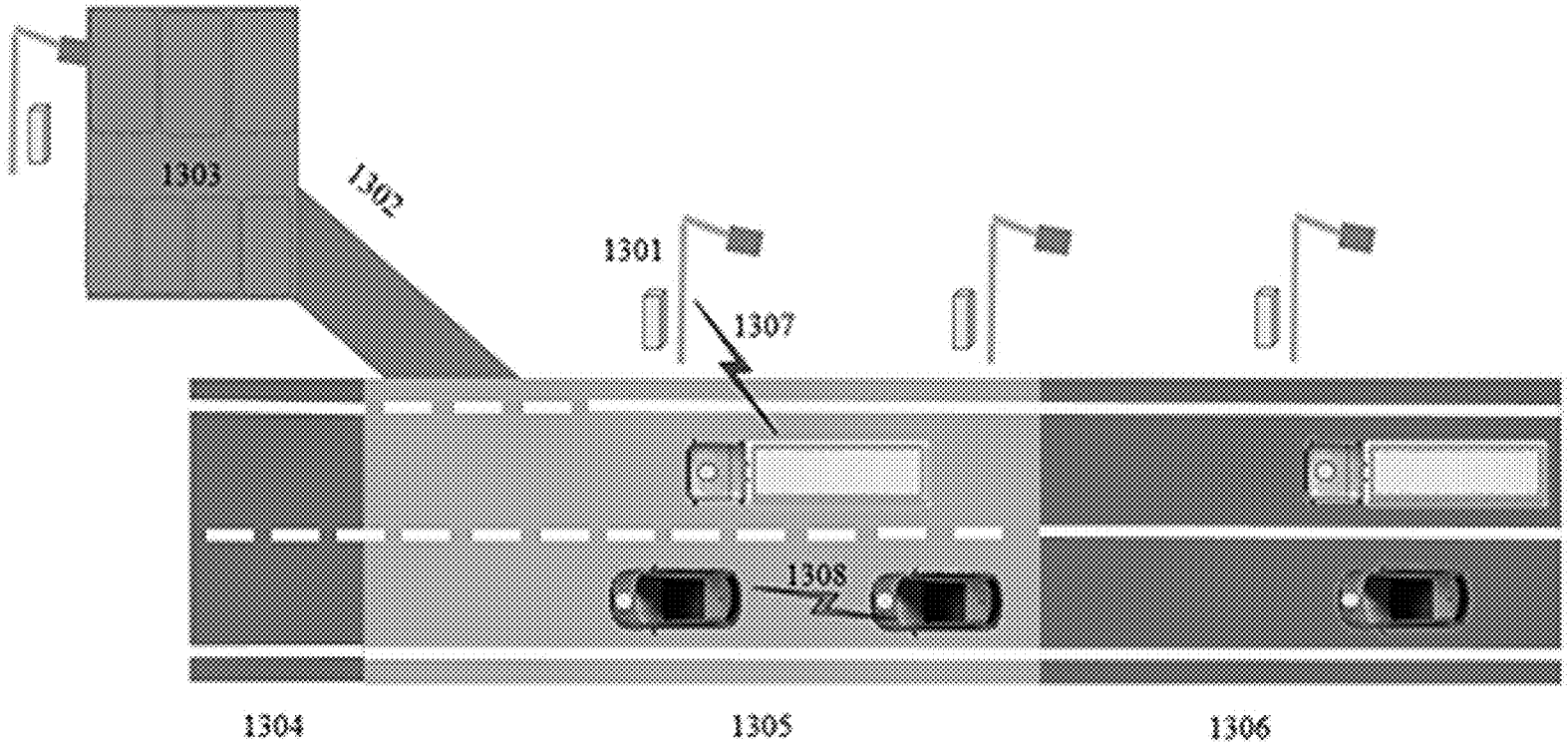
FIG. 13 illustrates automated vehicles driving from a dedicated lane to a parking area. Features shown in FIG. 13 include, e.g., 1301: Road side unit; 1302: Off-ramp lane; 1303: Parking area; 1304: Common highway segment; 1305: Lane changing and holding area; 1306: CAVH dedicated lane; 1307: Communication between RSUs and vehicles; 1308: Communication between vehicles.

As shown in FIG. 13, in some embodiments, an automated vehicle drives from a CAVH dedicated lane 1306 to a parking area 1303. In some embodiments, a road side unit 1301 retrieves and/or obtains vehicle information 1307 to plan driving routes and parking space for each vehicle. In some embodiments, for vehicles that will enter the lane changing and holding area 1305, the RSU sends deceleration instructions. In some embodiments, for the vehicles that will enter the parking area 1303, the RSU sends instructions for, e.g., routing, desired speed, and lane changing.

Figure 14:
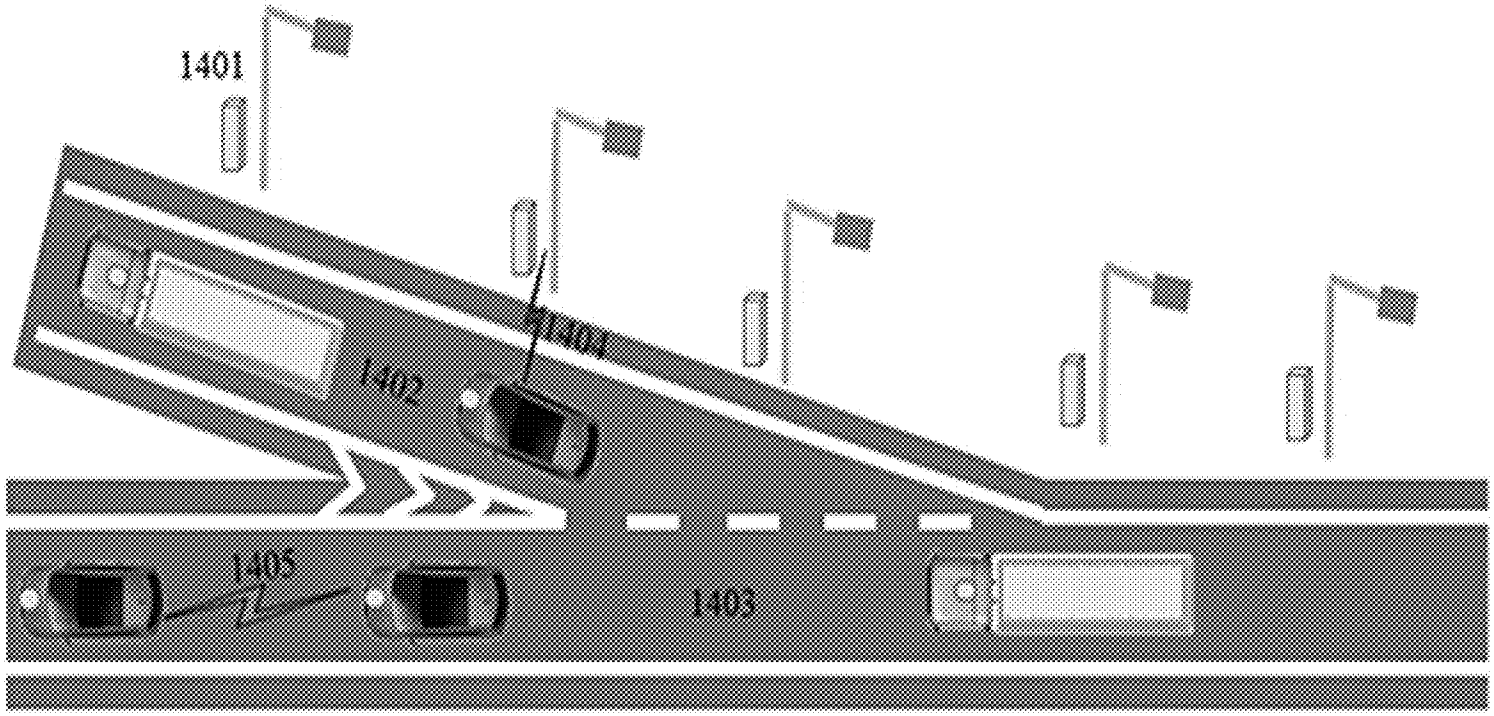
FIG. 14 illustrates automated vehicles exiting from a dedicated lane to an off-ramp. Features shown in FIG. 14 include, e.g., 1401: Road side unit; 1402: Off-ramp lane; 1403: CAVH dedicated lane; 1404: Communication between RSUs and vehicles; 1405: Communication between vehicles.

As shown in FIG. 14, in some embodiments, an automated vehicle exits from a CAVH dedicated lane 1403 to an off-ramp 1402. In some embodiments, the off-ramp RSU retrieves and/or obtains vehicle information such as headway and/or speed and sends control instructions 1404, e.g., comprising desired speed, headway, and/or turning angles to vehicles that will exit the ramp.

Figure 15:
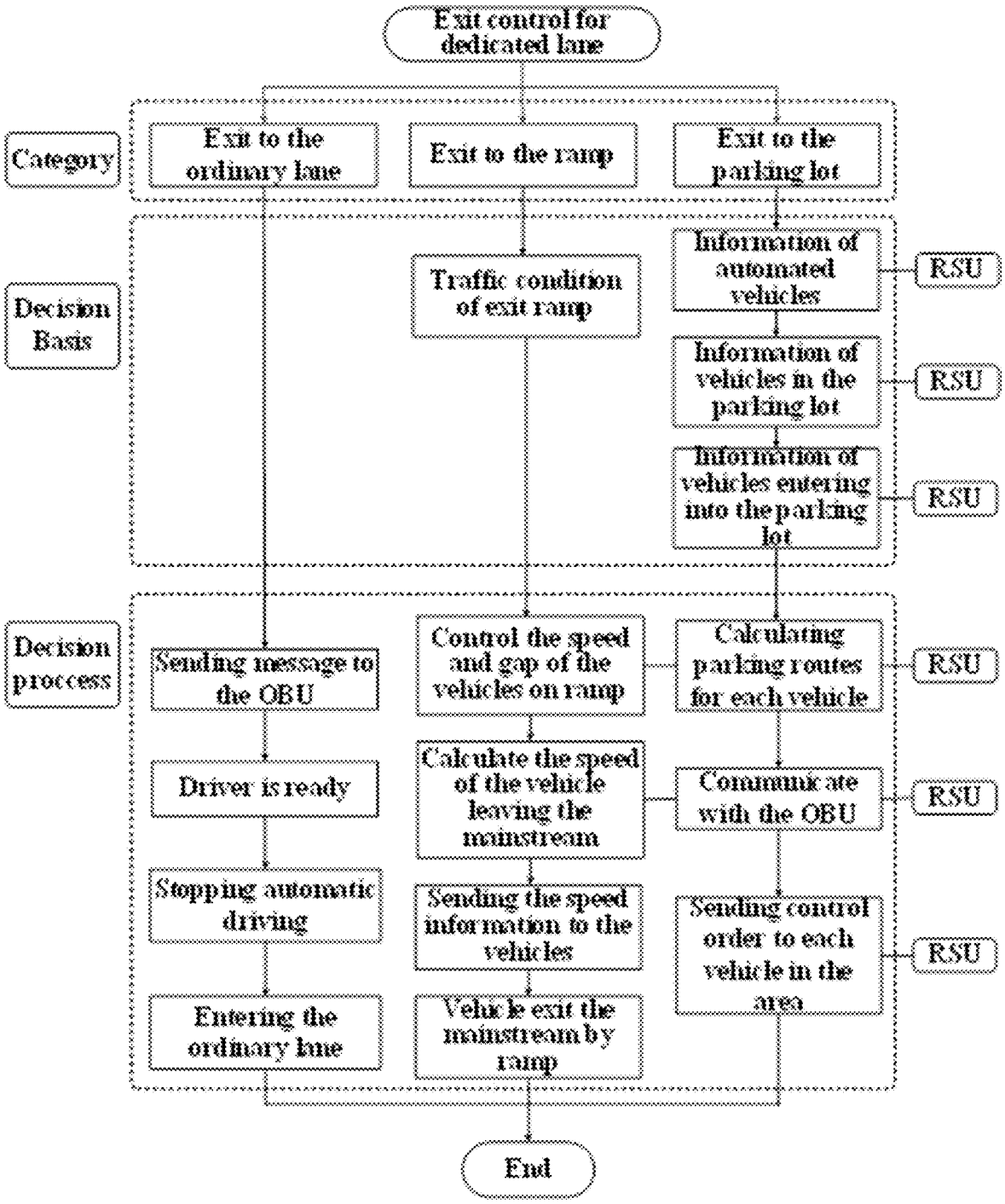
FIG. 15 is a flow chart of three exemplary scenarios of exiting a dedicated lane.

The technology contemplates, in some embodiments, several scenarios controlling the exit of vehicles from the CAVH dedicated lane, e.g., exiting to an ordinary lane, exiting to a ramp, and exiting to a parking area. The flow chart of FIG. 15 shows these three exemplary situations of vehicles exiting to the ordinary lane, exiting to the ramp, and exiting to the parking area. In some embodiments, an RSU evaluates traffic conditions in these three scenarios. If the conditions meet the requirements, the RSU sends instructions leading the vehicle to exit the dedicated lane.

Figure 16:
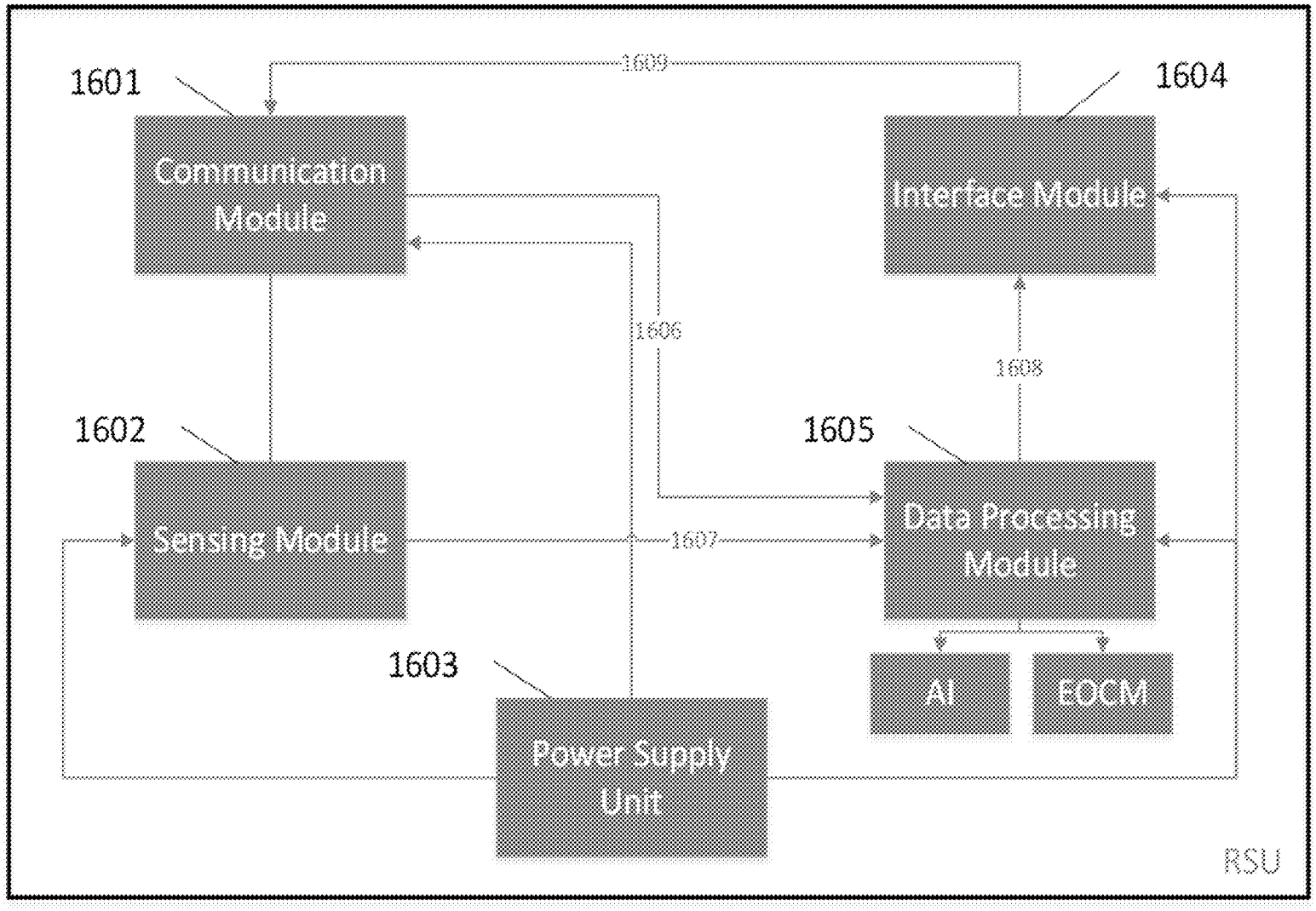
FIG. 16 illustrates the physical components of an exemplary RSU. Features shown in FIG. 16 include, e.g., 1601: Communication Module; 1602: Sensing Module; 1603: Power Supply Unit; 1604: Interface Module; 1605: Data Processing Module; 1606: Physical connection of Communication Module to Data Processing Module; 1607: Physical connection of Sensing Module to Data Processing Module; 1608: Physical connection of Data Processing Module to Interface Module; 1609: Physical connection of Interface Module to Communication Module.
Figure 17:
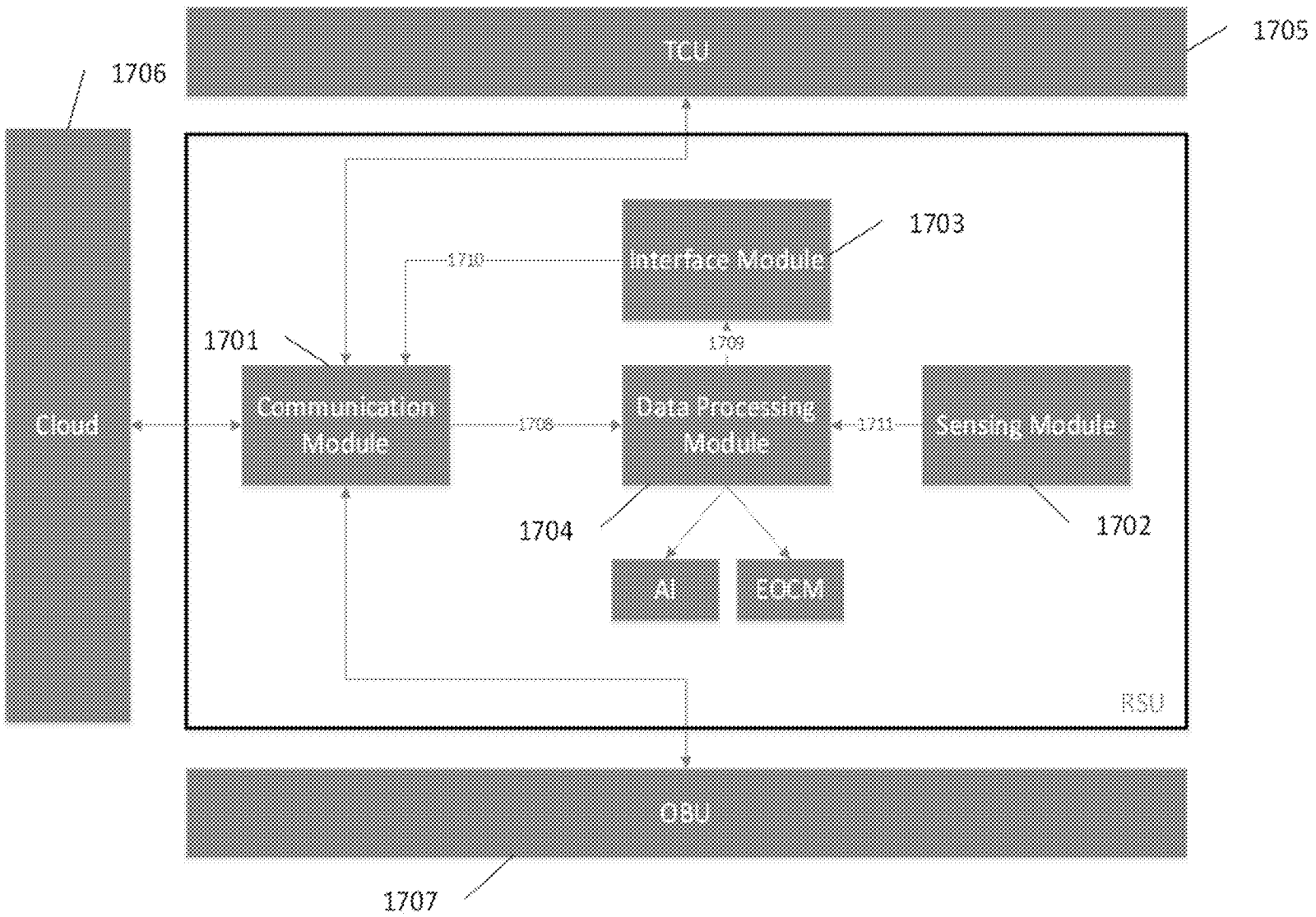
FIG. 17 illustrates internal data flow within a RSU. Features shown in FIG. 17 include, e.g., 1701: Communication Module; 1702: Sensing Module; 1703: Interface Module (e.g., a module that communicates between the data processing module and the communication module); 1704: Data Processing Module; 1705: TCU; 1706: Cloud; 1707: OBU; 1708: Data flow from Communication Module to Data Processing Module; 1709: Data flow from Data Processing Module to Interface Module; 1710: Data flow from Interface Module to Communication Module; 1711: Data flow from Sensing Module to Data Processing Module.

As shown in FIG. 16, in some embodiments an RSU comprises one or more physical components. For example, in some embodiments the RSU comprises one or more of a Communication Module 1601, a Sensing Module 1602, a Power Supply Unit 1603, an Interface Module 1604, and/or a Data Processing Module 1605. Various embodiments comprise various types of RSU, e.g., having various types of module configurations. For example, a vehicle-sensing RSU (e.g., comprising a Sensing Module) comprises only a vehicle ID recognition unit for vehicle tracking, e.g., to provide a low cost RSU for vehicle tracking. In some embodiments, a typical RSU (e.g., an RSU sensor module) comprises various sensors, e.g., LiDAR, RADAR, camera, and/or microwave radar. As shown in FIG. 17, data flows within an RSU and with other components of the CAVH system. In some embodiments, the RSU exchanges data with a vehicle OBU 1707, an upper level TCU 1705, and/or the cloud 1706. In some embodiments, the data processing module 1704 comprises two processors: 1) an external object calculating Module (EOCM); and 2) an AI processing unit. In some embodiments, the EOCM detects traffic objects based on inputs from the sensing module and the AI processing unit provides decision-making features (e.g., processes) to embodiments of the technology. As used herein, the term "cloud platform" or "cloud" refers to a component providing an infrastructure for applications, data storage, computing (e.g., data analysis), backup, etc. The cloud is typically accessible over a network and is typically remote from a component interacting with the cloud over the network.

Figure 18:
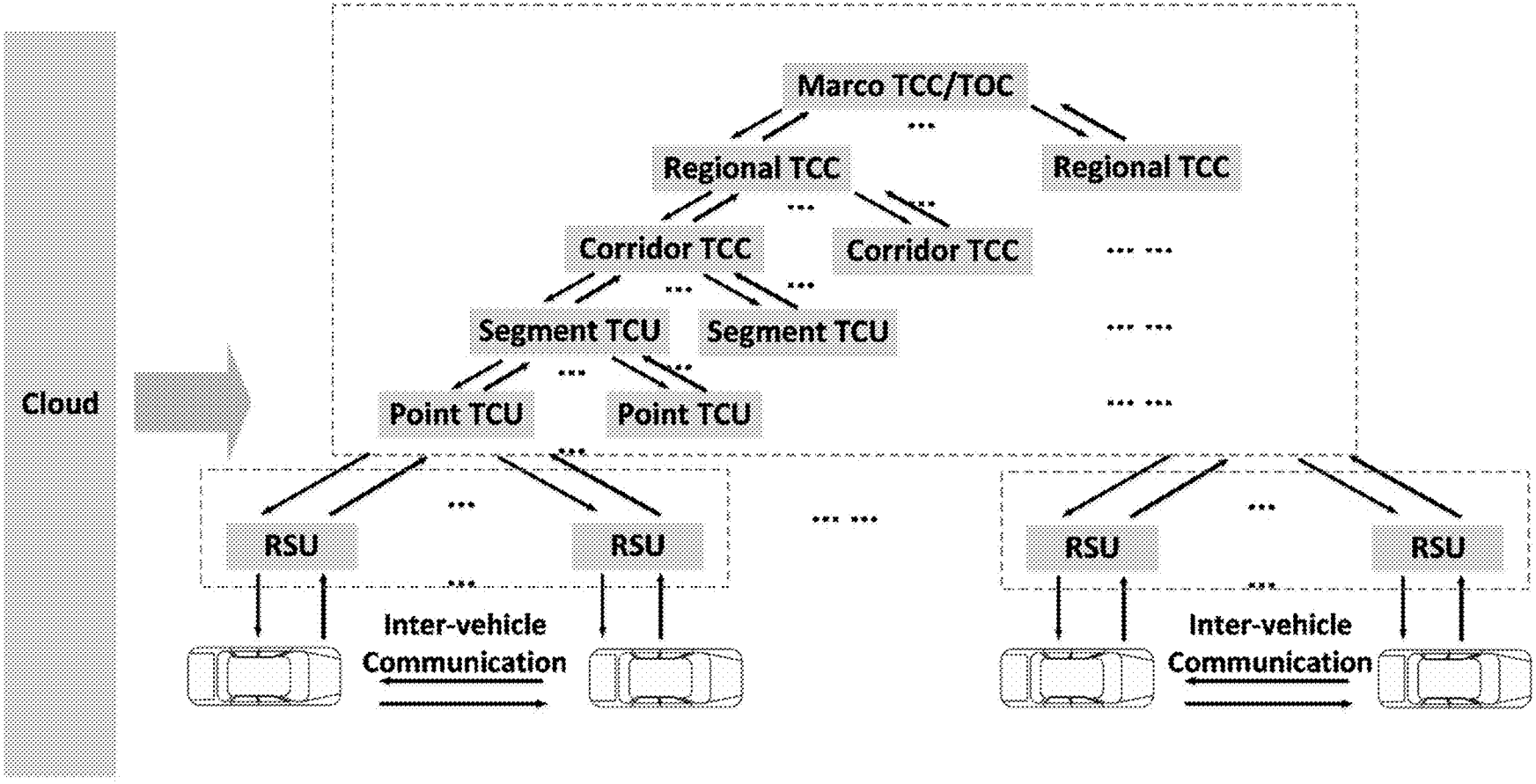
FIG. 18 illustrates the network and architecture of a TCC and a TCU.
Figure 19:
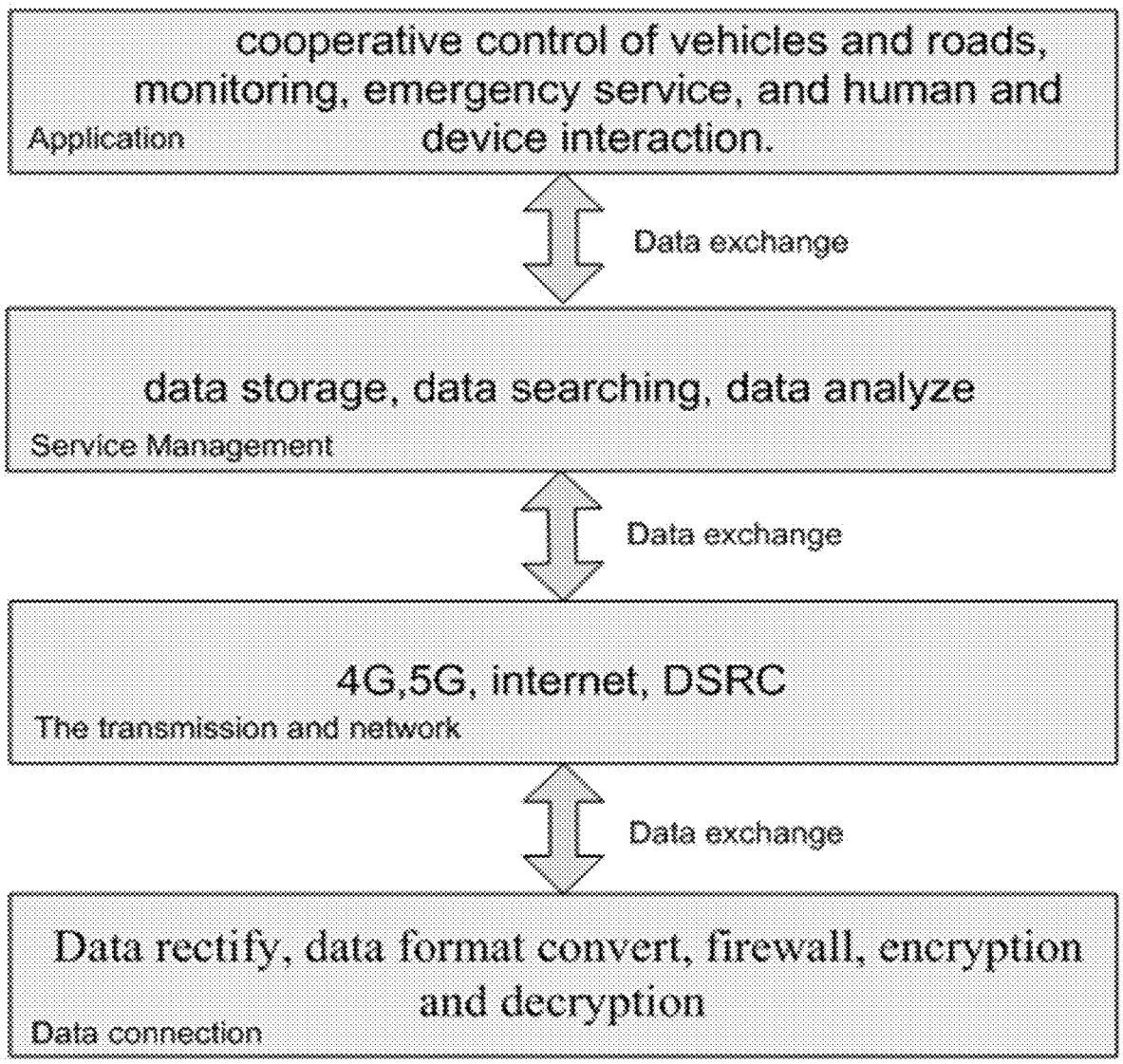
FIG. 19 illustrates the modules of a TCC and the relationships between TCC modules.
Figure 20:
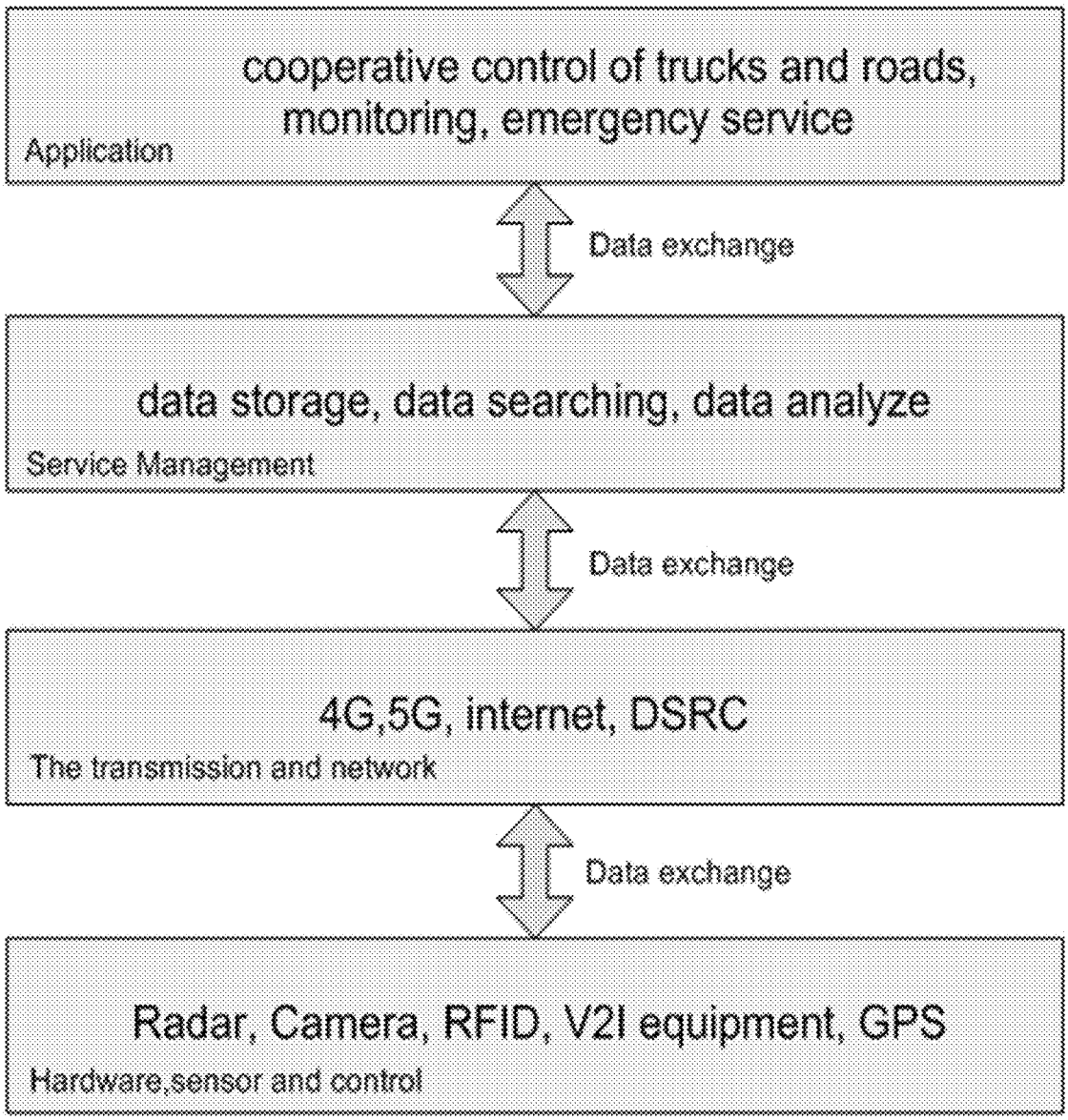
FIG. 20 illustrates the modules of a TCU and the relationships between TCU modules.

Embodiments of the technology comprise a traffic control center (TCC) and/or a traffic controller unit (TCU). As shown in FIG. 18, embodiments of the technology comprise a network and architecture of TCCs and/or TCUs. In some embodiments, the network and architecture of the system comprising the TCCs and TCUs has a hierarchical structure and is connected with the cloud. In the exemplary embodiment shown in FIG. 18, the network and architecture comprises several levels of TCC including, e.g., Macro TCCs, Regional TCCs, Corridor TCCs, and/or Segment TCCs. In some embodiments, the higher level TCCs control their lower lever (e.g., subordinate) TCCs, and data is exchanged between the TCCs of different levels. In some embodiments, the TCCs and TCUs show a hierarchical structure and are connected to a cloud. In some embodiments, the cloud connects the provided data platforms and various software components for the TCCs and TCUs and provides integrated control functions. In some embodiments, the cloud connects all provided data platforms and various software components for all TCCs and TCUs and provides the integrated control functions. As shown in FIG. 19, in some embodiments, TCCs have modules and the modules have relationships between them. For instance, as shown in FIG. 19, in some embodiments a TCC comprises (e.g., from top to bottom): an application module, a service management module, a transmission and network model, and/or a data connection module. In some embodiments, data exchange is performed between these modules to provide the functions of the TCCs. As shown in FIG. 20, in some embodiments, TCUs have modules and the module have relationships between them. For instance, as shown in FIG. 19, in some embodiments a TCU comprises (e.g., from top to bottom): an application module, a service management module, a transmission and network model, and/or a hardware model. In some embodiments, data exchange is performed between these modules to provide the functions of TCUs.

Figure 21:
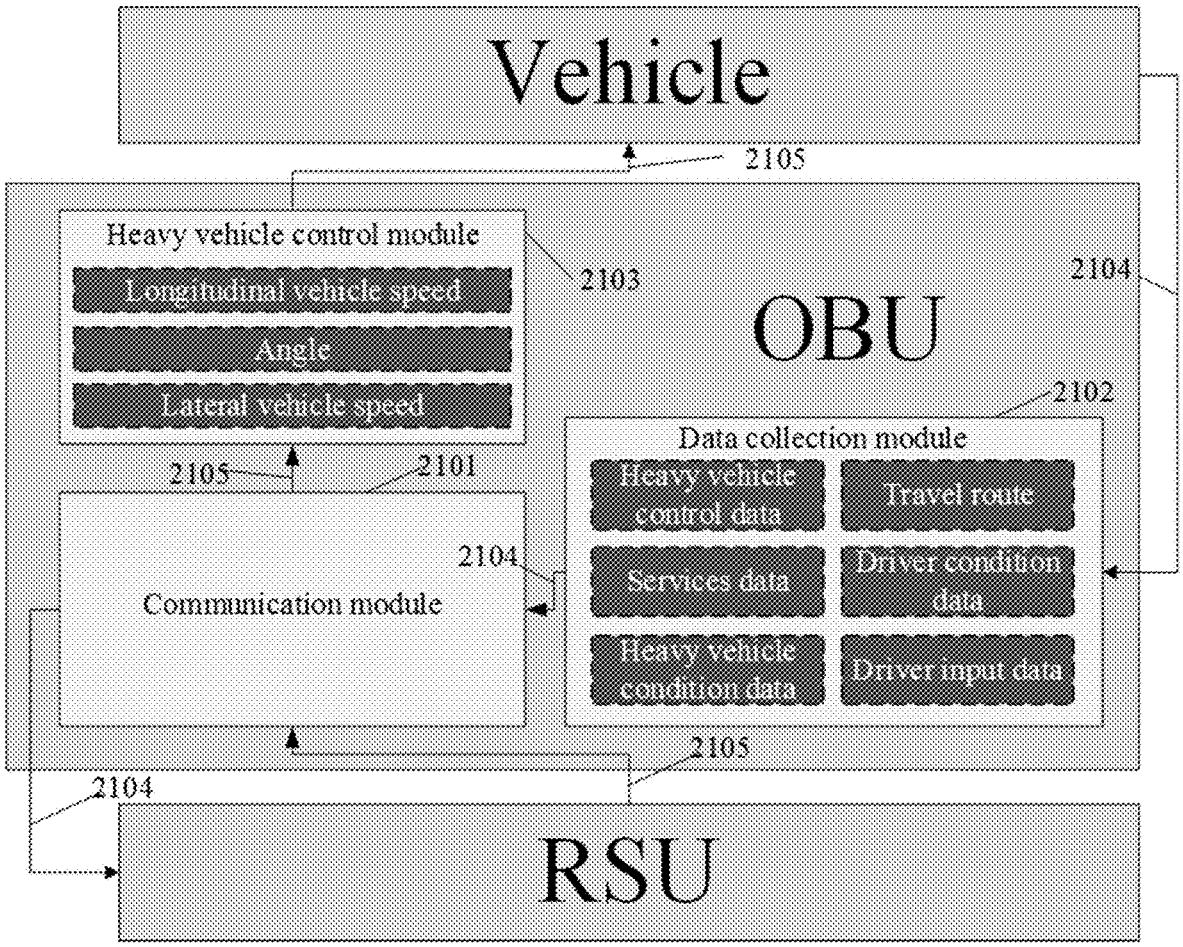
FIG. 21 illustrates the architecture of an OBU. Features shown in FIG. 21 include, e.g., 2101: Communication module for data transfer between RSU and OBU; 2102: Data collection module for collecting truck dynamic and static state data; 2103: Truck control module for executing control command from RSU (e.g., when the control system of the truck is damaged, the truck control module can take over control and stop the truck safely); 2104: Data of truck and driver; 2105: Data of RSU; 2201: RSU.

As shown in FIG. 21, embodiments provide an OBU comprising an architecture and data flow. In some embodiments, the OBU comprises a communication module 2101, a data collection module 2102, and vehicle control module 2103. In some embodiments, the data collection module collects data. In some embodiments, as shown in FIG. 21, data flows between an OBU and an RSU. In some embodiments, the data collection module 2102 collects data from the vehicle and/or human in a vehicle 2104 and sends it to an RSU through communication module 2101. Furthermore, in some embodiments, an OBU receives data from an RSU 2105 through communication module 2101. Accordingly, in some embodiments, the vehicle control module 2103 assists in controllingl the vehicle using the data from RSU 2105.

Figure 22:
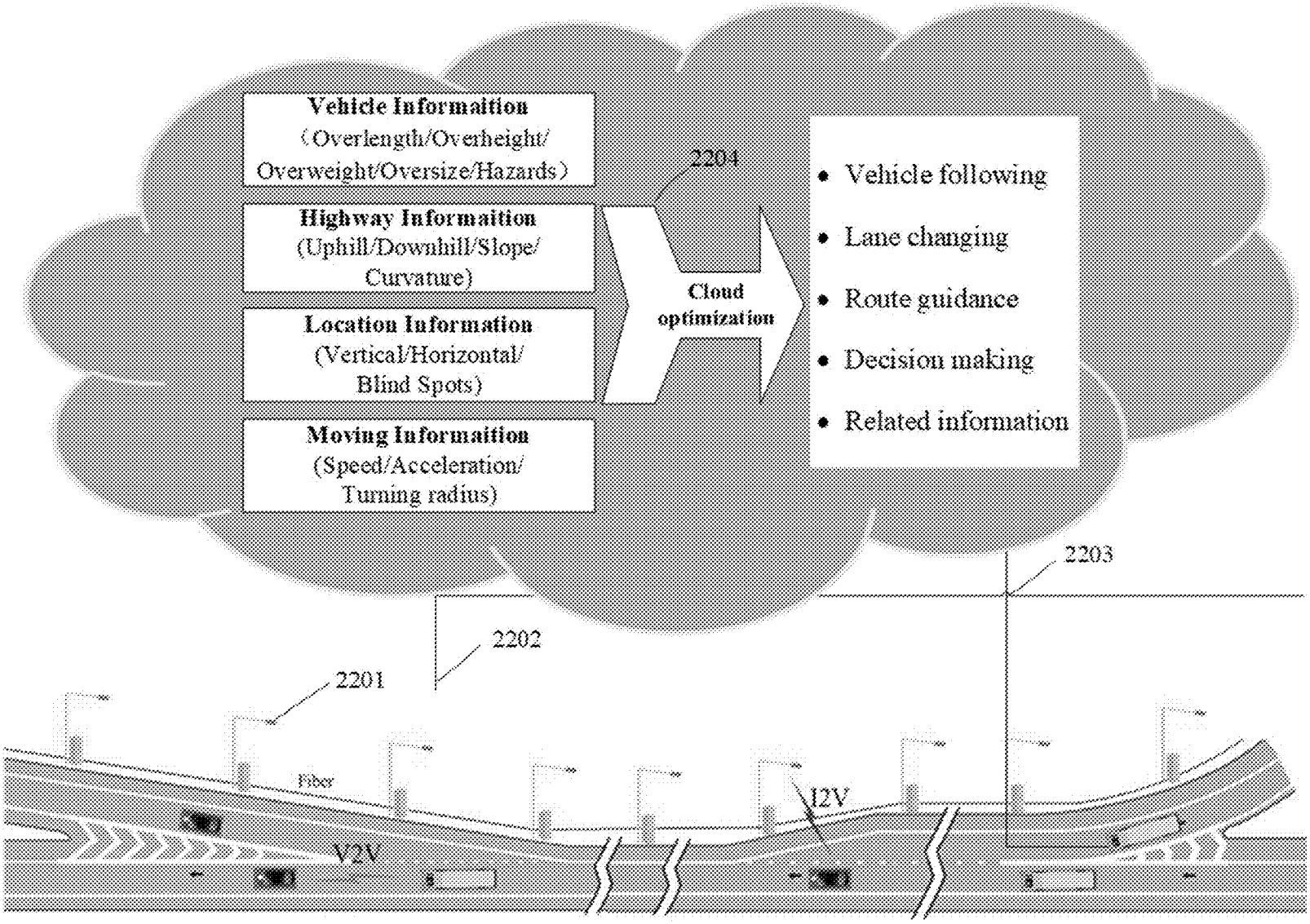
FIG. 22 illustrates the architecture of an embodiment of a CAVH cloud platform. Features shown in FIG. 22 include, e.g., 2201: RSU; 2202: Cloud to Infrastructure; 2203: Cloud to Vehicles; 2204: Cloud optimization technology (e.g., comprising data efficient storage and retrieval technology, big data association analysis, deep mining technologies, etc.); 2301: Special vehicles (e.g., oversize, overweight, overheight, and/or overlength vehicles; hazardous goods vehicles, manned vehicles).

As shown in FIG. 22, in some embodiments the technology comprises a cloud platform (e.g., a CAVH cloud platform). In some embodiments, the cloud platform comprises an architecture, e.g., as shown in FIG. 22. In some embodiments, the cloud platform stores, processes, analyzes, and/or transmits data, e.g., data relating to vehicle information, highway information, location information, and moving information. In some embodiments, the data relating to vehicle information, highway information, location information, and moving information relates to special features of the trucks and/or special vehicles using the system. In some embodiments, the cloud platform comprises a cloud optimization technology, e.g., comprising data efficient storage and retrieval technology, big data association analysis, and deep mining technologies. In some embodiments, the CAVH cloud platform provides information storage and additional sensing, computing, and control services for intelligent road infrastructure systems (IRIS) and vehicles, e.g., using the real-time interaction and sharing of information.

Figure 23:
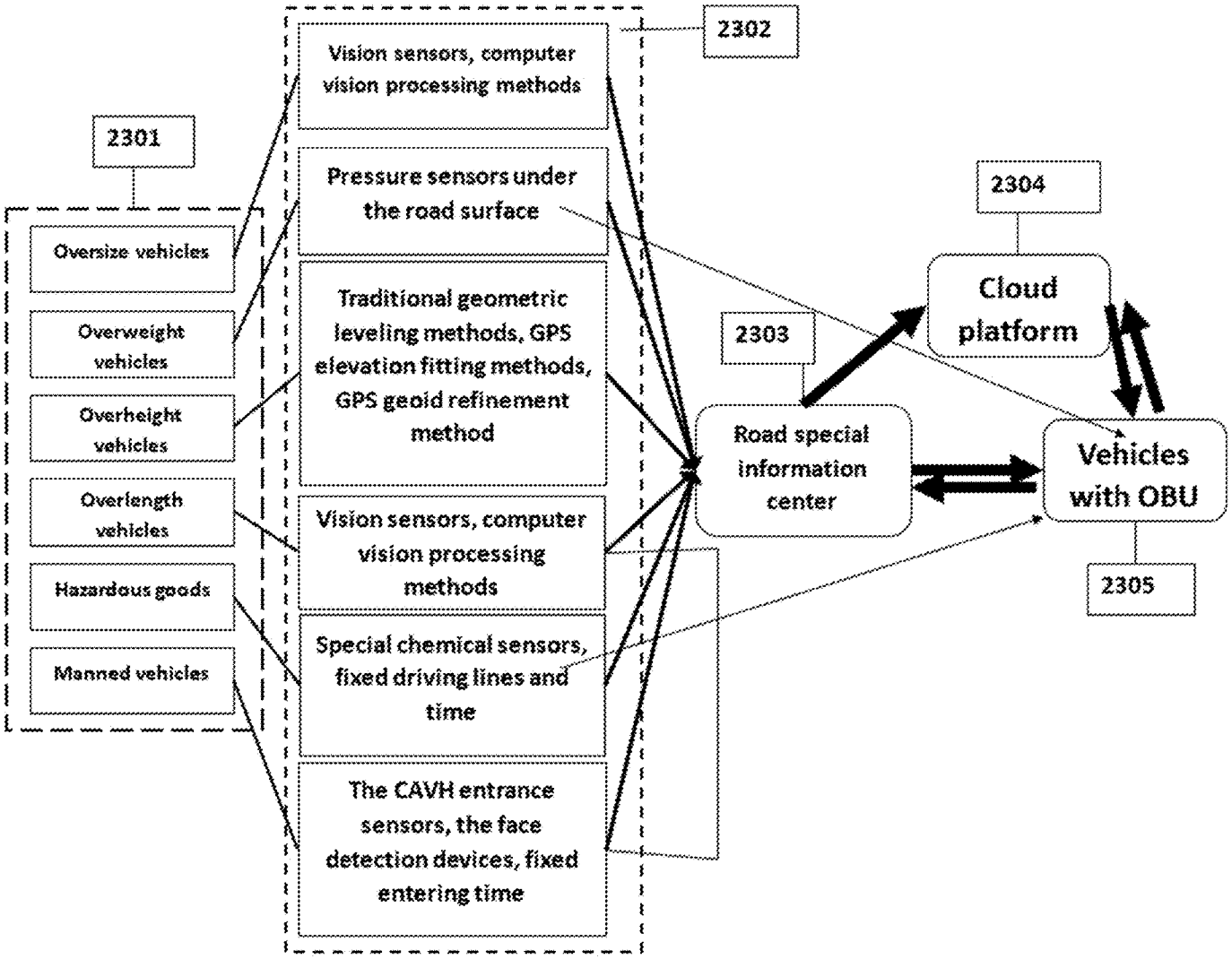
FIG. 23 illustrates approaches and sensors for identifying and sensing special vehicles. Features shown in FIG. 23 include, e.g., 2302: Sensing and processing methods for special vehicles; 2303: Road special information center; 2304: Other vehicles with OBU; 2305: Cloud platform.

As shown in FIG. 23, in some embodiments special vehicles 2301 (e.g., oversize, overweight, overheight, overlength vehicles; hazardous goods vehicles; manned vehicles) are sensed by special sensing and processing methods 2302. In some embodiments, the special sensing and processing methods 2302 are installed in an RSU. In some embodiments, the special sensing and processing methods 2302 are installed in an OBU 2304. In some embodiments, special sensing and processing methods 2302 are installed in an RSU and in an OBU 2304. In some embodiments, the information is recorded and processed in a centralized facility, e.g., a road special information center 2303. In some embodiments, the information is shared through the cloud platform 2305. As used herein, the term "special vehicle" refers to a vehicle controlled, in some embodiments, by particular processes and/or rules based on the special vehicle having one or more characteristics that are different than a typical vehicle used by a user for commuting and travelling (e.g., a passenger car, passenger truck, and/or passenger van). Non-limiting examples of a "special vehicle" include, but are not limited to, oversize vehicles (e.g., overlength vehicles, overwidth vehicles, overheight vehicles), overweight vehicles (e.g., heavy vehicles), vehicles transporting special goods (e.g., hazardous material (e.g., flammable, radioactive, poisonous, explosive, toxic, biohazardous, and/or waste material), perishable material (e.g., food), temperature sensitive material, valuable material (e.g., currency, precious metals), emergency vehicles (e.g., fire truck, ambulance, police vehicle, tow truck), scheduled vehicles (e.g., buses, taxis, on-demand and ride-share vehicles (e.g., Uber, Lyft, and the like)), shuttles, car services, livery vehicles, delivery vehicles, etc.

Figure 24:
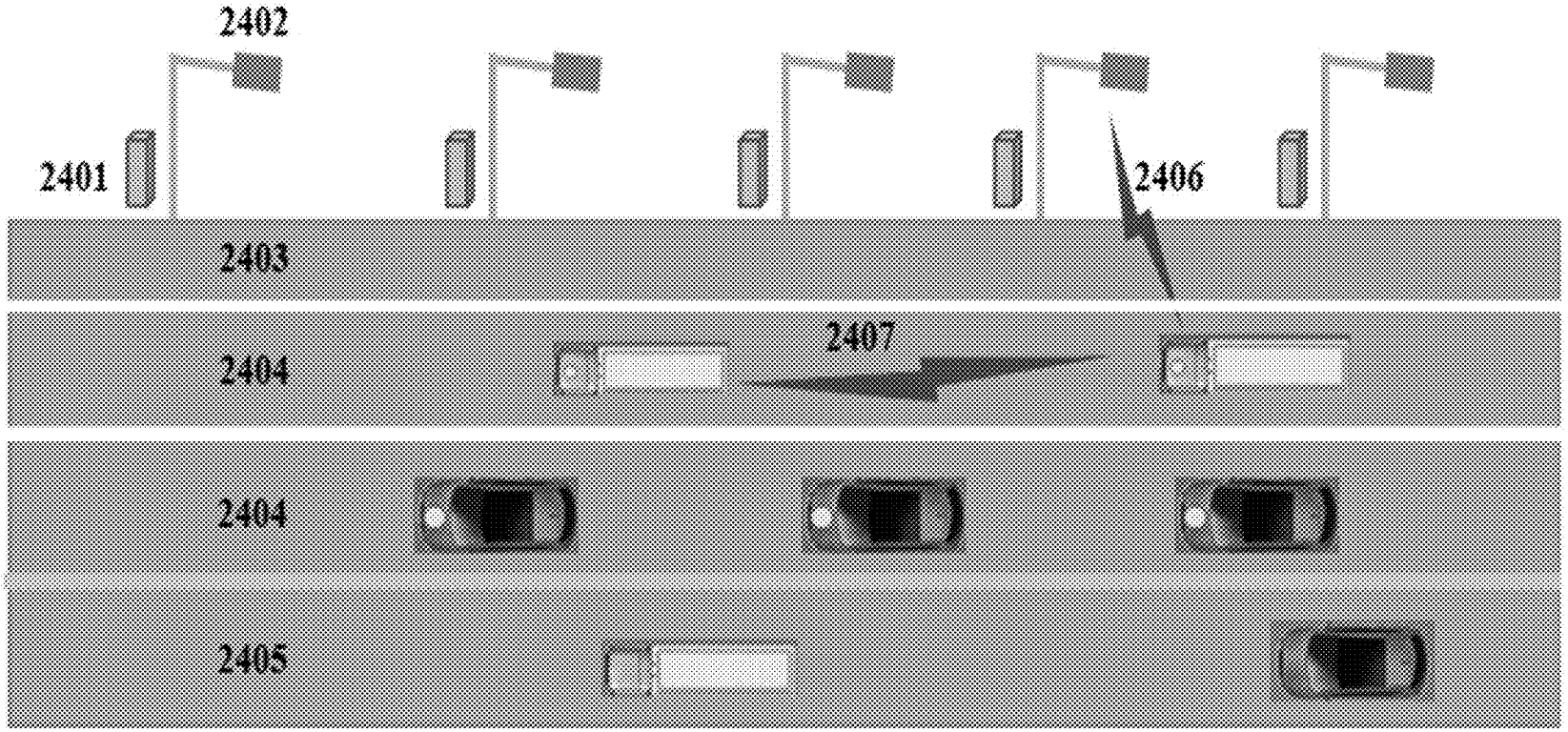
FIG. 24 illustrates vehicle control on a straight road with no gradient. Features shown in FIG. 24 include, e.g., 2401: RSU computing module (CPU, GPU); 2402: RSU sensing module (e.g., comprising DSRC-4G-LTE, RFID, Camera, Radar, and/or LED); 2403: Emergency lane; 2404: Automated driving lane; 2405: Normal driving lane; 2406: I2V; 2407: V2V.

As shown in FIG. 24, embodiments of the technology provide automatic driving modes. In some embodiments, an RSU sensing module 2402 comprises RFID technology that is used for vehicle identification for automatic driving modes. In some embodiments, the RSU sensing module 2402 comprises components to illuminate a road and vehicles on the road (e.g., a light source (e.g., an LED (e.g., a high brightness LED))). In some embodiments, the components to illuminate a road and vehicles on the road (e.g., a light source (e.g., an LED)) are installed directly above the road. In some embodiments, the RSU sensing module 2402 comprises a component to track vehicles on a road, e.g., laser radar. Thus, in some embodiments a laser radar provides a tracking function. In some embodiments, an RSU-associated 2402 component comprises a camera. In some embodiments, the camera and radar cooperate to detect obstacles and/or vehicles. In some embodiments, data obtained by the radar are used to calculate a distance between two vehicles (e.g., between an upstream vehicle and a current vehicle). In some embodiments, wireless positioning technology is used to reduce detection errors of the roadside camera and radar, e.g., in rainy and/or snowy weather. In some embodiments, the cloud platform calculates the optimal driving state of the upstream and current vehicles. In some embodiments, the cloud platform calculates the driving route of the two vehicles, the driving speed of the two vehicles, the acceleration of the two vehicles, and/or the slope of the acceleration curve of the two vehicles. In some embodiments, the cloud platform sends an optimal driving state of the upstream and current vehicles to RSU 2401. In some embodiments, the cloud platform sends the driving route of the two vehicles, the driving speed of the two vehicles, the acceleration of the two vehicles, and/or the slope of the acceleration curve of the two vehicles to RSU 2401. In some embodiments, an RSU sends instructions to an OBU to control the operation of the vehicles, and the vehicles drive according to their respective instructions.

Figure 25A:
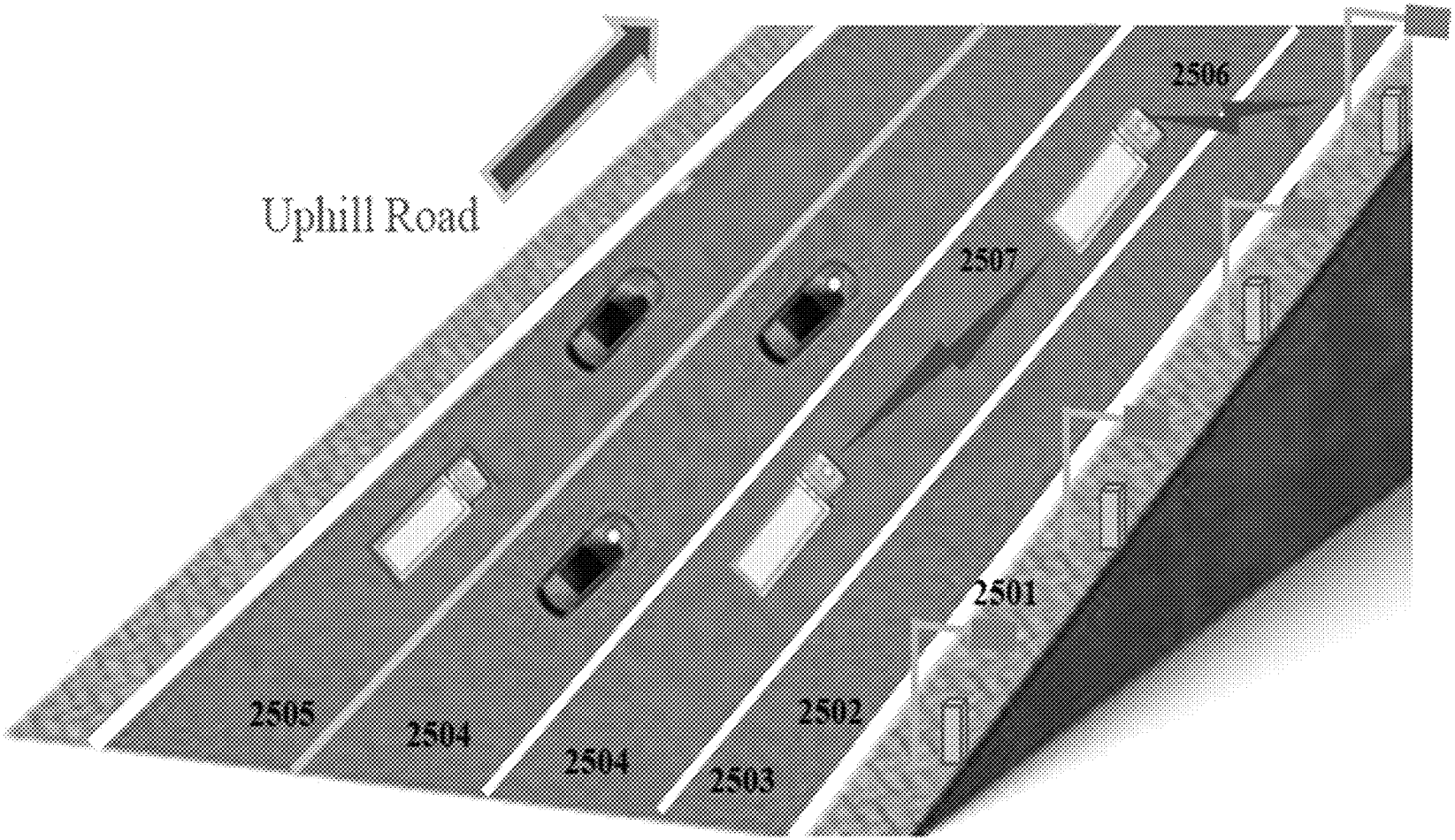
FIG. 25*a* illustrates vehicle control on an uphill grade. Features shown in FIG. 25*a* include, e.g., 2501: RSU computing module (CPU, GPU); 2502: RSU sensing module (e.g., comprising DSRC-4G-LTE, RFID, Camera, Radar, and/or LED); 2503: Emergency lane; 2504: Automated driving lane; 2505: Normal driving lane; 2506: I2V; 2507: V2V.
Figure 25B:
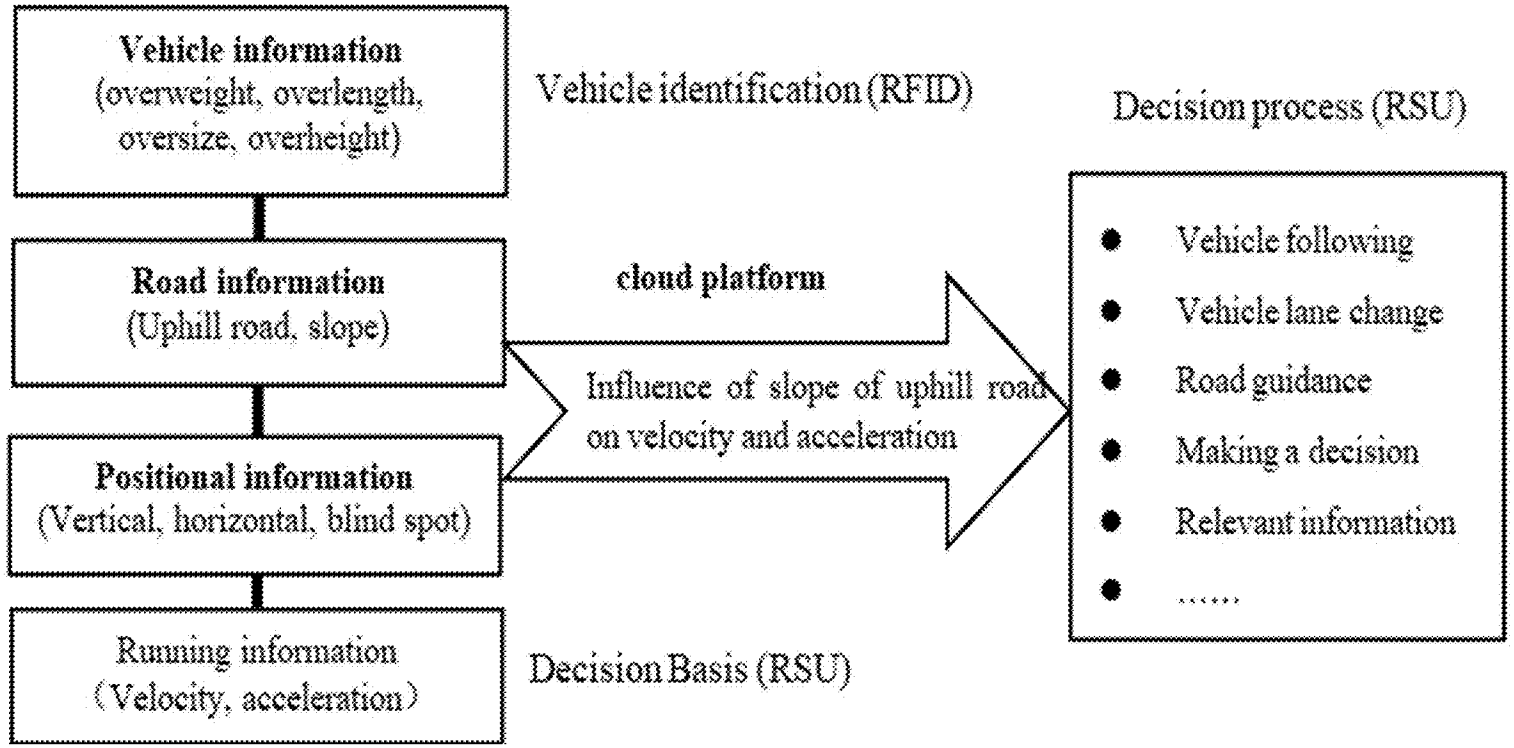
FIG. 25*b* is a block diagram of an embodiment of a method for controlling a vehicle on an uphill grade.

As shown in FIGS. 25*a* and 25*b*, in some embodiments the technology relates to vehicles driving on an uphill grade. Accordingly, in some embodiments the technology provides instructions to vehicle and an upstream vehicle to drive the vehicles forward and uphill according to the respective operation instructions. For example, in some embodiments, an RSU sensing module 2502 comprises an RFID technology that is used for vehicle identification. In some embodiments, an RSU sensing module 2502 comprising an LED (e.g., a high-brightness LED) component is erected directly above the road (e.g., through the gantry). In some embodiments, the LED works in conjunction with a laser radar of the RSU sensing module 2502 to provide a tracking function. In some embodiments, an RSU sensing module 2502 comprises a roadside camera. In some embodiments, the roadside camera in 2502 cooperates with the laser radar to detect obstacles and vehicles. In some embodiments, vehicle distance and other parameters characterizing the environment around the vehicle are calculated. In some embodiments, wireless positioning technology reduces roadside camera and laser radar detection errors, e.g., in rainy and/or snowy conditions. In some embodiments, the cloud platform calculates the optimal driving state of the upstream and current vehicles. In some embodiments, the cloud platform calculates the driving route of the two vehicles, the driving speed of the two vehicles, the acceleration of the two vehicles, and/or the slope of the acceleration curve of the two vehicles. In some embodiments, the cloud platform sends an optimal driving state of the upstream and current vehicles to RSU 2501. In some embodiments, the cloud platform sends the driving route of the two vehicles, the driving speed of the two vehicles, the acceleration of the two vehicles, and/or the slope of the acceleration curve of the two vehicles to RSU 2501. In some embodiments, an RSU sends instructions to an OBU to control the operation of the vehicles, and the vehicles drive according to their respective instructions, e.g., the upstream vehicle and the current vehicle run straight ahead and uphill according to the instructions of their respective operations.

Figure 26A:
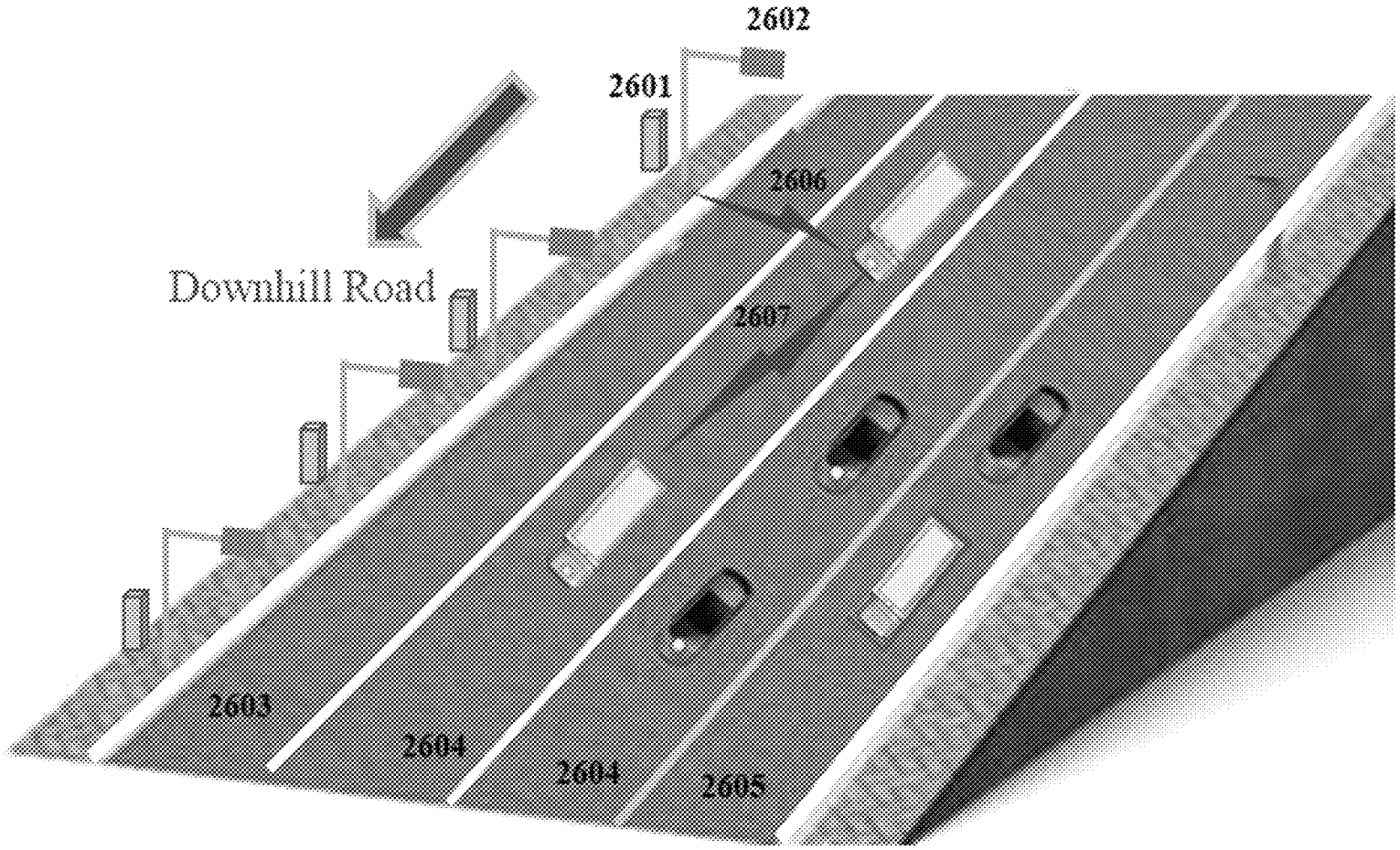
FIG. 26*a* illustrates vehicle control on a downhill grade. Features shown in FIG. 26*a* include, e.g., 2601: RSU computing module (CPU, GPU); 2602: RSU sensing module (e.g., comprising DSRC-4G-LTE, RFID, Camera, Radar, and/or LED); 2603: Emergency lane; 2604: Automated driving lane; 2605: Normal driving lane; 2606: I2V; 2607: V2V.
Figure 26B:
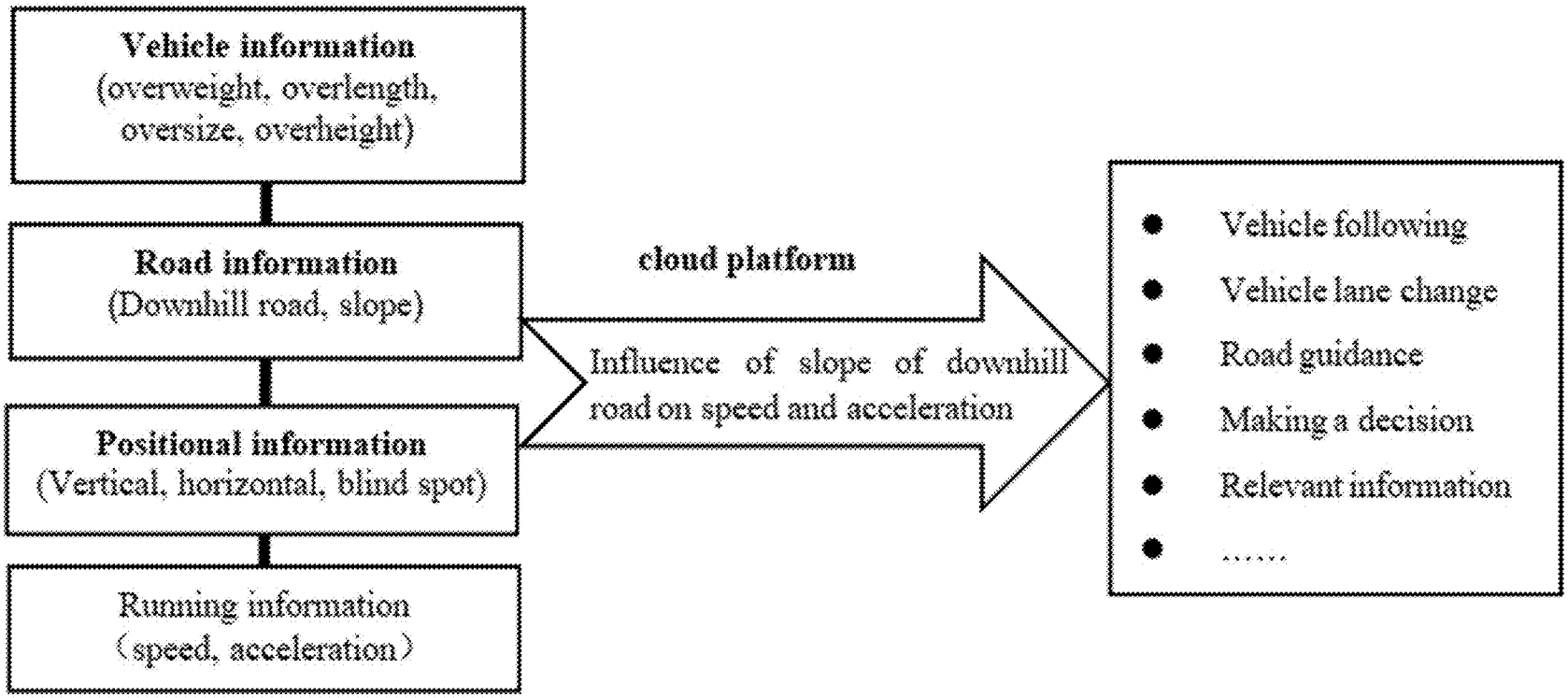
FIG. 26*b* is a block diagram of an embodiment of a method for controlling a vehicle on a downhill grade.

As shown in FIGS. 26*a* and 26*b*, in some embodiments the technology relates to vehicles driving on a downhill grade. Accordingly, in some embodiments the technology provides instructions to vehicle and an upstream vehicle to drive the vehicles forward and downhill according to the respective operation instructions. For example, in some embodiments, an RSU sensing module 2602 comprises an RFID technology that is used for vehicle identification. In some embodiments, an RSU sensing module 2602 comprising an LED (e.g., a high-brightness LED) component is erected directly above the road (e.g., through the gantry). In some embodiments, the LED works in conjunction with a laser radar of the RSU sensing module 2602 to provide a tracking function. In some embodiments, an RSU sensing module 2602 comprises a roadside camera. In some embodiments, the roadside camera in 2602 cooperates with the laser radar to detect obstacles and vehicles. In some embodiments, vehicle distance and other parameters characterizing the environment around the vehicle are calculated. In some embodiments, wireless positioning technology reduces roadside camera and laser radar detection errors, e.g., in rainy and/or snowy conditions. In some embodiments, the cloud platform calculates the optimal driving state of the upstream and current vehicles. In some embodiments, the cloud platform calculates the driving route of the two vehicles, the driving speed of the two vehicles, the acceleration of the two vehicles, and/or the slope of the acceleration curve of the two vehicles. In some embodiments, the cloud platform sends an optimal driving state of the upstream and current vehicles to RSU 2601. In some embodiments, the cloud platform sends the driving route of the two vehicles, the driving speed of the two vehicles, the acceleration of the two vehicles, and/or the slope of the acceleration curve of the two vehicles to RSU 2501. In some embodiments, an RSU sends instructions to an OBU to control the operation of the vehicles, and the vehicles drive according to their respective instructions, e.g., the upstream vehicle and the current vehicle run straight ahead and downhill according to the instructions of their respective operations.

Figure 27A:
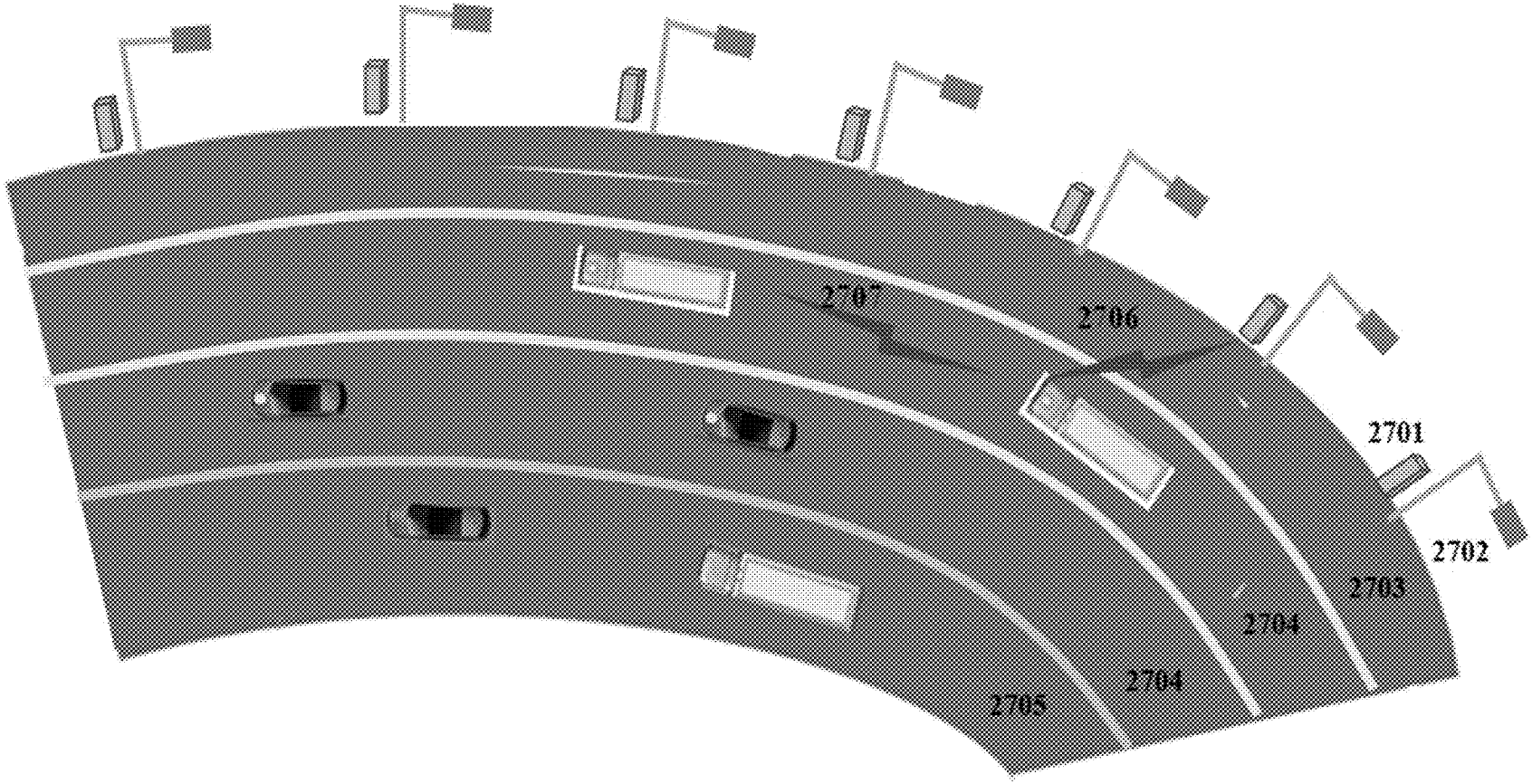
FIG. 27*a* illustrates vehicle control on a curve. Features shown in FIG. 27*a* include, e.g., 2701: RSU computing module (CPU, GPU); 2702: RSU sensing module (e.g., comprising DSRC-4G-LTE, RFID, Camera, Radar, and/or LED); 2703: Emergency lane; 2704: Dedicated lane; 2705: General lane; 2706: I2V; 2707: V2V.
Figure 27B:
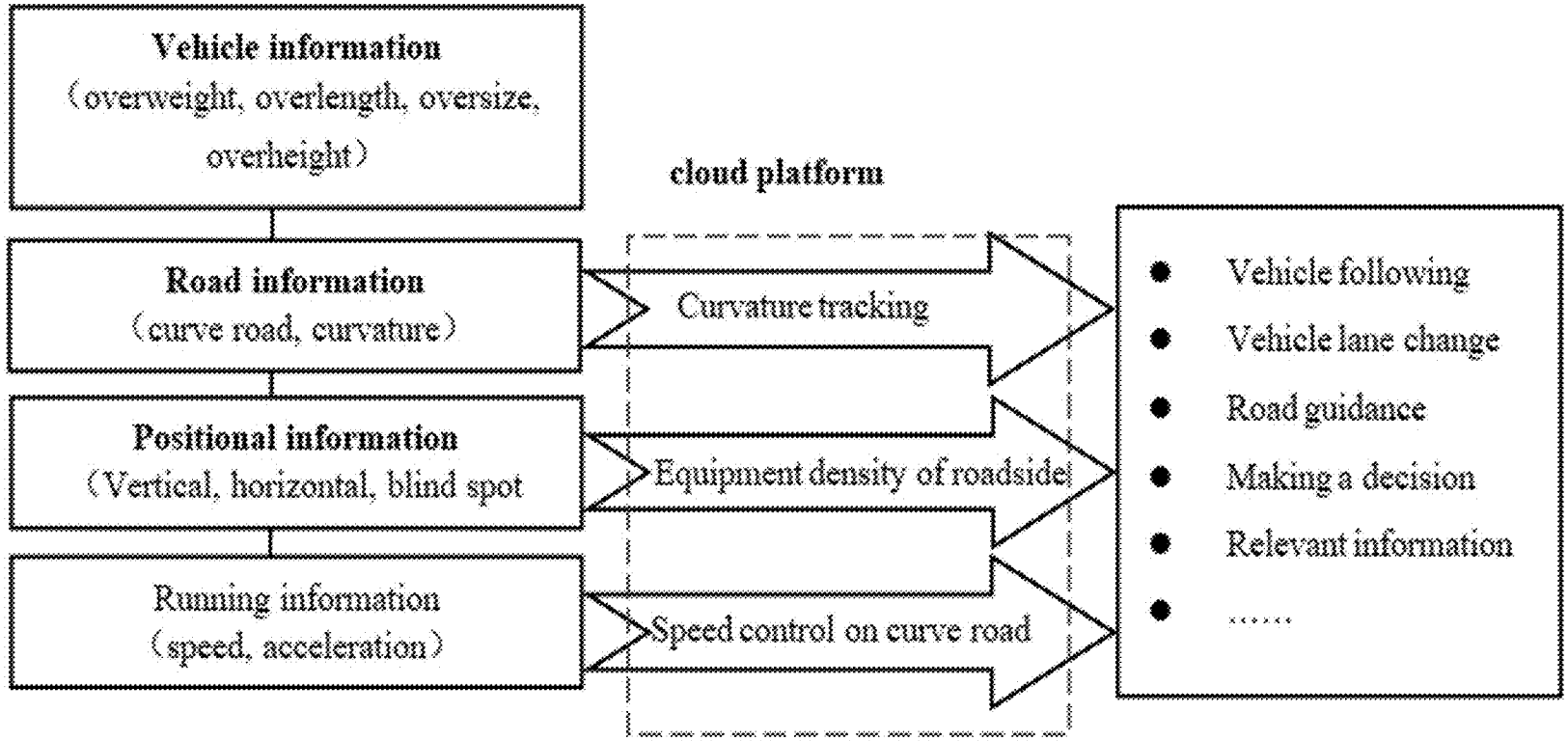
FIG. 27*b* is a block diagram of an embodiment of a method for controlling a vehicle on a curve.

As shown in FIG. 27*a* and FIG. 27*b*, embodiments of the technology relate to controlling vehicles on a curve. In some embodiments, RSU 2701 obtains the automatic driving curve and vehicle information. In some embodiments, a camera of an RSU sensing module 2702 and a radar of an RSU sensing module 2702 cooperate to detect obstacles around the vehicle. In some embodiments, the cloud platform accurately calculates the optimal driving conditions of each vehicle. For instance, in some embodiments the cloud platform calculates, e.g., driving routes of each vehicle, the turning routes of each vehicle, the turning radius of each vehicle, the driving speed of each vehicle, the acceleration of each vehicle, the deceleration of each vehicle, and/or the slope of the acceleration or deceleration curve of the two vehicles. In some embodiments, the cloud platform communicates with RSU 2701. In some embodiments, the RSU 2701 sends instructions to control the operation of a vehicle (e.g., separately from each other vehicle). In some embodiments, for vehicles that will enter a corner, the RSU 2701 sends instructions to control the operation of a vehicle (e.g., instructions relating to detour route, a specific speed, a specific steering angle) and the vehicle completes the left or right turn according to their respective instructions. In some embodiments, the speed and steering angle are gradually decreased as the vehicle proceeds through the curve. In some embodiments, the speed and steering angle are gradually increased after the vehicle exits the curve and enters a straight road.

Figure 28:
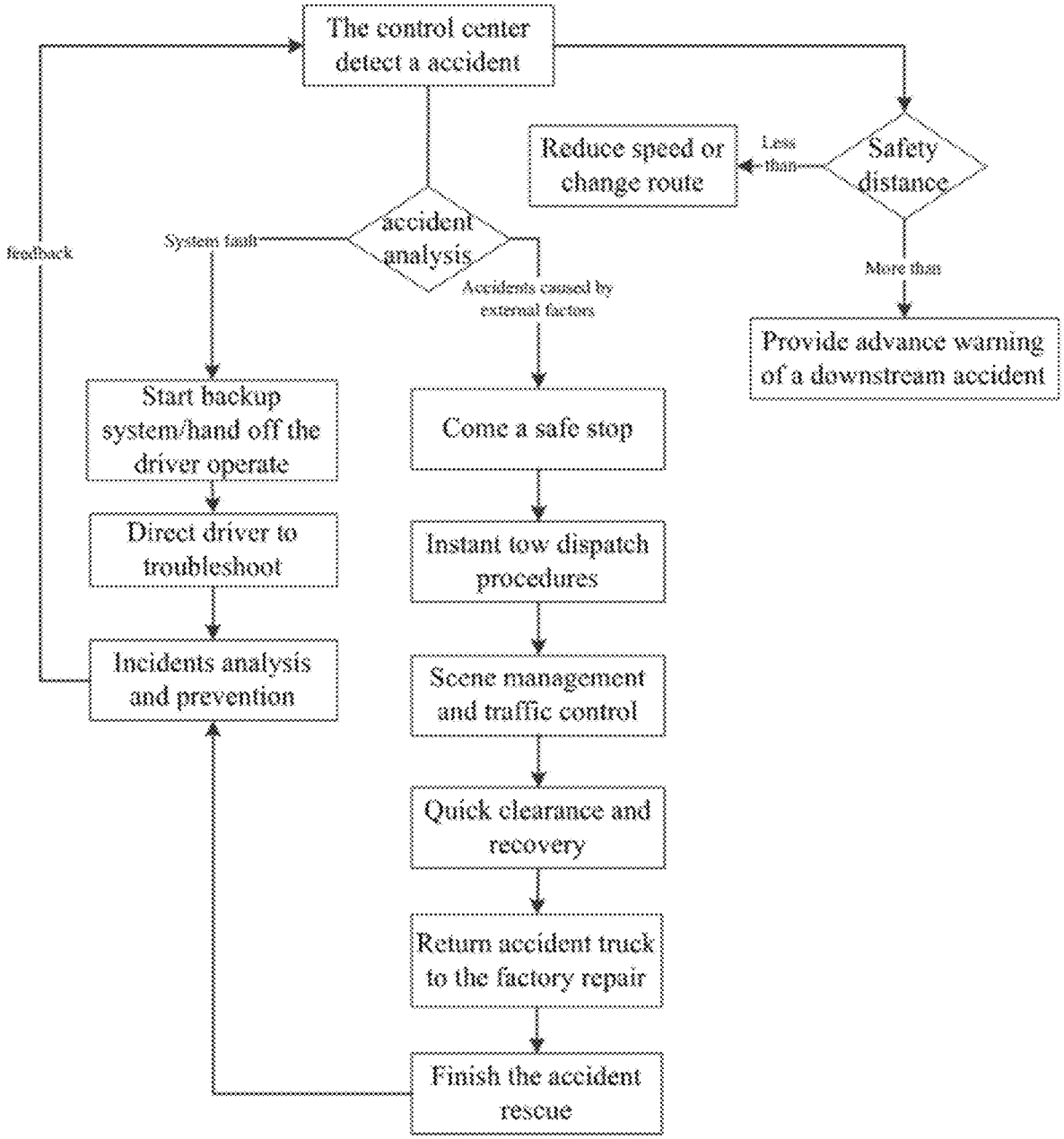
FIG. 28 is a flowchart for processing heavy vehicle-related emergencies and incidents.

As shown in the flowchart provided by FIG. 28, in some embodiments, the technology comprises collecting, analyzing, and processing data and information related to emergencies and incidents involving a special vehicle (e.g., a heavy vehicle). In some embodiments (e.g., when the control center detects an emergency or incident), the system conducts an accident analysis for the accident vehicle. In some embodiments, the system calculates the distance between the accident vehicle and other running vehicles. Then, in some embodiments (e.g., an accident caused by a system fault), the system starts a backup system for the accident vehicle or transfers control of the heavy vehicle. In some embodiments, (e.g., an accident caused by external factors) the system causes the accident vehicle to safely stop and the system will initiate processing for efficient clearance and recovery (e.g., towing) of the accident vehicle. In some embodiments, the system reduces speed or changes route of other vehicles (e.g., when the distance from a vehicle to the accident vehicle is less than a safe distance). In some embodiments, the system provides an advance warning of an accident ahead to other vehicles (e.g., when the distance from a vehicle to the accident vehicle is more than a safe distance).

Figure 29:
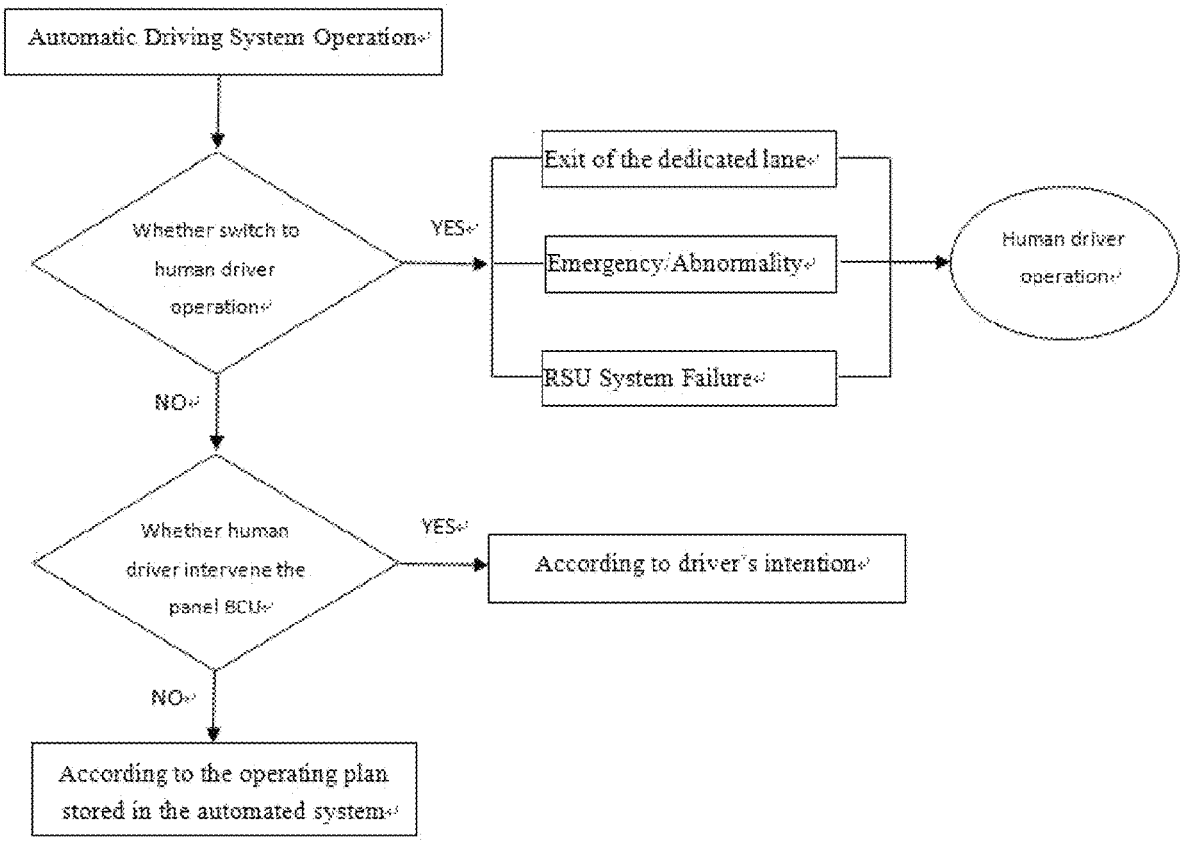
FIG. 29 is a flowchart for switching control of a vehicle between an automatic driving system and a human driver.

As shown in FIG. 29, in some embodiments the technology provides a switching process for transferring control of a vehicle between an automated driving system and a human driver. For example, in some embodiments (e.g., related to lower levels of automation), the human driver keeps his hands on the steering wheel and prepares to assume control of the vehicle using the steering wheel during the process of automated driving. In some embodiments, the vehicle OBD senses driver behavior. In some embodiments (e.g., in case of emergency or abnormality), the RSU and the OBD prompt the human driver to assume control of the vehicle (e.g., by a user using the steering wheel) via I2V and I2P. In some embodiments, in the process of automated driving, though the vehicle accords with the operating plan that is stored in the automated system, the human driver can intervene (e.g., using the panel BCU (Board Control Assembly)) to change temporarily the vehicle speed and lane position contrary to the main operation plan. In some embodiments, human intervention has a greater priority than the autopilot at any time. A general design is described in U.S. Pat. No. 9,845,096 (herein incorporated by reference in its entirety), which is not specifically for heavy vehicles operated by connected automated vehicle highway systems.

Figure 30:
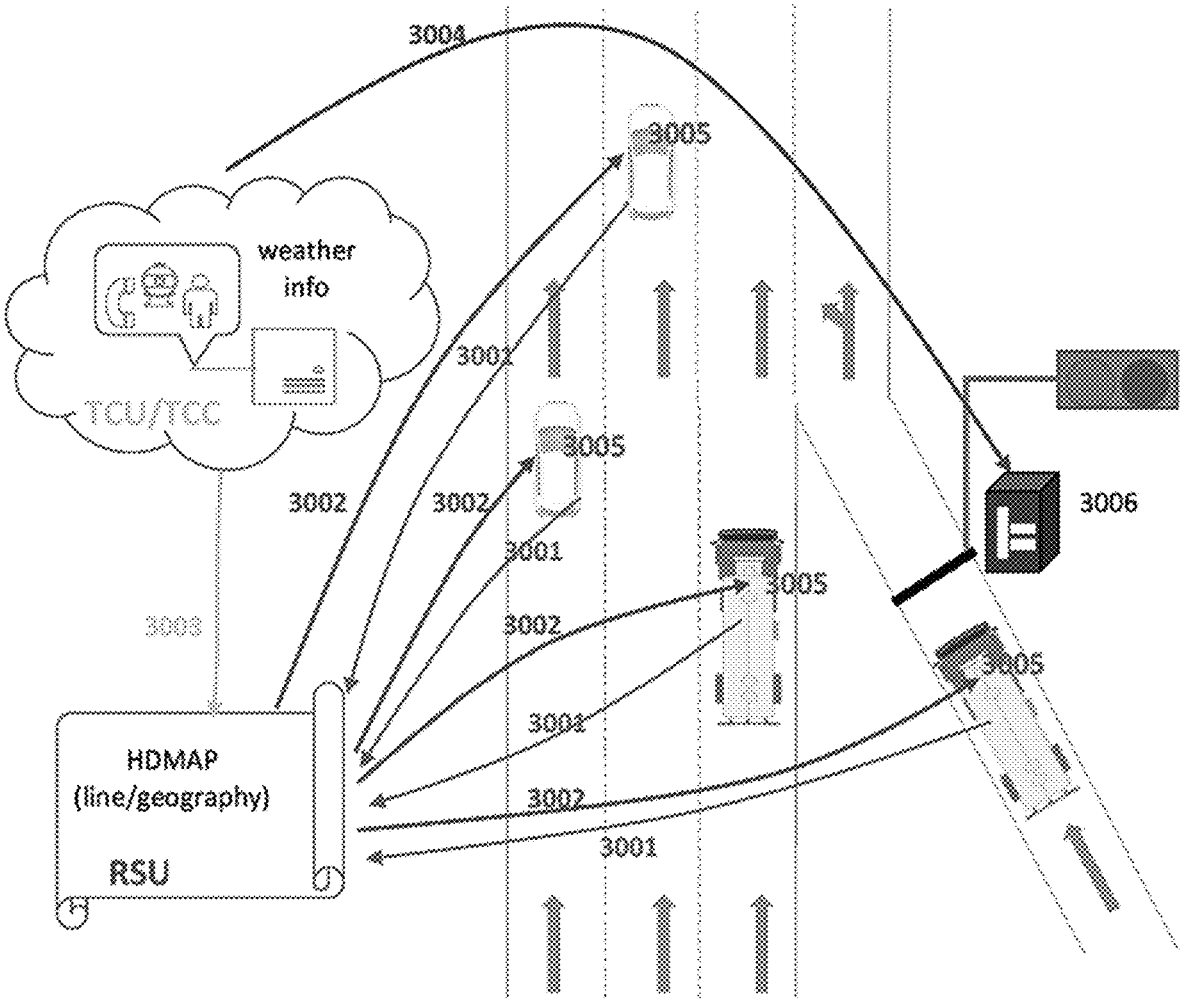
FIG. 30 illustrates heavy vehicle control in adverse weather. Features shown in FIG. 30 include, e.g., 3001: Heavy vehicle and other vehicle status, location, and sensor data; 3002: Comprehensive weather and pavement condition data and vehicle control instructions; 3003: Wide area weather and traffic information obtained by the TCU/TCC network; 3004: Ramp control information obtained by the TCU/TCC network; 3005: OBUs installed in heavy vehicles and other vehicles; 3006: Ramp controller.

As shown in FIG. 30, in some embodiments the technology relates to control of special vehicles (e.g., heavy vehicles) in adverse weather. In some embodiments, status, location, and sensor data related to special (e.g., heavy) vehicles and other vehicles are sent to HDMAP in real time. In some embodiments, once a TCU/TCC receives the adverse weather information, it will send the wide area weather and traffic information to HDMAP. In some embodiments, HDMAP sends the weather and traffic information, comprehensive weather and pavement condition data, vehicle control, routing, and/or schedule instructions to OBUs 3005 installed in special vehicles. In some embodiments, HDMAP sends ramp control information (e.g., obtained by a ramp control algorithm in the TCU/TCC network) to a ramp controller 3006.

Figure 31:
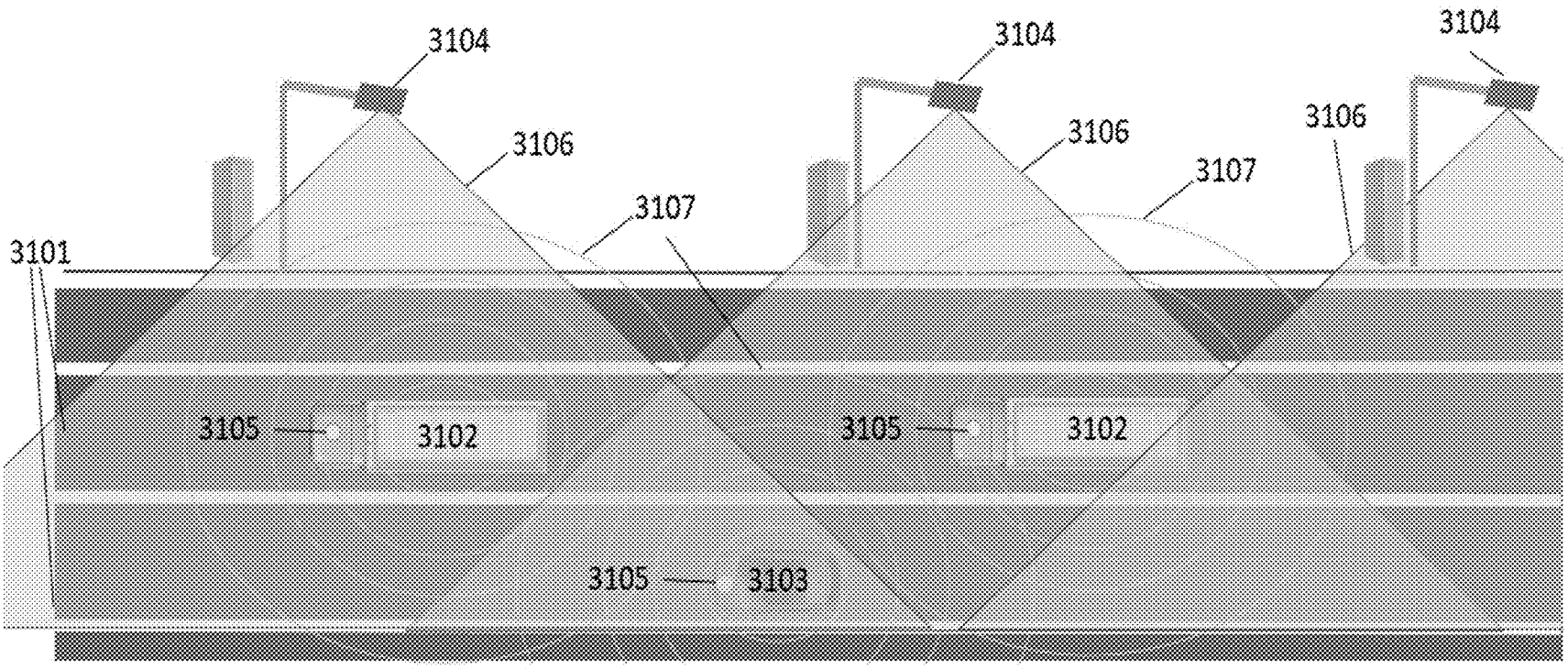
FIG. 31 illustrates detecting blind spots on a dedicated CAVH. Features shown in FIG. 31 include, e.g., 3101: Dedicated lanes; 3102: Connected and automated heavy vehicle; 3103: Connected and automated heavy car; 3104: RSU; 3105: OBU; 3106: Detection range of RSU; 3107: Detection range of OBU; 3301: Non-dedicated lanes.

As shown in FIG. 31, in some embodiments the technology relates to detecting blind spots on dedicated CAVH. For example, in some embodiments, data are collected from cameras, Lidar, Radar, and/or RFID components of an RSU. As shown in FIG. 31, the camera(s), Lidar, Radar, RFID in the RSU 3104 collect data describing the highway and vehicle conditions (e.g., the positions of all the vehicles 3102 and 3103, the headway between any two vehicles, all the entities around any vehicle, etc.) within the detection range of the RSU 3104. In some embodiments, the camera (s), Lidar, and/or Radar in a vehicle OBU collect data describing the conditions (e.g., lines, road markings, signs, and entities around the vehicle) around the vehicle comprising the OBU. In some embodiments, one or more of the OBU 3105 send real time data to an RSU 3104 (e.g., a nearby RSU, the closest RSU). In some embodiments, the distance between two RSU 3101 is determined by the detection range 3106 of a RSU 3104 and accuracy considerations. In some embodiments, the computing module in the RSU 3104 performs heterogeneous data fusion to characterize the road and vehicle environmental conditions accurately. Then, blind spots of special (e.g., heavy) vehicles are identified and/or minimized and/or eliminated. In some embodiments, the Traffic Control Unit (TCU) controls vehicles 3102 and 3103 driving automatically according to the road and vehicle data. In some embodiments, at the same time, the outputs of the data fusion of the road and vehicle condition computed by RSU 3104 are sent to the display screen installed on the vehicle 3102 and 3103, which is used to help the driver to observe the conditions and environment in all directions around the vehicle.

Figure 32:
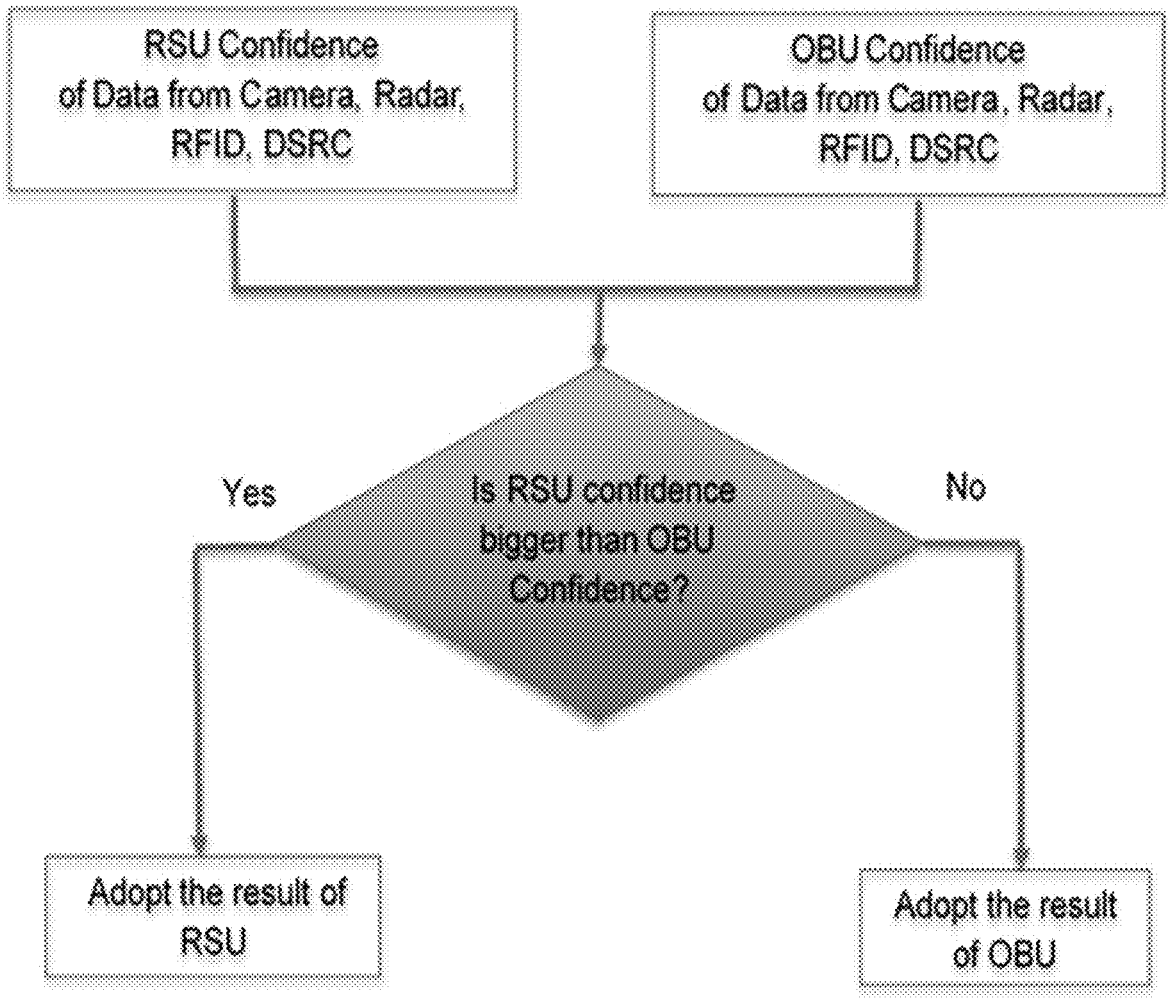
FIG. 32 illustrates data processing for detecting blind spots.

As shown in FIG. 32, in some embodiments, the technology comprises a data fusion process for assessing conflicting blind spot detection results from different data sources (e.g., RSU and OBU). In some embodiments, each data source is assigned a confidence level according to its application condition and real time location. Then, in some embodiments, when blind spot data detected from each data source is different, the system compares the confidence levels of each data source and adopts the blind spot data from the data source with the higher confidence level.

Figure 33:
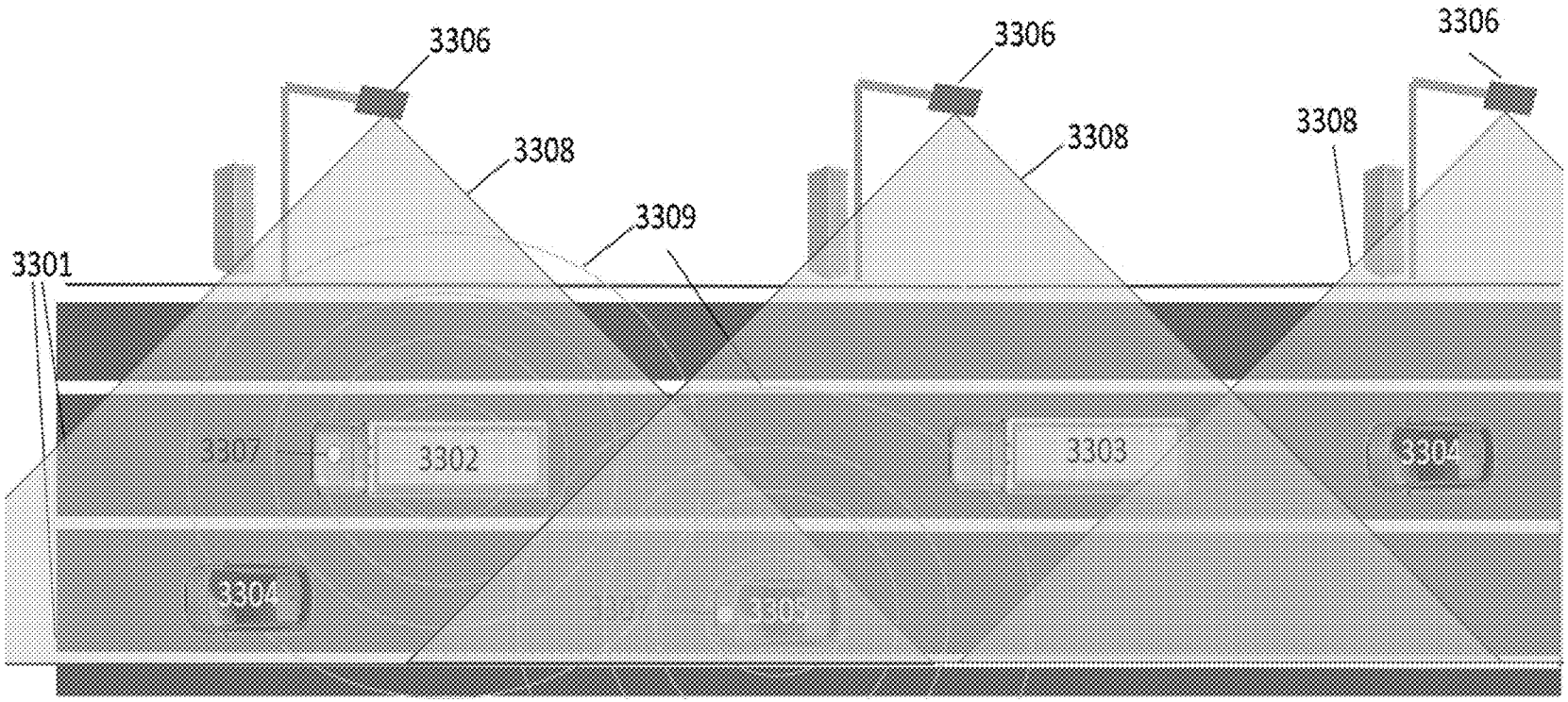
FIG. 33 illustrates an exemplary design for the detection of the blind spots on non-dedicated lanes. Features shown in FIG. 33 include, e.g., 3302: Connected and automated heavy vehicle; 3303: Non-automated heavy vehicle; 3304: Non-automated vehicle; 3305: Connected and automated car; 3306: RSU; 3307: OBU; 3308: Detection range of RSU; 3309: Detection range of OBU.

As shown in FIG. 33, in some embodiments, the technology provides detecting blind spots on non-dedicated lanes. In some embodiments, the facilities in RSU 3306 and OBU 3307 detect the obstacles around the automated vehicles 3302 and 3305, the obstacles around the non-automated vehicles 3303 and 3304, and moving objects on the road side. In some embodiments, these data are fused and information derived from the data fusion without any blind spot is used to control the connected and automated vehicles 3302 and 3305.

Figure 34:
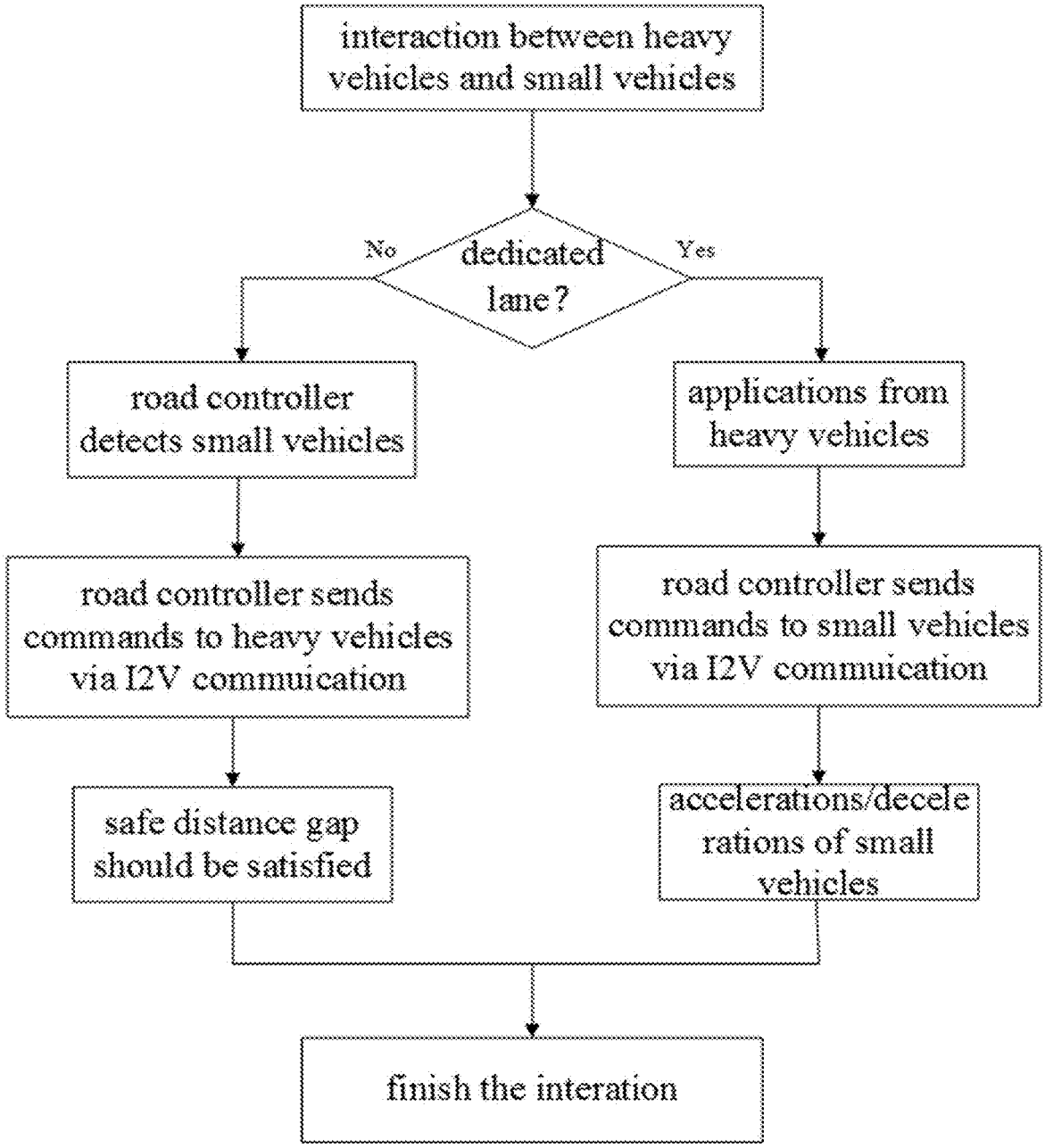
FIG. 34 illustrates interactions between heavy vehicles and small vehicles.

As shown in FIG. 34, embodiments of the technology relate to controlling interaction between special (e.g., heavy) vehicles and non-special (e.g., small) vehicles. In some embodiments, for a dedicated lane, the road controller receives interaction requests from automated special (e.g., heavy) vehicles and sends control commands to non-special (e.g., small) automated vehicles via infrastructure-to-vehicle (I2V) communication. Control on special vehicles is considered according to their characteristics, e.g., overlength, overweight, oversize, overheight, cargo, use, etc. In some embodiments, by controlling accelerations and/or decelerations of small automated vehicles on current and target lanes, the road controller maintains a safe distance gap for lane changing and overtaking by heavy vehicles. In some embodiments, for a non-dedicated lane, the road controller detects the non-automated non-special (e.g., small) vehicle on the non-dedicated lane and sends control commands to the automated special (e.g., heavy) vehicle upstream via I2V communication to warn that the automated special (e.g., heavy) vehicle should follow the non-automated non-special (e.g., small) vehicle with a sufficient safe distance gap due to the characteristics of the special vehicle, e.g., overlength, overweight, oversize, overheight, cargo, use, etc.

Figure 35:
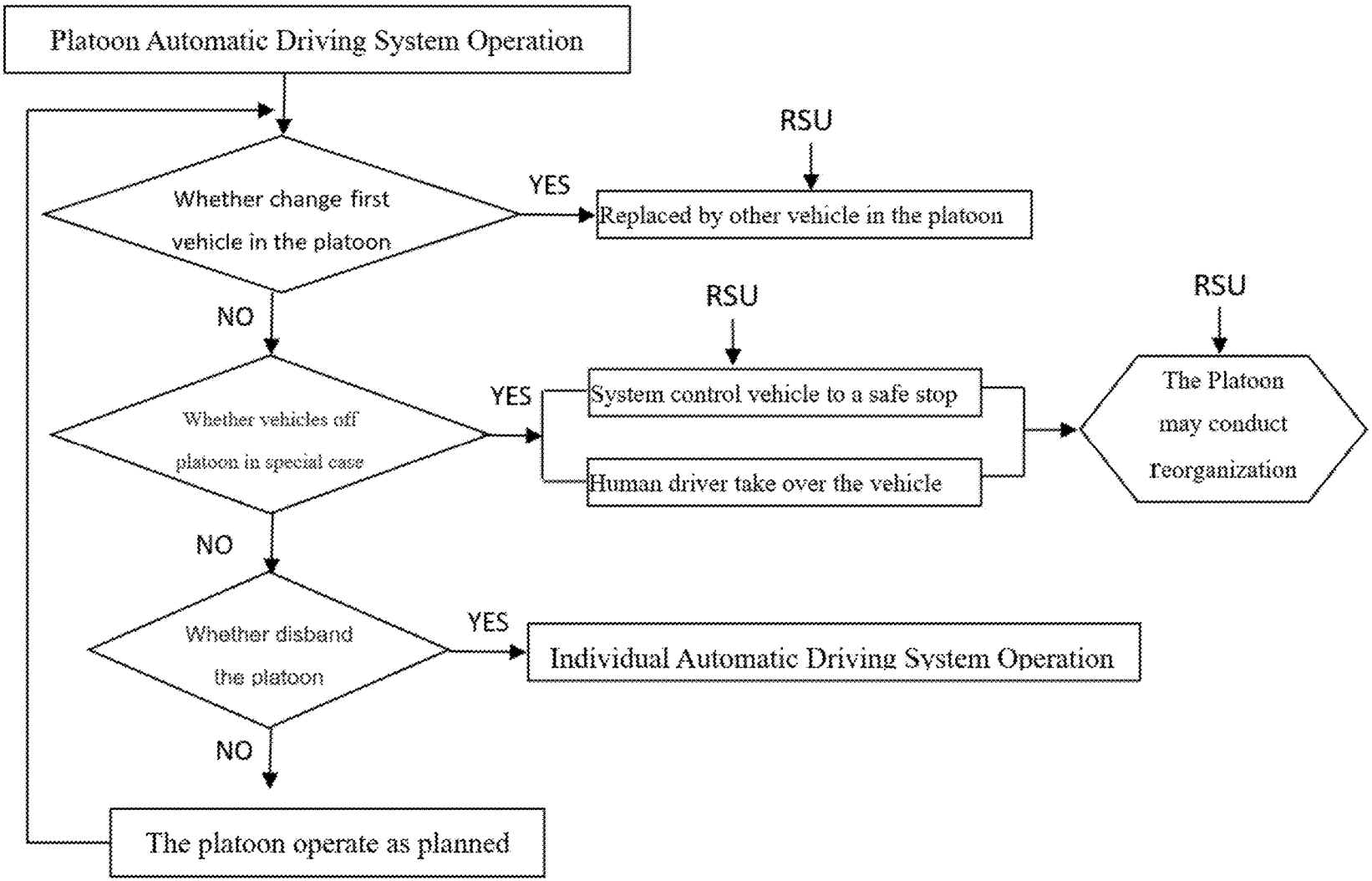
FIG. 35 illustrates control of automated vehicles in platoons.

As shown in FIG. 35, embodiments of the technology relate to automated vehicles driving in a platoon. For example, in some embodiments related to automated vehicle driving in a platoon and methods for switching between platoon and non-platoon driving, the driver of the first vehicle in the platoon can be the replaced by other rear vehicles regularly. See, e.g., U.S. Pat. No. 8,682,511, which describes a method for platoon of vehicles in an automated vehicle system, incorporated herein by reference. While the technology of U.S. Pat. No. 8,682,511 is designed for an automated vehicle system, it does not describe a connected automated vehicle highway systems. Additionally, U.S. Pat. No. 9,799,224 describes a platoon travel system in which plural platoon vehicles travel in vehicle groups. While the technology of U.S. Pat. No. 9,799,224 is designed for a platoon travel system, it does not describe a connected automated vehicle highway system and does not describe a system comprising one or more dedicated lane.

We claim:

1. A vehicle operations and control system for controlling special vehicles, said system comprising a) a roadside unit (RSU) network comprising a plurality of RSUs in road infrastructure, each of the plurality of RSUs configured to receive data from special vehicles, detect traffic conditions, and send control instructions to special vehicles; wherein each of the plurality of RSUs comprise a communications module, a sensing module, and a data processing module; the RSU network generates and provides vehicle specific control instructions including vehicle longitudinal and lateral speed, acceleration, and movement, and angular movement; and the RSU network conducts transportation behavior prediction and management, and provides planning and decision making;

b) a Traffic Control Unit (TCU) and Traffic Control Center (TCC) network comprising a TCU and a TCC residing in a remote facility, that processes information and traffic operations instructions and provides control instructions to special vehicles;

c) a vehicle comprising an onboard unit (OBU);

d) a cloud-based platform configured to provide information and computing services, wherein said TCC and TCU are automatic or semi-automated computational modules that conduct planning and decision making; provide data gathering, data processing, information processing, network optimization, and traffic control; and generate and provide vehicle specific control instructions including vehicle longitudinal and lateral speed, acceleration, and movement, and angular movement; and wherein said vehicle operations and control system is configured to provide individual special vehicles with detailed control instructions for vehicle following, lane changing, and route guidance including vehicle longitudinal and lateral speed, acceleration, and movement, and angular movement; and wherein said system is configured to provide sensing functions, transportation behavior prediction and management functions, planning and decision-making functions, and vehicle control functions by using the plurality of RSUs, the OBU, the TCU, the TCC, and the cloud-based platform; and wherein said transportation behavior prediction and management function is configured to provide:

a) longitudinal control of one or more vehicles, wherein said longitudinal control comprises controlling automated heavy vehicle platoons, automated heavy and light vehicle platoons, and automated and manual vehicle platoons, and said longitudinal control instructions include vehicle longitudinal speed, acceleration, deceleration, and movement;

b) a freight priority management system for controlling heavy vehicle priority levels to reduce the acceleration and deceleration of automated vehicles and for providing smooth traffic movement on dedicated or non-dedicated lanes;

c) weight loading monitoring for one or more vehicles, wherein said weight loading monitoring comprises use of an artificial intelligence-based vehicle loading technology, cargo weight and packing volume information, and vehicle specification information;

d) special event notifications comprising information for goods type, serial number, delivery station, loading vehicle location, unloading vehicle location, shipper, consignee, vehicle number, and loading quantity;

e) incident detection comprising monitoring status of tires, status of braking components, and status of sensors;

f) manage oversize and/or overweight (OSOW) vehicles; to provide routing services for OSOW vehicles;

g) provide permitting services for OSOW vehicles, wherein said permitting services comprise applying for permits, paving for permits, and receiving approved routes based on road system constraints and the intended vehicle and load characteristics; and h) provide route planning and guidance to vehicles comprising providing vehicles with routes and schedules according to vehicle length, height, load weight, axis number, origin, and destination.

2. The system of claim 1 wherein said system controls a special vehicle chosen from the group consisting of an oversize vehicle, an overweight vehicle, a vehicle transporting special goods, a scheduled vehicle, a delivery vehicle, and an emergency vehicle, by sending control instructions including vehicle's longitudinal and lateral speed, acceleration, and movement, and angular movement.

3. The system of claim 1 further comprising one or more highway lanes and said system is configured to provide: (1) dedicated lane(s) shared by automated heavy and light vehicles; (2) dedicated lane(s) for automated heavy vehicles separated from dedicated lane(s) for automated, light vehicles; and (3) non-dedicated lane(s) shared by automated and human-driven vehicles.

4. The system of claim 1 comprising an interactive interface in the TCC configured to manage vehicle platoons.

5. The system of claim 1 wherein said cloud platform is configured to provide methods for fleet maintenance comprising remote vehicle diagnostics, intelligent fuel-saving driving, and intelligent charging and refueling.

6. The system of claim 1 wherein said cloud platform is configured to support:

a) real-time information exchange and sharing among vehicles, cloud, and infrastructure; and b) analyze vehicle conditions comprising a vehicle characteristic that is one or more of overlength, overheight, overweight, oversize, turning radius, moving uphill, moving downhill, acceleration, deceleration, blind spot, and carrying hazardous goods.

7. The system of claim 1 wherein said sensing function for automated heavy vehicles comprises:

a) sensing overheight, overwidth, or overlength vehicles using a vision sensor; using a pressure sensor or weigh-in-motion device; or using a geometric leveling method, a GPS elevation fitting method, or a GPS geoid refinement method; or b) sensing vehicles transporting hazardous goods using a vehicle OBU or chemical sensors.

8. The system of claim 7 wherein oversize vehicle information or vehicle hazardous goods information for automated heavy vehicles is collected from said sensing function, sent to a special information center, and shared through the cloud platform for generating control instructions for automated vehicle control.

9. The system of claim 1 wherein said system is further configured in one of the plurality of RSUs or the TCU and TCC network to a) plan routes and dispatch vehicles transporting hazardous goods for automated heavy vehicles; and b) transmit route and dispatch information for automated heavy vehicles transporting hazardous goods to other vehicles.

10. The system of claim 1 further configured to provide a hazard transportation management function, wherein an automated heavy vehicle transporting a hazard is:

a) identified with an electronic tag providing information comprising the type of hazard, vehicle origin, vehicle destination, and vehicle license or permit; and b) tracked by the vehicle OBU and the RSU network from vehicle origin to vehicle destination.

11. A vehicle operations and control system for controlling special vehicles, said system comprising:

a) a roadside unit (RSU) network comprising a plurality of RSUs in road infrastructure, each of the plurality of RSUs configured to receive data from special vehicles, detect traffic conditions, and send control instructions to special vehicles;

wherein each of the plurality of RSUs comprise a communications module, a sensing module, and a data processing module;

the RSU network generates and provides vehicle specific control instructions including vehicle longitudinal and lateral speed, acceleration, and movement, and angular movement; and the RSU network conducts transportation behavior prediction and management, and provides planning and decision making;

b) a Traffic Control Unit (TCU) and Traffic Control Center (TCC) network comprising a TCU and a TCC residing in a remote facility, that processes information and traffic operations instructions and provides control instructions to special vehicles;

c) a vehicle comprising an onboard unit (OBU);

d) a cloud-based platform configured to provide information and computing services, wherein said TCC and TCU are automatic or semi-automated computational modules that conduct planning and decision making; provide data gathering, data processing, information processing, network optimization, and traffic control; and generate and provide vehicle specific control instructions including vehicle longitudinal and lateral speed, acceleration, and movement, and angular movement; and wherein said vehicle operations and control system is configured to provide individual special vehicles with detailed control instructions for vehicle following, lane changing, and route guidance including vehicle longitudinal and lateral speed, acceleration, and movement, and angular movement; and further configured to provide a hazard transportation management function, wherein an automated heavy vehicle transporting a hazard is:

identified with an electronic tag providing information comprising the type of hazard, vehicle origin, vehicle destination, and vehicle license or permit; and tracked by the vehicle OBU and the RSU network from vehicle origin to vehicle destination; and wherein said hazard transportation management function implements a route planning algorithm in one of the plurality of RSUs or the TCU and TCC network for automated heavy transport vehicles comprising travel cost, traffic, and road condition.

12. A vehicle operations and control system for controlling special vehicles, said system comprising:

a) a roadside unit (RSU) network comprising a plurality of RSUs in road infrastructure, each of the plurality of RSUs configured to receive data from special vehicles, detect traffic conditions, and send control instructions to special vehicles;

wherein each of the plurality of RSUs comprise a communications module, a sensing module, and a data processing module;

the RSU network generates and provides vehicle specific control instructions including vehicle longitudinal and lateral speed, acceleration, and movement, and angular movement; and the RSU network conducts transportation behavior prediction and management, and provides planning and decision making b) a Traffic Control Unit (TCU) and Traffic Control Center (TCC) network comprising a TCU and a TCC residing in a remote facility, that processes information and traffic operations instructions and provides control instructions to special vehicles;

c) a vehicle comprising an onboard unit (OBU);

d) a cloud-based platform configured to provide information and computing services, wherein said TCC and TCU are automatic or semi-automated computational modules that conduct planning and decision making; provide data gathering, data processing, information processing, network optimization, and traffic control; and generate and provide vehicle specific control instructions including vehicle longitudinal and lateral speed, acceleration, and movement, and angular movement; and wherein said vehicle operations and control system is configured to provide individual special vehicles with detailed control instructions for vehicle following, lane changing, and route guidance including vehicle longitudinal and lateral speed, acceleration, and movement, and angular movement; and a heavy vehicle emergency and incident management system configured to:

identify and detect heavy vehicles involved in an emergency or incident;

analyze and evaluate an emergency or incident;

provide warnings and notifications related to an emergency or incident; and provide heavy vehicle control strategies by sending control instructions including vehicle's longitudinal and lateral speed, acceleration, and movement, and angular movement for emergency and incident response and action plans.

13. The system of claim 1 configured to provide detection, warning, and control functions for a special vehicle on specific road segments, wherein a TCC provides vehicle related control strategies by sending control instructions including vehicle's longitudinal and lateral speed, acceleration, and movement, and angular movement based on information comprising site-specific road environment information.

14. The system of claim 1 configured to implement a method comprising managing heavy vehicles and small vehicles on dedicated lanes and non-dedicated lanes.

15. The system of claim 1 configured to switch a platoon vehicle from automated driving mode to non-automated driving mode and to reorganize a platoon of automated and non-automated vehicles.

16. The system of claim 1 configured to provide safety and efficiency functions for heavy vehicle operations and control by sending control instructions including vehicle's longitudinal and lateral speed, acceleration, and movement, and angular movement under adverse weather conditions, wherein said heavy vehicle operations and control comprises use of:

a) information from a high-definition map and location service and a site-specific road weather and pavement condition information service; and b) information describing a type of hazardous goods transported by a heavy vehicle.

17. The system of claim 16 wherein said safety and efficiency functions provide an automated heavy vehicle routing and schedule service comprising use of site-specific road weather information and information for the type of cargo, wherein the type of cargo is one or more of hazardous, non-hazardous, temperature sensitive, and has a time of delivery requirement, wherein temperature sensitive means that the condition of the goods alters in response to temperature, and time of delivery requirement represents a time that the goods are required to deliver at.

18. A vehicle operations and control system for controlling special vehicles, said system comprising:

a) a roadside unit (RSU) network comprising a plurality of RSUs in road infrastructure, each of the plurality of RSUs configured to receive data from special vehicles, detect traffic conditions, and send control instructions to special vehicles;

wherein each of the plurality of RSUs comprise a communications module, a sensing module, and a data processing module;

the RSU network generates and provides vehicle specific control instructions including vehicle longitudinal and lateral speed, acceleration, and movement, and angular movement; and the RSU network conducts transportation behavior prediction and management, and provides planning and decision making b) a Traffic Control Unit (TCU) and Traffic Control Center (TCC) network comprising a TCU and a TCC residing in a remote facility, that processes information and traffic operations instructions and provides control instructions to special vehicles;

c) a vehicle comprising an onboard unit (OBU);

d) a cloud-based platform configured to provide information and computing services, wherein said TCC and TCU are automatic or semi-automated computational modules that conduct planning and decision making provide data gathering, data processing, information processing, network optimization, and traffic control; and generate and provide vehicle specific control instructions including vehicle longitudinal and lateral speed, acceleration, and movement, and angular movement; and wherein said vehicle operations and control system is configured to provide individual special vehicles with detailed control instructions for vehicle following, lane changing, and route guidance including vehicle longitudinal and lateral speed, acceleration, and movement, and angular movement; and wherein the system is configured to provide a blind spot detection function for heavy vehicles, wherein:

data collected by the RSU and OBU are used to determine a road status and vehicle environment status to provide sensing coverage of blind spots for heavy vehicles in dedicated lanes;

the RSU network performs a heterogeneous data fusion of multiple data sources to determine a road status and vehicle environment status to provide sensing coverage of blind spots for heavy vehicles in dedicated lanes; and data collected by the RSU and OBU are used to minimize or eliminate blind spots for heavy vehicles in dedicated lanes, and wherein the RSU detection of blind spots complements or replaces the vehicle detection of blind spots when the vehicle sensing is blocked by obstacles including road infrastructure, buildings, trees, other vehicles, and weather events.

19. The system of 276 wherein the system obtains:

a) a confidence value associated with data provided by the RSU network; and b) a confidence value associated with data provided by an OBU; and the system uses the data associated with the higher confidence value to identify blind spots using the blind spot detection function.

20. The system of claim 18 wherein road and vehicle condition data from the RSU network and the OBU are fused with blind spot information for display on a screen installed in the vehicle for use by a driver to observe all the directions around the vehicle.

* * * * *